US010343296B2

(12) United States Patent
Hall et al.

(10) Patent No.: US 10,343,296 B2
(45) Date of Patent: Jul. 9, 2019

(54) POWER OPERATED ROTARY KNIFE WITH NOTCHED ROTARY KNIFE BLADE AND TRIM GUIDE

(71) Applicant: Bettcher Industries, Inc., Birmingham, OH (US)

(72) Inventors: Joel L. Hall, Cleveland, OH (US); Terrence A. Pagano, North Royalton, OH (US); Kevin V. Stump, Wellington, OH (US)

(73) Assignee: Bettcher Industries, Inc., Birmingham, OH (US)

( * ) Notice: Subject to any disclaimer, the term of this patent is extended or adjusted under 35 U.S.C. 154(b) by 30 days.

(21) Appl. No.: 15/216,120

(22) Filed: Jul. 21, 2016

(65) Prior Publication Data

US 2017/0021514 A1 Jan. 26, 2017

Related U.S. Application Data

(60) Provisional application No. 62/196,973, filed on Jul. 25, 2015.

(51) Int. Cl.
*A01D 34/81* (2006.01)
*B26B 25/00* (2006.01)
(Continued)

(52) U.S. Cl.
CPC ..... *B26B 25/002* (2013.01); *B26B 29/06* (2013.01); *B26D 7/1863* (2013.01)

(58) Field of Classification Search
CPC ..... A01D 34/81; A01D 34/828; A22B 5/165; A22B 5/168; B26B 25/002; B26B 29/06; B26D 7/1863
(Continued)

(56) References Cited

U.S. PATENT DOCUMENTS 2,281,531 A * 4/1942 Casner ..... B26B 19/14 30/346.51
2,720,696 A * 10/1955 Wadsworth ..... B26B 19/14 30/41.5
(Continued)

FOREIGN PATENT DOCUMENTS

EP 0816026 A1 1/1998
EP 2168730 A1 3/2010
WO WO 00/15024 3/2000

OTHER PUBLICATIONS

PCT International Search Report and Written Opinion of the International Searching Authority dated Jul. 22, 2016 for PCT International Application No. PCT/US2016/043484. PCT International Application No. PCT/US2016/043484 claims priority from the present application, namely, U.S. Appl. No. 15/216,120, filed Jul. 21, 2016. (13 pages).
(Continued)

*Primary Examiner* — Andrea L Wellington
*Assistant Examiner* — Fernando A Ayala
(74) *Attorney, Agent, or Firm* — Tarolli, Sundheim, Covell & Tummino LLP

(57) ABSTRACT

A combination of a rotary knife blade and a trim guide for a power operated rotary knife. The annular rotary knife blade supported for rotation about a central axis of rotation in a direction of rotation and rotating with respect to the trim guide, the knife blade including a blade section extending from an annular body, the lower end of the blade section defining a plurality of circumferentially spaced apart notches including an opening at the lower end and a central open portion defined by a peripheral wall, the peripheral wall including an arcuate cutting portion adjacent the lower end of the blade section. The trim guide including a guide section defining a plurality of circumferentially spaced apart notches extending from a lower end, each of the plurality of notches
(Continued)

including a shearing portion in overlapping axial alignment with the arcuate cutting portions of the blade section.

30 Claims, 35 Drawing Sheets

(51) Int. Cl.
*B26B 29/06* (2006.01)
*B26D 7/18* (2006.01)

(58) Field of Classification Search
USPC ..... 30/276; 452/132, 130, 137
See application file for complete search history.

(56) References Cited

U.S. PATENT DOCUMENTS 2,740,198 A * 4/1956 Edgett ..... A01G 3/0535 30/276
2,883,746 A * 4/1959 Gilsi ..... A01G 3/0535 30/276
3,077,664 A * 2/1963 Murawski ..... A01D 34/78 30/228
4,439,924 A 4/1984 Bettcher
4,637,140 A 1/1987 Bettcher
4,854,046 A 8/1989 Decker et al.
4,858,321 A * 8/1989 McCullough ..... B26B 25/002 30/276
4,987,681 A 1/1991 Sepke
5,020,226 A * 6/1991 Chabbert ..... A61F 15/02 30/373
5,404,644 A * 4/1995 Needham ..... A01G 1/12 172/378
5,445,561 A * 8/1995 Elmer ..... A22B 5/163 30/347
5,588,289 A * 12/1996 Wilson ..... A01G 3/0535 30/124
5,692,307 A * 12/1997 Whited ..... B26B 25/002 30/276
5,940,972 A 8/1999 Baris et al.
6,013,079 A 1/2000 Salam
6,354,949 B1 3/2002 Baris et al.
6,413,157 B1 7/2002 Marton
6,662,452 B2 12/2003 Whited
6,665,943 B1 * 12/2003 Sloane ..... A01G 3/0535 30/206
6,751,872 B1 6/2004 Whited et al.
6,769,184 B1 8/2004 Whited
6,857,191 B2 2/2005 Whited
6,978,548 B2 12/2005 Whited et al.
7,152,323 B1 * 12/2006 Lin ..... B26B 19/148 30/29.5
7,207,114 B2 4/2007 Rosu et al.
7,458,161 B2 12/2008 Wilson
D618,253 S 6/2010 Wilson et al.
D630,480 S 1/2011 Wilson
8,240,055 B2 8/2012 Gooding
8,448,340 B2 5/2013 Whited
8,661,692 B2 3/2014 Whited et al.
8,726,524 B2 5/2014 Whited et al.
8,745,881 B2 6/2014 Thompson et al.
8,756,819 B2 6/2014 Whited et al.
8,968,107 B2 3/2015 Rapp et al.
9,265,263 B2 2/2016 Whited et al.
9,452,541 B2 9/2016 Mascari et al.
9,579,810 B2 2/2017 Mascari
9,592,076 B2 3/2017 Esarey et al.
2003/0084576 A1 5/2003 Whited et al.
2004/0088864 A1 5/2004 Whited
2004/0211067 A1 10/2004 Whited et al.
2008/0098605 A1 * 5/2008 Whited ..... B26B 25/002 30/276
2008/0110026 A1 5/2008 Marcoe
2010/0101097 A1 * 4/2010 Thien ..... B26B 25/002 30/276
2011/0072669 A1 * 3/2011 Morisugi ..... B26B 19/148 30/29.5
2013/0025138 A1 1/2013 Whited et al.
2013/0104404 A1 * 5/2013 Levsen ..... A22C 17/12 30/276
2013/0174424 A1 7/2013 Whited
2013/0219726 A1 8/2013 Rosu et al.
2014/0074120 A1 3/2014 Esarey et al.
2014/0250697 A1 9/2014 Steele et al.
2017/0210024 A1 7/2017 Mascari

OTHER PUBLICATIONS

User Manual for Garden Groom Versa Trim Collecting Trimmer (Model No. GG30), publication date Jun. 15, 2009. (10 pages).
User Manual for Garden Groom PRO Safety Hedge Trimmer (Model No. GG21), upon information and belief, publication date is at least as early as Jul. 24 2014. (6 pages).
User Manual for Garden Groom Garden Barber Cordless Collecting Hedge and Shrub Trimmer (Model No. GG41), upon information and belief, publication date is at least as early as Jul. 24, 2014. (6 pages).
Extended European Search Report dated Dec. 3, 2018 for European Application No. 16831110.8, filed Jan. 25, 2018. European Application No. 16831110.8 is a regional phase application of PCT International Application No. PCT/US 2016/043,484, filed Jul. 22, 2016. PCT International Application No. PCT/US 2016/043,484 claims priority from the present application. (7 pages).

* cited by examiner

POWER OPERATED ROTARY KNIFE WITH NOTCHED ROTARY KNIFE BLADE AND TRIM GUIDE

CROSS REFERENCE TO RELATED APPLICATION

The following application claims priority to U.S. Provisional Patent Application Ser. No. 62/196,973, filed Jul. 25, 2015 entitled Power Operated Rotary Knife With Notched Rotary Knife Blade and Trim Guide. The above-identified U.S. provisional patent application (Ser. No. 62/196,973) is fully incorporated herein by reference in its entirety for any and all purposes.

TECHNICAL FIELD

The present disclosure relates to a power operated rotary knife including a notched annular rotary knife blade and a notched annular trim guide, the notched trim guide directing elements to be cut into position for cutting between recessed, sharpened regions or cutting portions of the rotary knife blade against recessed shearing portions of the notched trim guide.

BACKGROUND

Power operated rotary knives are widely used in meat processing facilities for meat cutting and trimming operations. Power operated rotary knives also have application in a variety of other industries where cutting and/or trimming operations need to be performed quickly and with less effort than would be the case if traditional manual cutting or trimming tools were used, e.g., long knives, scissors, nippers, etc. By way of example, power operated rotary knives may be effectively utilized for such diverse tasks as taxidermy; cutting and trimming of elastomeric or urethane foam for a variety of applications including vehicle seats; and tissue removal or debriding in connection with medical/surgical procedures and/or tissue recovery from a body of a human or animal donor.

Power operated rotary knives typically include a head assembly and an elongated handle assembly releasably affixed to the head assembly. The handle assembly extends along a longitudinal axis and includes a hand piece having a gripping surface to be grasped by an operator or user to manipulate the power operated rotary knife. The handle assembly may include a central core or other attachment structure to releasably attach the handle assembly to the head assembly.

The head assembly includes an annular blade housing and an annular rotary knife blade supported for rotation by the blade housing. The annular rotary blade of conventional power operated rotary knives is typically rotated by a drive assembly which include a flexible shaft drive assembly extending through an opening in the handle assembly. The shaft drive assembly engages and rotates a drive train, such as, for example, a pinion gear supported by the head assembly. The flexible shaft drive assembly includes a stationary outer sheath and a rotatable interior drive shaft which is driven by an electric motor. Gear teeth of the pinion gear engage mating gear teeth formed on an upper surface of the rotary knife blade. Alternately, a pneumatic motor disposed in a throughbore of the handle assembly may be used to drive the pinion gear supported by the head assembly which, in turn, rotates the rotary knife blade.

Upon rotation of the pinion gear by the drive shaft of the flexible shaft drive assembly, the annular rotary blade rotates within the blade housing at a high RPM, on the order of 500-1500 RPM, depending on the structure and characteristics of the drive assembly including the motor, the shaft drive assembly, and a diameter and the number of gear teeth formed on the rotary knife blade. Conventional power operated rotary knives are disclosed in U.S. Pat. No. 6,354,949 to Baris et al., U.S. Pat. No. 6,751,872 to Whited et al., U.S. Pat. No. 6,769,184 to Whited, and U.S. Pat. No. 6,978,548 to Whited et al., all of which are assigned to the assignee of the present invention and all of which are incorporated herein in their respective entireties by reference.

SUMMARY

In one aspect, the present disclosure relates to a power operated rotary knife comprising: an annular rotary knife blade supported for rotation about a central axis of rotation in a direction of rotation and rotating with respect to a trim guide, the knife blade including an annular body including an inner wall and an outer wall and an upper end and a lower end, the annular body of the rotary knife blade including a bearing surface for rotational support of the rotary knife blade and a driven gear for rotationally driving the rotary knife blade, the rotary knife blade further including a blade section extending from the lower end of the annular body, the blade section including a blade frustoconical wall extending between an upper end of the blade section and a lower end of the blade section, the lower end of the blade section spaced radially inwardly from and axially below the upper end, a plurality of circumferentially spaced apart notches extending from the lower end of the blade section into the blade frustoconical wall, each of the plurality of notches including an opening at the lower end and a central open portion defined by a peripheral wall, the peripheral wall including a cutting portion, the cutting portion of each of the plurality of circumferentially spaced apart notches defining a cutting edge of the rotary knife blade; and a trim guide including a base and a guide section extending radially inwardly and axially downwardly from the base, the guide section extending axially below and being adjacent to the blade section of the rotary knife blade and including a guide frustoconical wall extending between an upper end of the guide section and a lower end of the guide section, the lower end of the guide section spaced radially inwardly from the upper end, a plurality of circumferentially spaced apart notches extending from the lower end into the guide frustoconical wall, each of the plurality of notches including as opening at the lower end and a central open portion defined by a peripheral wall, the peripheral wall including a shearing portion, the shearing portion in overlapping axial alignment with the cutting portions of the plurality of notches of the blade section of the rotary knife blade as the rotary blade rotates about the central axis of rotation.

In another aspect, the present disclosure relates to a combination of an annular rotary knife blade and a trim guide for a power operated rotary knife, the combination comprising: the annular rotary knife blade supported for rotation about a central axis of rotation in a direction of rotation and rotating with respect to the trim guide, the knife blade including an annular body including an inner wall and an outer wall and an upper end and a lower end, the annular body of the rotary knife blade including a bearing surface for rotational support of the rotary knife blade and a driven gear for rotationally driving the rotary knife blade, the rotary knife blade further including a blade section extending from the lower end of the annular body, the blade section including a blade frustoconical wall extending between an upper end of the blade section and a lower end of the blade section, the lower end of the blade section spaced radially inwardly from and axially below the upper end, a plurality of circumferentially spaced apart notches extending from the lower end of the blade section into the blade frustoconical wall, each of the plurality of notches including an opening at the lower end and a central open portion defined by a peripheral wall, the peripheral wall including an arcuate cutting portion, the arcuate cutting portion of each of the plurality of circumferentially spaced apart notches defining a cutting edge of the rotary knife blade; and the trim guide including a base and a guide section extending radially inwardly and axially downwardly from the base, the guide section extending axially below and being adjacent to the blade section of the rotary knife blade and including a guide frustoconical wall extending between an upper end of the guide section and a lower end of the guide section, the lower end of the guide section spaced radially inwardly from the upper end, a plurality of circumferentially spaced apart notches extending from the lower end into the guide frustoconical wall, each of the plurality of notches including as opening at the lower end and a central open portion defined by a peripheral wall, the peripheral wall including a shearing portion, the shearing portion in overlapping axial alignment with the cutting portions of the plurality of notches of the blade section of the rotary knife blade as the rotary blade rotates about the central axis of rotation.

BRIEF DESCRIPTION OF THE DRAWINGS

The foregoing and other features and advantages of the present disclosure will become apparent to one skilled in the art to which the present disclosure relates upon consideration of the following description of the disclosure with reference to the accompanying drawings, wherein like reference numerals, unless otherwise described refer to like parts throughout the drawings and in which.

DETAILED DESCRIPTION

Figure 1:
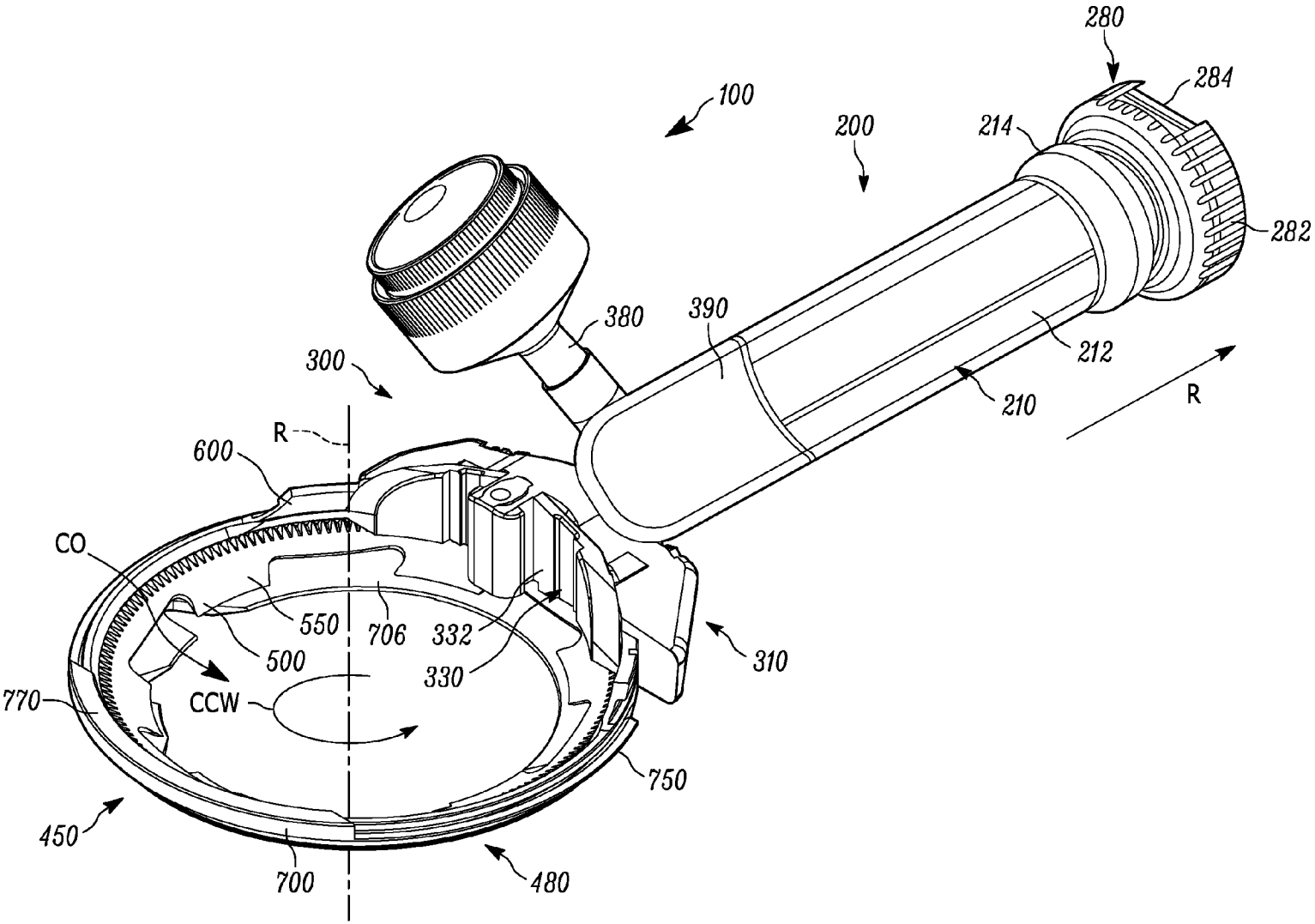
FIG. 1 is a schematic top front perspective view of a first exemplary embodiment of a power operated rotary knife of the present disclosure including a handle assembly, a head assembly, including a notched annular rotary knife blade, a blade housing and a notched trim guide.
Figure 2:
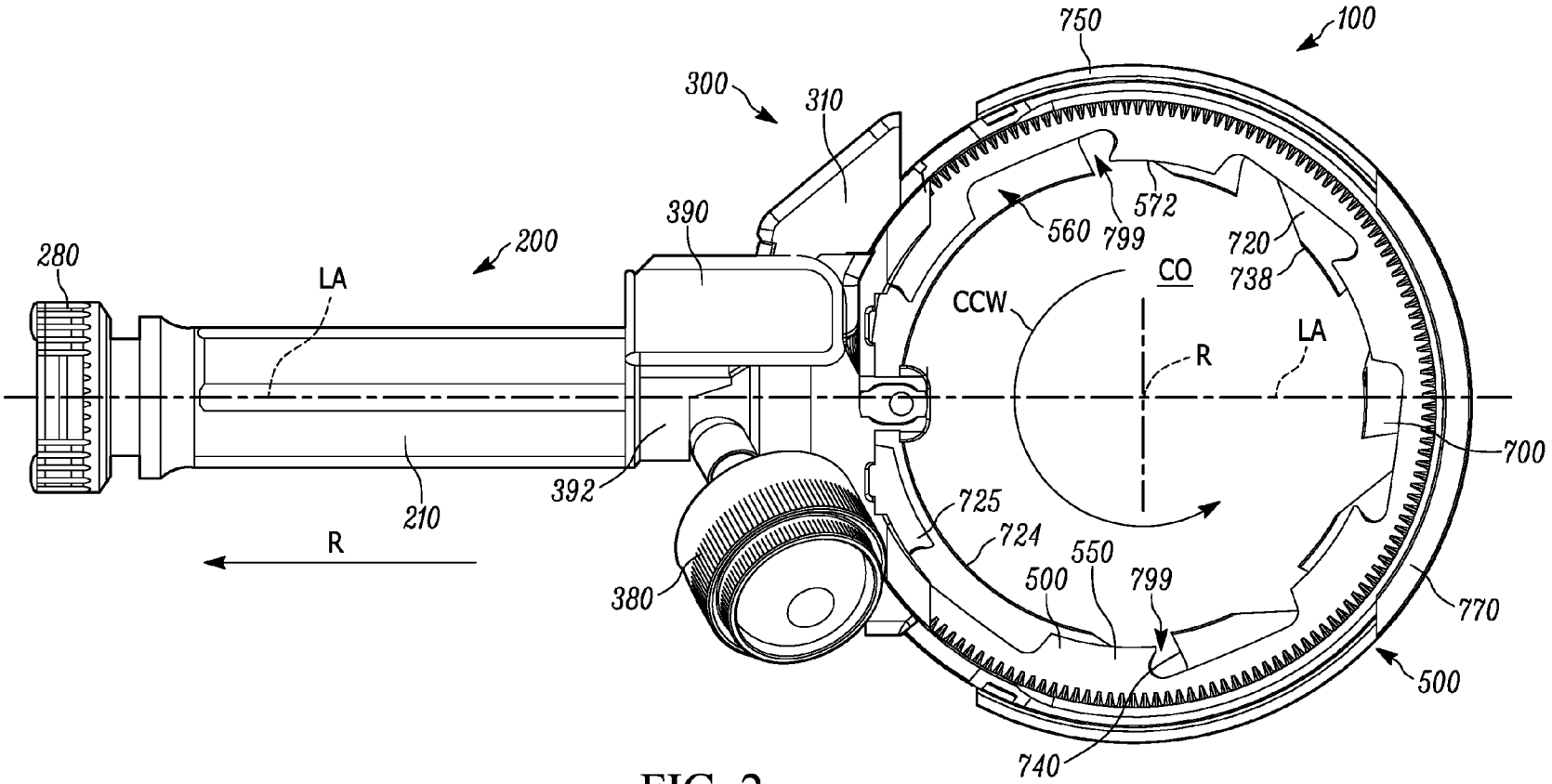
FIG. 2 is a schematic top plan view of the power operated rotary knife of FIG. 1.
Figure 3:
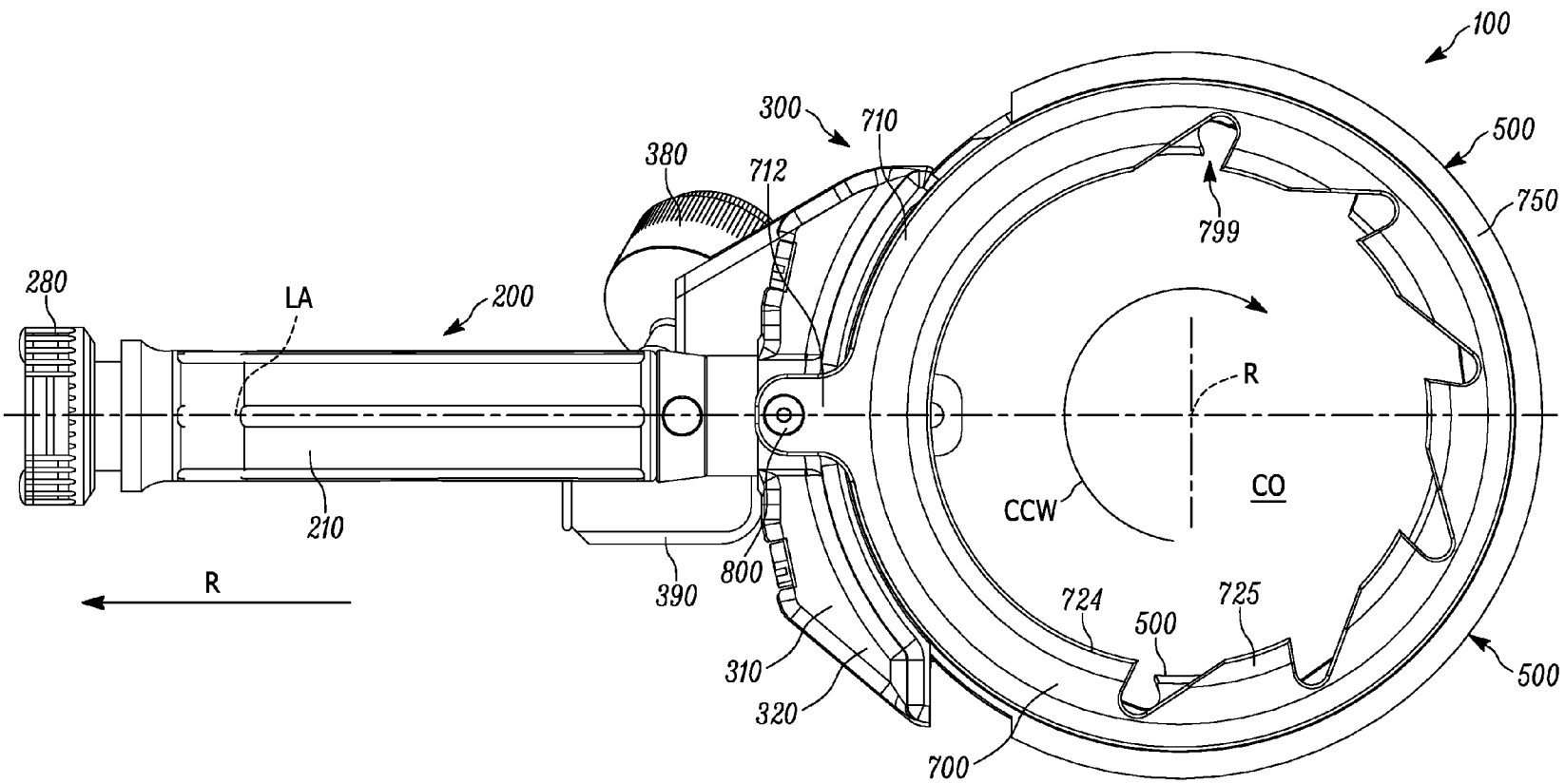
FIG. 3 is a schematic bottom plan view of the power operated rotary knife of FIG. 1.

The present disclosure relates to a power operated rotary knife, in one exemplary embodiment, shown generally at 100, in FIGS. 1-3, including a head assembly 300 having a rotating, notched annular rotary knife blade 500 (FIGS. 10-13) and a coacting stationary, notched trim guide 700 (FIGS. 14-17). The rotary knife blade 500 is supported by a stationary blade housing 600 (FIGS. 18 and 19) for rotation about a central axis of rotation R of the blade 500. The blade housing 600 is positioned between the rotary knife blade 500 and the trim guide 700. Each of the rotary knife blade 500, the blade housing 600 and the trim guide 700 are annular, defining central open regions. When the rotary knife blade 500, the blade housing 600 and the trim guide are assembled and attached to a frame body 310 of the head assembly 300, as described below, the central open regions of a combination 450 of the b lade 500, blade housing 600 and trim guide 700 define a central cutting opening CO (best seen in the top plan view of FIGS. 2 and 7) of the power operated rotary knife 100. Cutting and trimming take place with the central cutting opening CO. The central cutting opening CO is actually defined by a combination 480 of the blade 500 and the trim guide 700. As can be seen in the top plan view of FIG. 7, the bottom plan view of FIG. 8 and the sectional view of FIG. 9 which depicts the blade/blade housing/trim guide assembled combination 450, no portion of the blade housing 600 extends radially inwardly far enough to define any portion of the central cutting opening CO. Thus, the central cutting opening CO is defined by intersecting central open regions of the assembled combination 480 of the rotary knife blade 500 and trim guide 700.

The notched annular knife blade 500 and coacting notched trim guide 700 are useful for a number of tasks, including trimming/pruning of plants and, specifically, trimming/pruning foliage, branches, stems, stalks, runners, etc. of plants, including nursery stock and production plants in an efficient and effective manner, by utilizing the advantage of a power driven, rapidly rotating rotary knife blade for cutting purposes. Among the plant suitable for trimming and pruning by the power operated knife 100 of the present disclosure include strawberry plants or bushes, which require periodic pruning and trimming of the plants, including trimming of runners (stems sent out by a plant to establish new plants, crowns, etc.) to maximize fruit production.

Pruning of strawberry plants by hand using conventional hand tools such as pruning shears, snips, scissors, etc. or having employees use their hands for pruning is both labor intensive and time consuming. Additionally, constant hand manipulations required for operating pruning shears and the like are both tiring for the employee and result in repetitive stress to the employee's hand. While attempts at using power operated or power driven tools to replace hand pruning operations, such as, for example, the use of power driven string trimmers to prune strawberry plants, have met with limited success because strawberry plants are delicate and the plant and its root structure may be easily damaged by the action of a rapidly rotating plastic line of a string trimmer. Additionally, many commercial growers utilize plastic mats or sheets between strawberry plant rows to inhibit weed growth and protect strawberry plant roots. The whipping action of a rotating plastic line upon inadvertent contact with plastic mat or sheet can displace or damage the mat or sheet thereby undesirably exposing the plant roots and/or damaging the plant roots.

The power operated rotary knife 100 of the present disclosure utilizes the advantage of a rapidly rotating rotary knife blade 500 and the stationary trim guide 700 to facilitate effective and efficient trimming or cutting of plant foliage/branches/stems/stalks/runners and the like, etc. (hereinafter interchangeably and generally/collectively referred to as "branch" and/or "branches" and/or "foliage" and/or "foliage material" and/or "material" and/or "materials" throughout this description). Depending on the gearing of a drive mechanism 400 and the rotational speed of a drive motor of the drive mechanism 400 of the power operated rotary knife 100, a diameter of the rotary knife blade 500 and the gearing characteristics of the driven gear 520 of the blade 500 and other factors, the rotation speed of the blade 500 may be on the order of 500-1500 RPM. The rotary knife blade 500 is supported for rotation about a central axis of rotation R by a blade housing 600 and, when looking at the rotary knife blade 500 and the rotary knife 100 from above (the top plan view shown in FIG. 2) rotates in a counterclockwise direction of rotation CCW (as seen in FIG. 2).

Figure 11:
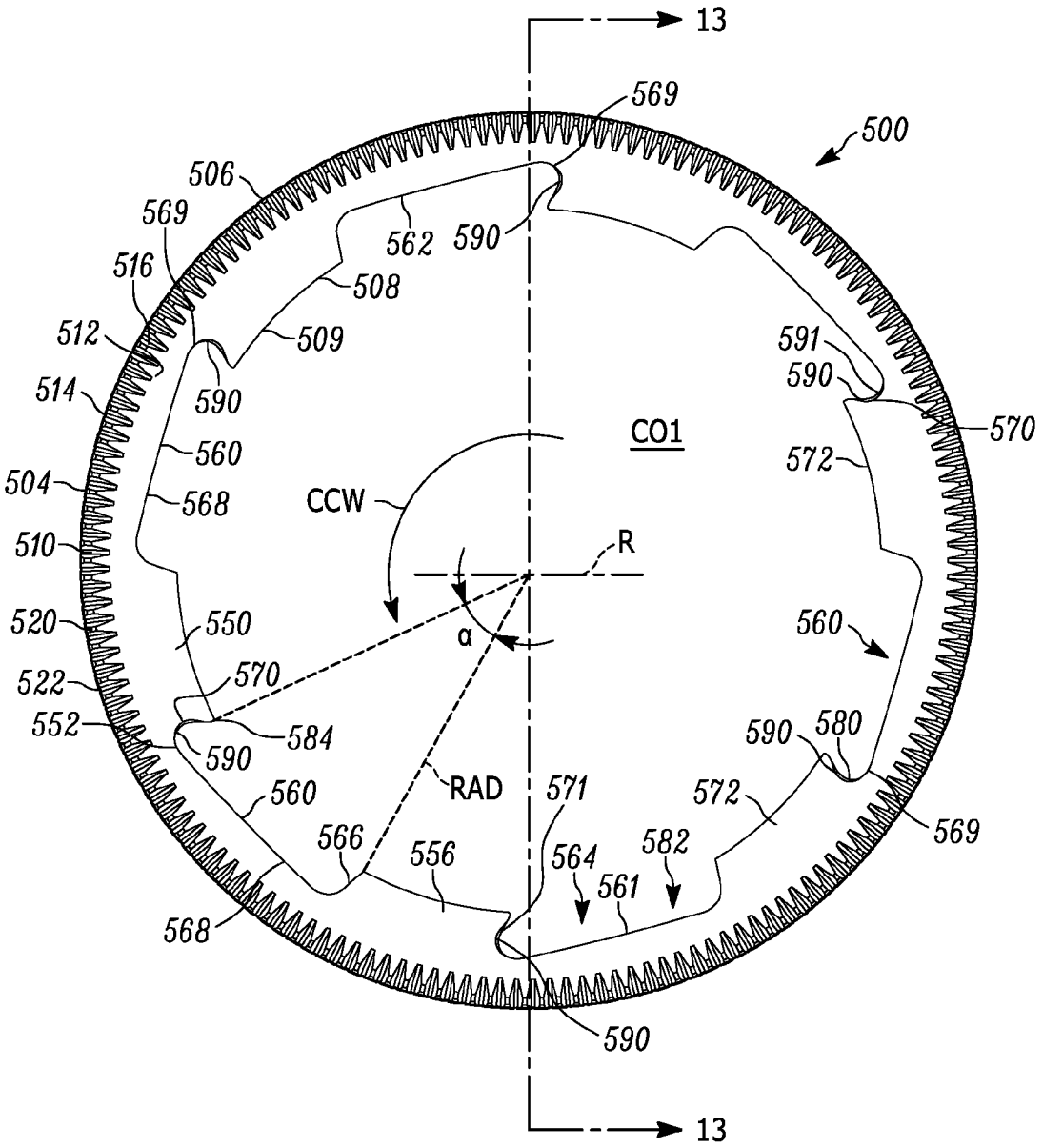
FIG. 11 is a schematic top plan view of the notched annular rotary knife blade of the head assembly of the power operated rotary knife of FIG. 1.
Figure 12:
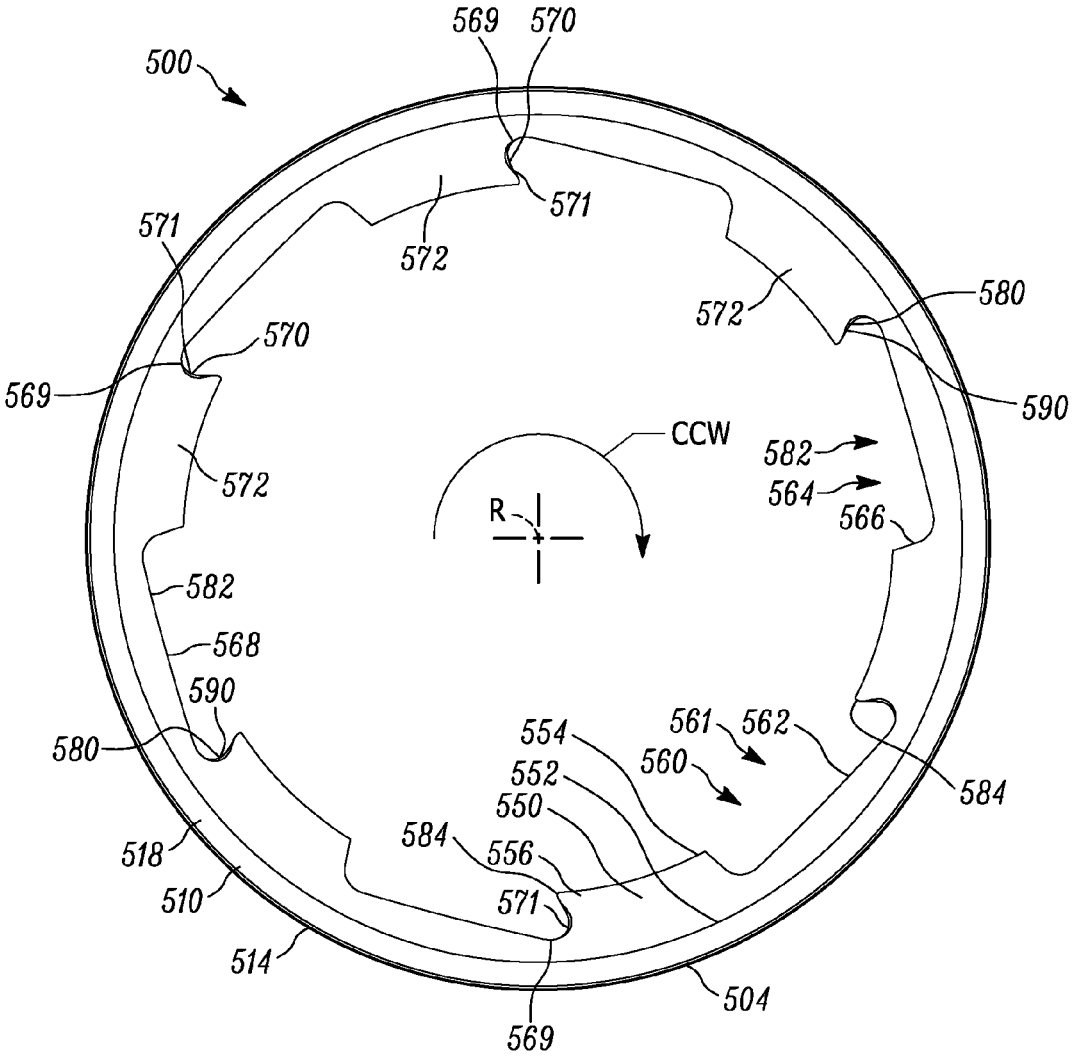
FIG. 12 is a schematic bottom plan view of the notched annular rotary knife blade of the head assembly of the power operated rotary knife of FIG. 1.
Figure 13:
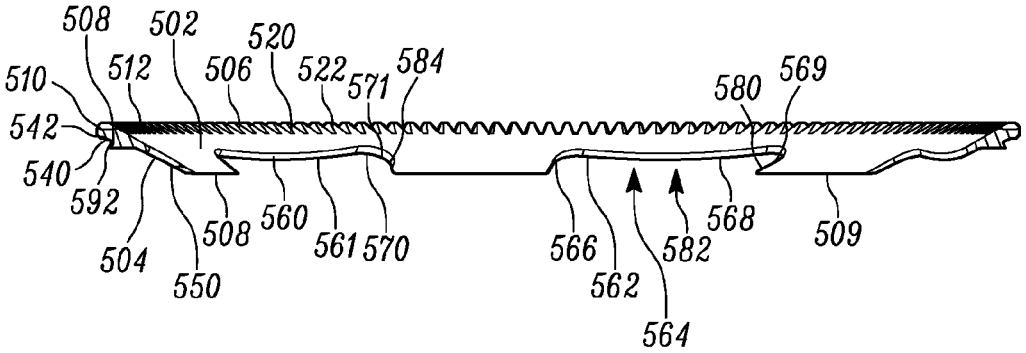
FIG. 13 is a schematic section view of the notched annular rotary knife blade of the head assembly of the power operated rotary knife of FIG. 1, as seen from a plane indicated by the line 13-13 in FIG. 11.
Figure 13A:
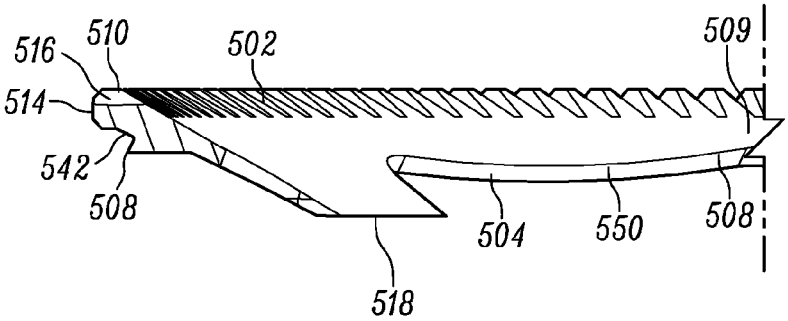
FIG. 13A is a schematic section view of an end portion of the notched annular rotary knife blade depicted in the section view of FIG. 13.
Figure 14:
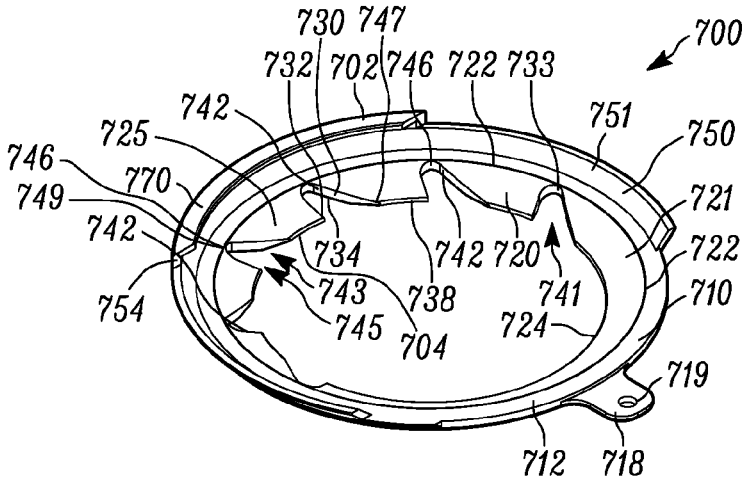
FIG. 14 is a schematic top, front perspective view of the notched trim guide of the head assembly of the power operated rotary knife of FIG. 1.
Figure 15:
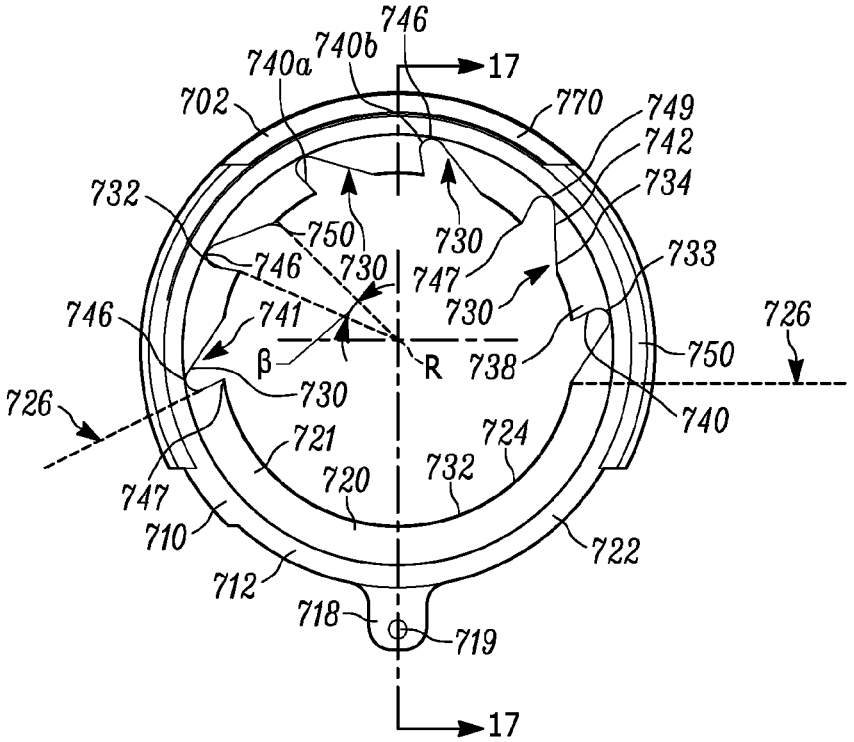
FIG. 15 is a schematic top plan view of the notched trim guide of the head assembly of the power operated rotary knife of FIG. 1.

The rotary knife blade 500 includes a blade section 550 that extends axially downwardly and radially inwardly from an annular body 510 of the blade 500. The blade section 550 extends between an upper end 552 and a lower end 554 and has a generally frustoconical shape. The lower end 554 of the blade section 550 defines a lower end 518 of the rotary knife blade 500. The blade section 550 includes a plurality of notches or notched regions 560 extending inwardly from a bottom or lower end 508 of the blade 500, that is, the lower end 554 of the blade section 550. Each of the plurality of notches 560 defines a recessed, arcuate cutting region or portion 580 of the rotary knife blade 500. Taken together, the recessed, arcuate cutting portions 580 defined by the plurality of notches 560 define a cutting edge 590 of the blade section 550. The plurality of notches 560 extend inwardly from a bottom end 554 of the blade section 550 of the rotary knife blade 500. The notches 560 include interior cutting regions which are recessed from the bottom end 554 of the blade section 550. For each of the plurality of notches 560, the arcuate cutting portion 580 of the notch 560 is disposed at a trailing end 570 of the notch 560 with respect to the direction of rotation CCW of the blade 500. In one exemplary embodiment of the rotary knife blade 500 of the present disclosure, the plurality of notches 560 are disposed in an evenly circumferentially spaced arrangement in the blade section 550 of the knife 500, as best seen in FIG. 11, and the number of notches 560 is six.

The coacting trim guide 700 includes a planar base 710 and a guide section 720 extending axially downwardly and radially inwardly from the base 710. The trim guide 700 is positioned and configured such that the guide section 720 extends below and is adjacent to the blade section 550 of the blade 500, substantially conforming to the generally frustoconical shape of the blade section 550. The guide section 720 includes an upper end 722 and a lower end 724. The lower end 724 of the guide section 720 defines a lower end 704 of the trim guide 700. The guide section 720 includes a plurality of notches or notched regions 730 extending inwardly from a bottom or lower end 724 of the guide section 720, that is, the lower end 704 of the trim guide 700. Each of the plurality of notches 730 defines a recessed, shearing regions or portions 740 of the trim guide 700. For each of the plurality of notches 730, the shearing portion 740 of the notch 730 is disposed at a leading end of the notch 730 with respect to the direction of rotation CCW of the blade 550. The shearing portions 740 of the guide section notches 730 are in overlapping axial alignment with the arcuate cutting portions 580 of the blade section notches 560 as the rotary knife blade rotates about the central axis of rotation R. Stated another way, the stationary shearing portions 740 and the rotating cutting portions 580 create a shearing or scissors-like cutting action because they are in overlapping axial alignment as the rotary knife blade 100 rotates about its central axis of rotation R.

An extending distal portion 725 of the guide section 720 of the trim guide 700 extends axially below and radially inwardly of the lower end 504 of the rotary knife blade 500 to function as a guard to protect the blade 500 from inadvertent contact with the plastic mat or sheeting used between rows of plants or around the base of a plant to inhibit weed growth and/or protect plant roots. Additionally, the extending distal portion 725 of the guide section 720 advantageously functions to direct a branch or branches into an interior region 745 of one of the plurality of notches 730 as the knife 100 is moved by the operator in a direction orthogonal to the axis of rotation R of the rotary knife blade 500 to cut or trim a branch or branches. That is, the operator moves the knife 100 to position a branch or branches to be cut or trimmed within the central cutting opening CO defined by the rotary knife blade, blade housing, and trim guide combination 450. The operator then moves the knife 100 in a direction generally orthogonal to the blade axis of rotation R such that the branches are urged against the lower end 724 of the trim guide 700 and slide along a lower end 724 of the guide section 720 and move into the interior region 745 of one of the plurality of notches 730 of the guide section 720. Typically, the movement of the knife 100 is in the direction of the operator, that is, the operator pull the knife in a rearward or proximal direction RW (FIG. 1) toward himself or herself as the plurality of notches 730 are position toward a forward portion 726 of the guide section 720. Since the distal portion 725 extends beyond the lower end 504 of the blade, the uncut branch or branches can slide along a lower end 724 of the guide section 720 and move into the interior region 745 of one of the plurality of notches 730 of the guide section 720 as the operator pull the knife 100 toward himself or herself.

The trim guide 700 also includes a guard section 750 comprising a peripheral rib 751 which extends axially above and radially outwardly from the base 710. As can best be seen in FIG. 15, the rib 751 extends around most, but not all of the total annulus defined by the trim guide 700. Additionally, the guard section 550 includes a vertical extension 754 extending axially upwardly from an upper end 751*a* of the rib 751 and a lip 770 extending axially upwardly and radially inwardly from an upper end 754*a* of the vertical extension 754. The vertical extension 754 and the lip 770 subtend an angle less than an angle subtended by the rib 751. Both the rib 751, the vertical extension 754 and the lip 770 of the guard section 750 function as guards to protect the blade 500 from inadvertent contact with plastic mats, portions of plants that are not to be trimmed or cut, and the like.

Figure 16:
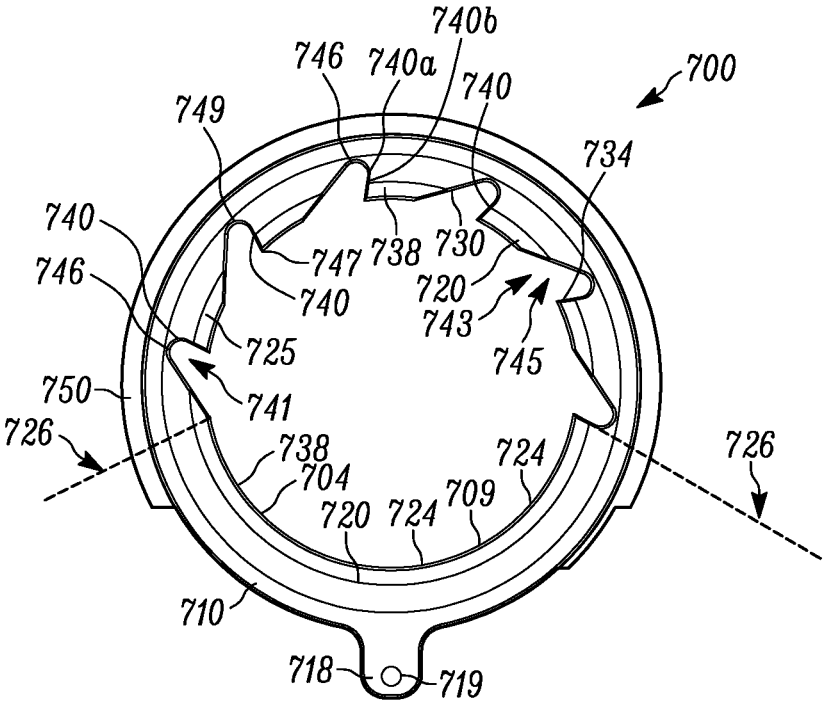
FIG. 16 is a schematic bottom plan view of the notched trim guide of the head assembly of the power operated rotary knife of FIG. 1.
Figure 17:
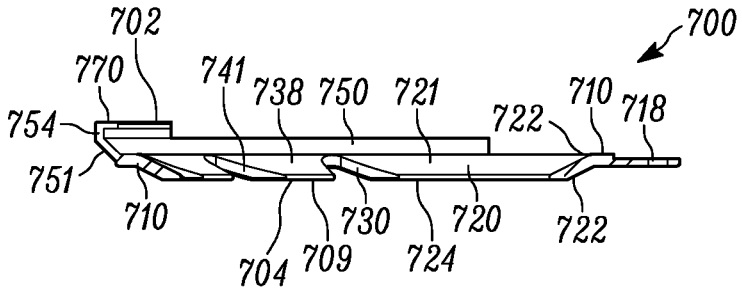
FIG. 17 is a schematic section view of the notched trim guide of the head assembly of the power operated rotary knife of FIG. 1, as seen from a plane indicated by the line 17-17 in FIG. 15.

In one exemplary embodiment of the trim guide 700 of the present disclosure, the plurality of notches 730 are disposed in a front or distal portion 726 of the guide section 720 of the trim guide 700, as can best be seen in FIG. 16, and the number of notches 730 is six, evenly spaced apart subtending just over 180 degrees of the total annulus defined by the trim guide 700.

The notches 730 of the trim guide 700 function to direct the plant branches to be cut into recessed shearing portions 740 defined by each of the plurality of notches 730 of the trim guide 700 wherein the recessed arcuate cutting portions 580 of the plurality of notches 560 of the rotary knife blade 500 cut the branches by shearing action as the blade 500 rotates with respect to the stationary trim guide 700. To cut or trim a branch, the power operated rotary knife 100 is positioned with respect to a plant branch to be cut or trimmed such that the branch extends through the cutting opening CO defined by the power operated rotary knife 100, the operator then moves the knife 100 in a direction such that the branch is moved within the cutting opening CO and urged against the front or distal portion 725 of the guide section 720 of the trim guide 700. Depending on the position of the branch within the cutting opening CO, the movement of the rotary knife 100 by the operator will move the branch into one of the plurality of notches 730 of the trim guide section 720. A cutting portion 580 of the rotary knife blade 500 will impact the branch within the interior region 745 of the notch 730, cutting the branch by a shearing action between the shearing portion 740 of the trim guide notch 730 at the leading end 732 of the notch 730 and the cutting portion 580 of the blade section notch 560 at the trailing end 570 of the notch 560.

While the shearing action of the power operated rotary knife 100 has been described above with respect to trimming, pruning, cutting of plants and, specifically, strawberry plants, one of skill in the art will recognize that the power operated rotary knife 100 of the present disclosure can be advantageously used for any trimming/pruning/cutting task where a shearing-type cutting action between a rapidly rotating rotary knife blade 500 having, recessed sharpened, cutting portions 580, against a stationary trim guide 700, having recessing shearing portions 740, that functions to guide elements to be cut or trimmed into position for cutting by the recessed, sharpened cutting portions 580 of the rotary knife blade 500. In one exemplary embodiment of the power operated rotary knife 100 of the present disclosure, an outer diameter of the rotary knife blade 500 is approximately 5.09 in. and the blade configuration is a so-called flat blade configuration meaning the blade has a shallow blade cutting profile, as opposed to, for example, a hook blade configuration or a straight blade configuration. As would be understood by one of skill in the art, the configuration and size of the rotary knife blade 500 may vary depending on the elements/branches to be cut, trimmed or pruned. The present disclosure contemplates the use of alternate blade sizes and configurations and corresponding different diameters/sizes and configurations for the trim guide 700 in the power operated rotary knife 100.

Handle Assembly 200

The power operated rotary knife 100 of the present disclosure includes the head assembly 300 having an elongated handle assembly releasably affixed thereto. As can best be seen in FIGS. 1-3, the handle assembly 200 extends along a longitudinal axis LA. The handle assembly 200 includes a hand piece 210 defining an exterior gripping surface 212 adapted to be gripped by an operator of the power operated knife 100 when wielding and manipulating the knife 100. The hand piece 210 includes the central throughbore defined by an inner surface 224 of the hand piece 210. The handle assembly throughbore is coaxial with the longitudinal axis LA and is aligned with a throughbore of a throughbore 312 of a frame or frame housing/body 310 of the head assembly.

The handle assembly 200 further includes a drive shaft latching assembly 280. The shaft drive latching assembly 280 releasably secures a flexible shaft drive assembly (not shown) of the drive mechanism 400 to the handle assembly 200 such that motive power may be applied to drive a drive or gear train 402 disposed in the throughbore 312 of the frame 310 and thereby rotate the rotary knife blade 300. In one exemplary embodiment, the gear train 402 comprises a pinion gear 404 which is rotated by the flexible shaft drive assembly and, in turn, rotates the rotary knife blade 500. The shaft drive latching assembly 280 includes a latching knob 282 secured to a proximal end 214 of the hand piece 210 and a latching member 284 for releasably securing a coupling of the shaft drive assembly to the handle assembly 200.

The latching knob 282 of the drive shaft latching assembly 280 threads onto a threaded end section (not shown) of the frame tube (not shown) extending from the frame body 310. When the latching knob 282 is threaded onto the threaded proximal end section of the frame tube, the hand piece 210 is thereby sandwiched and secured to the rearward annular boss 350 of the frame body 310.

Head Assembly 300

Figure 4:
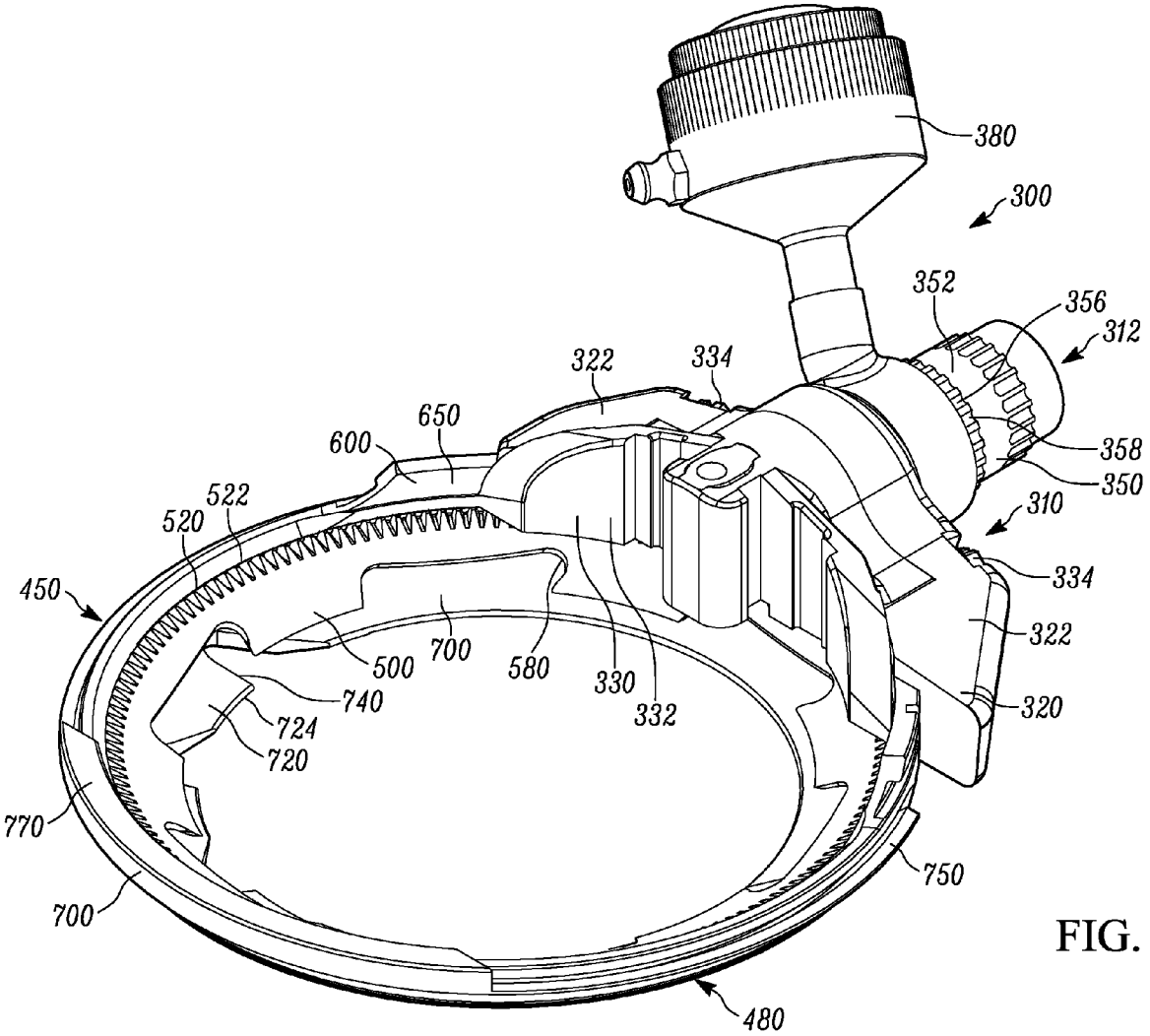
FIG. 4 is a schematic top, front perspective view of the head assembly of the power operated rotary knife of FIG. 1, including a frame, the notched annular rotary knife blade, a blade housing, and the notched trim guide and with a pivoting thumbpiece assembly removed for clarity.
Figure 5:
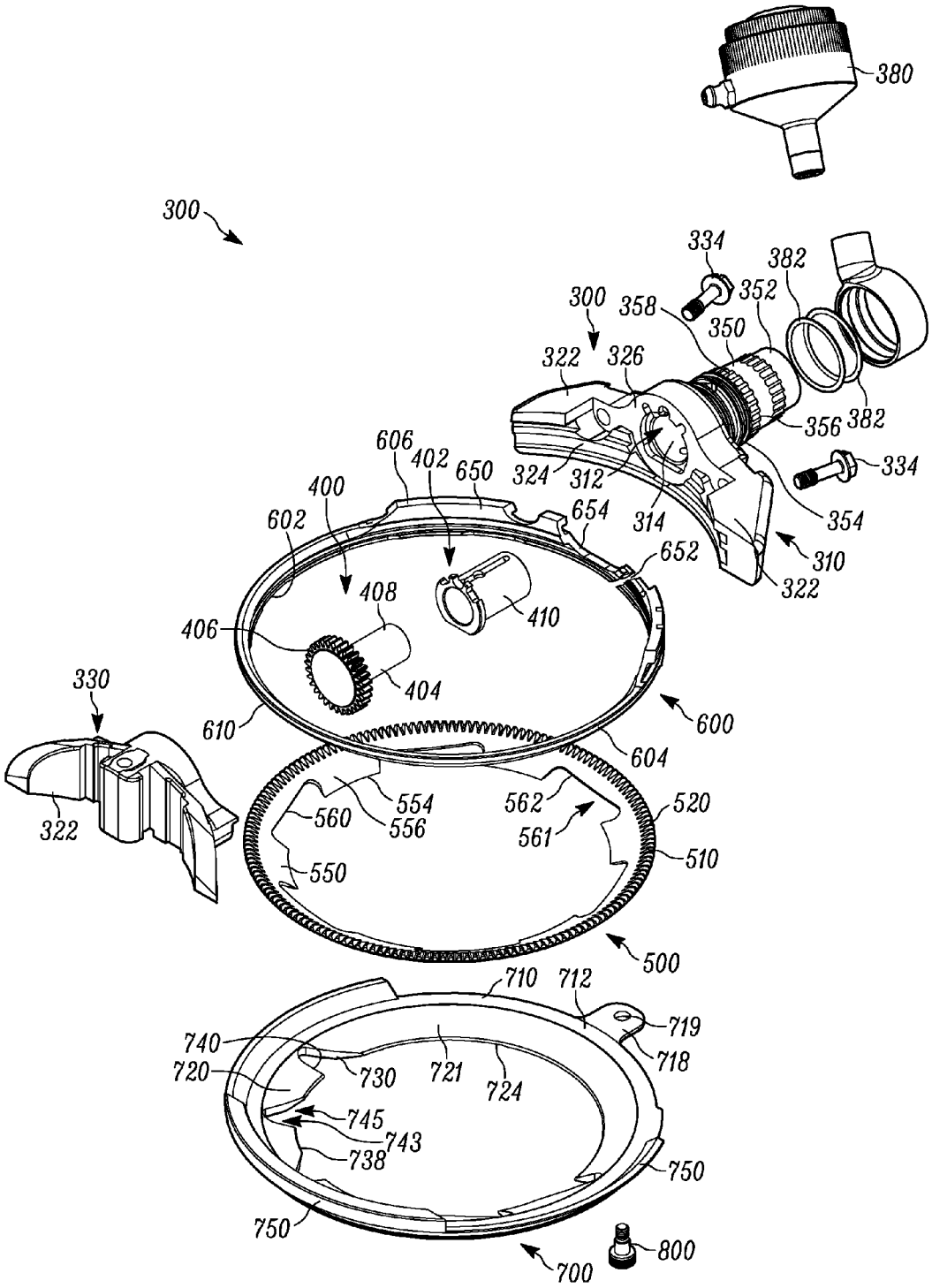
FIG. 5 is a schematic exploded top, front perspective view of the head assembly of FIG. 4.
Figure 6:
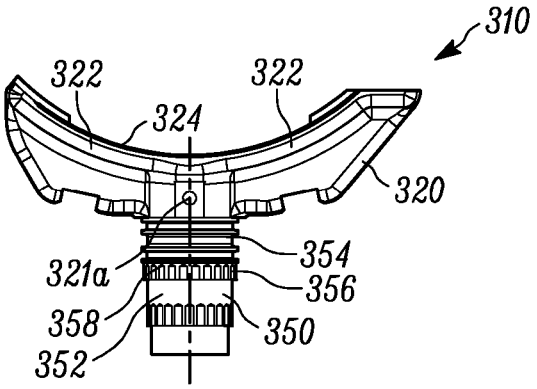
FIG. 6 is a schematic bottom plan view of the frame of the head assembly of FIG. 4.
Figure 7:
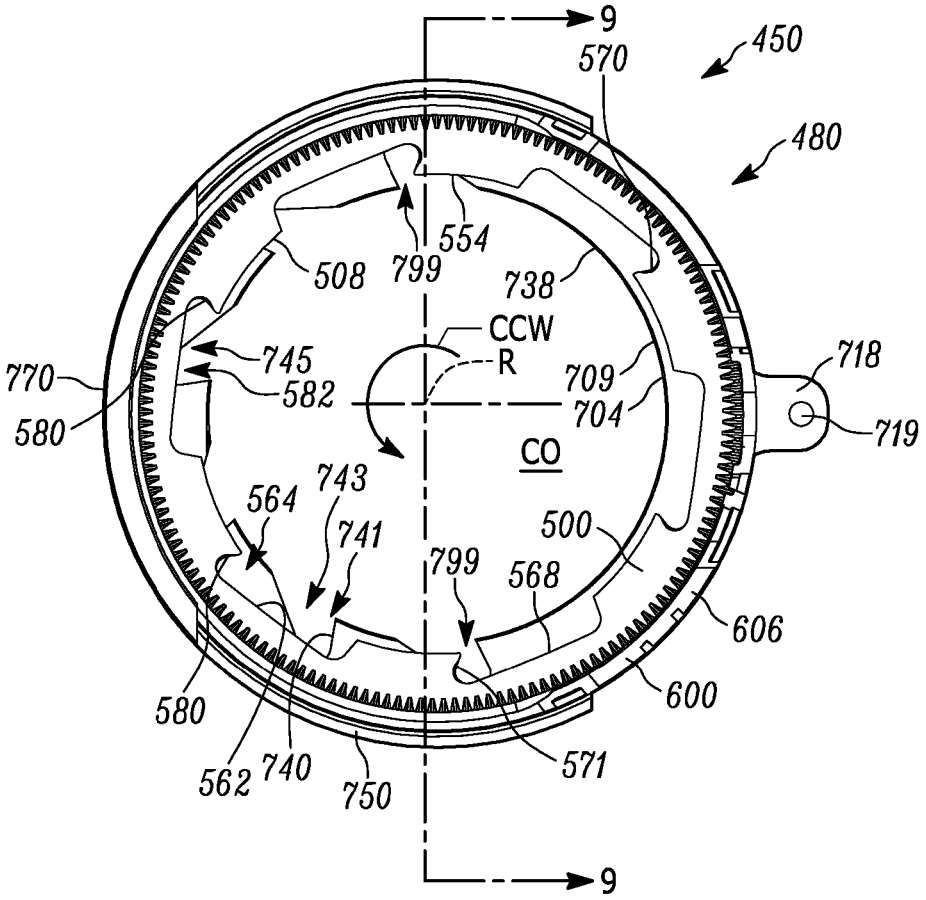
FIG. 7 is a schematic top plan view of a combination of the notched annular rotary knife blade, the blade housing, and the notched trim guide of the head assembly of the power operated rotary knife of FIG. 1.
Figure 8:
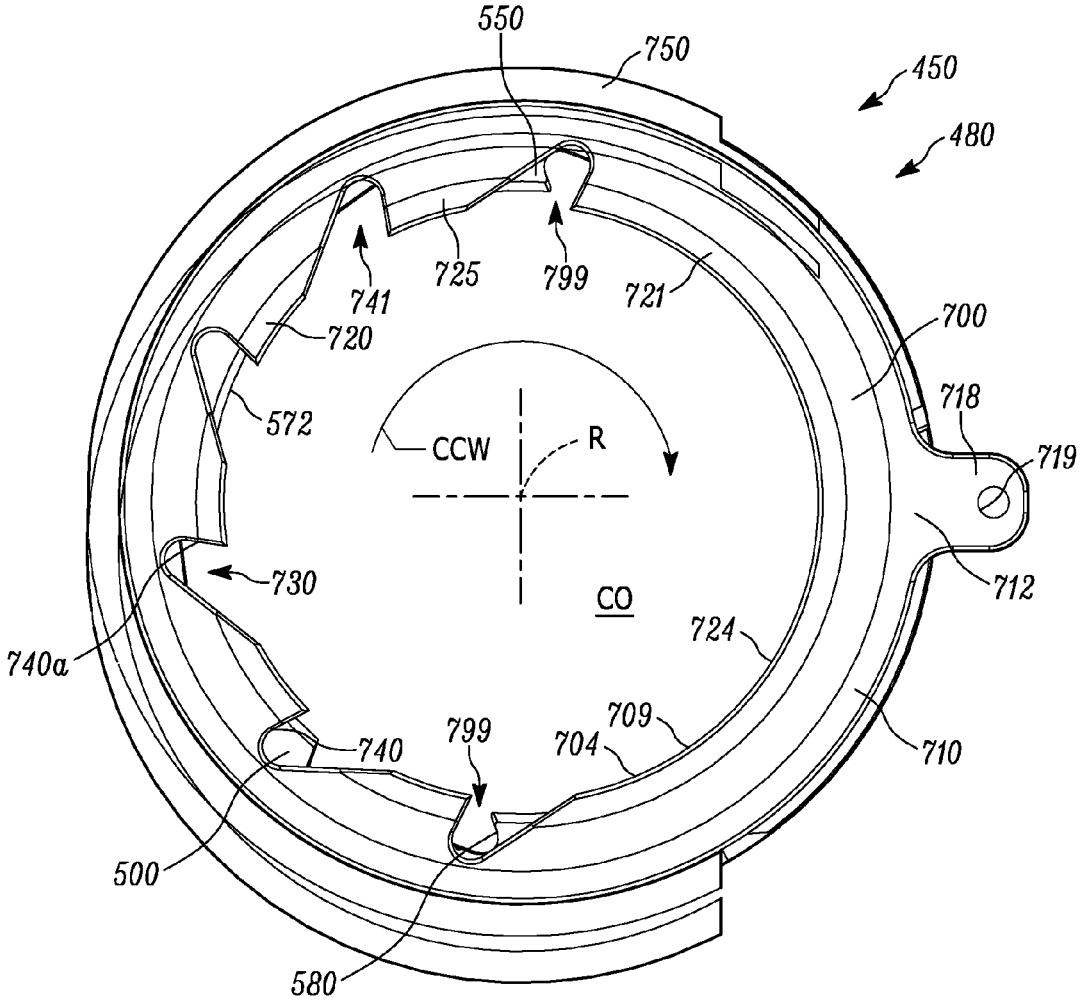
FIG. 8 is a schematic bottom plan view of the combination of the notched annular rotary knife blade, the blade housing, and the notched trim guide of the head assembly of the power operated rotary knife of FIG. 1.

The power operated rotary knife 100 includes a handle assembly 200 and the head assembly 300 releasably affixed to the handle assembly 200. As can best be seen in FIGS. 4-6, the head assembly 300 includes the frame housing or frame 310, a clamping assembly 330, the rotary knife blade 500, the blade housing 600 and the trim guide 700. The rotary knife blade 500 is supported for rotation about the axis of rotation R by the blade housing 600. The blade housing 600 defines a rotational plane RP of the rotary knife blade 500. The blade housing 600, in turn, is releasably affixed to the frame body 310 by a cover or clamp 332 of the clamp assembly 330. As is best seen in FIGS. 6-8, the frame body 310 also supports the drive mechanism 400 of the power operated rotary knife 100. In one exemplary embodiment, the frame body 310 includes the longitudinally extending, central throughbore 312 which supports the gear train 402 of the drive mechanism 400. Specifically, the gear train 402 includes a pinion gear 4604 and an input shaft of the pinion gear 404 is supported for rotation within a cylindrical bushing 410 positioned within a front portion 314 of the throughbore 312. The pinion gear 404 is precisely positioned and oriented by the frame body 310 such that a gear head 406 of the pinion gear meshes with a driven gear 520, namely, set of gear teeth 522 formed at the upper end 516 of the annular body 510 of the of the rotary knife blade 500 to rotate the knife blade 580 within the blade housing 600.

Frame Body 310

The frame body 310 includes a forward or distal blade housing support region 320 and a rearward annular boss 350. The forward blade support region 320 includes a pair of outwardly extending arcuate arms 322 which define a blade housing mounting region 324 for receiving an arcuate mounting section 650 of the blade housing 600 and a clamping receiving region 326 for receiving the proximal wall of the clamp 332 of the clamping assembly 330. The clamp 332 is secured to the frame body 310 by a pair of threaded fasteners 334 that extend through respective openings in the arcuate arms 322 of the frame body 310. The arcuate mounting section 392 of the blade housing 390 is sandwiched between the forward blade housing support region 320 and the clamp 332 to releasably secure the blade housing 600 to the frame body 310.

In one exemplary embodiment, the rearward annular boss 350 of the frame body 310 includes an inner surface defining a rear portion of the central throughbore 312. The rear portion of the central throughbore 312 includes a threaded section. A frame tube (not shown) threads into and is affixed to the threaded section of the rearward annular boss 350. The frame tube (not shown) extends rearwardly though a central throughbore of a hand piece 210 of the handle assembly 200 and includes a threaded proximal end section. An outer surface 352 of the rearward annular boss 350 includes a first region 354, closest to the forward blade support region 320, and a middle region 356. The first region 354 includes a pair of exterior grooves on the outer surface 352 that receives a pair of sealing members 382 of the grease cup assembly 380. The middle region 356 includes a plurality of raised splines 358 and is sized to receive an annular mounting ring 392 of the pivoting thumb support 390. If desired and depending on operator preference, the pivoting thumb support 390 may be removed from the power operated rotary knife 100 and the knife 100 may be used without the thumb support 390. In such an alternate exemplary embodiment, the annular mounting ring 392 is replaced with an annular spacer ring (not shown) which is sized to fit on the plurality of raised splines 358 of the rearward annular boss 350 of the frame 310. Specific details of the structure and function of the pivoting thumb support 390, the grease cup assembly 380 and attachment structure of the handle assembly 200 to the head assembly 300 are found in U.S. Published Application No. US2014/0259690 to Mascari et al., published Sep. 18, 2014 and U.S. Published Application No. US2014/0250697 to Steele et al., published Sep. 11, 2014, issued as U.S. Pat. No. 9,321,183 on Apr. 26, 2016. Both U.S. Published Application No. US2014/0259690 and U.S. Published Application No. US2014/0250697 are assigned to the assignee of the present invention and both of the aforesaid published applications are incorporated herein in their respective entireties by reference.

Drive Mechanism 400

The drive mechanism 400 of the power operated rotary knife 100 includes the drive train 402 supported within the central throughbore 312 of the frame body 310. In one exemplary embodiment, the drive train 402 includes the pinion gear 404. The input shaft 408 of the pinion gear 404 is supported for rotation by the cylindrical bushing 410 positioned within the front portion of the throughbore 412. A drive coupling of a flexible shaft drive transmission (not shown), driven by a remote motor drive (not shown), extends through a throughbore of the hand piece 210 of the handle assembly 200 and engages a female coupling defined by the pinion gear input shaft 408 to rotate the pinion gear 404. The gear head 406 of the pinion gear 404 operatively engages the set of gear teeth of the rotary knife blade 500 to rotate the knife blade 500 within the blade housing 600.

As mentioned above, in one exemplary embodiment, the drive mechanism 400 of the power operated rotary knife 100 may comprise a remote motor drive and a flexible shaft drive transmission which transfers rotational power from the motor drive to rotate a drive train 1550 of the power operated rotary knife 1000. The flexible shaft drive transmission includes a driver assembly which is received in a central, longitudinally extending throughbore of the handle assembly 200 to rotatably drive the drive train 402 of the drive mechanism 400. Such a drive mechanism, including a remote motor drive and flexible shaft drive transmission and driver assembly, are disclosed in U.S. Pat. No. 8,968,107 to Rapp et al., issued Mar. 3, 2015 and U.S. Published Application No. US2013/0174424 to Whited et al., published Jul. 11, 2013, issued as U.S. Pat. No. 9,265,263 on Feb. 23, 2016, both of which are assigned to the assignee of the present invention. Both U.S. Pat. No. 8,968,107 and U.S. Published Application No. US2013/0174424 are incorporated herein in their respective entireties by reference. In an alternate exemplary embodiment of the power operated rotary knife of the present disclosure, the drive mechanism 400 may include a pneumatic motor (not shown) disposed within the throughbore of the handle assembly 200. An output shaft and coupling of the pneumatic motor are operatively coupled to the female coupling defined by the pinion gear input shaft 408 to rotate the pinion gear 404. Such a pneumatic drive mechanism is disclosed in U.S. Pat. No. 7,207,114 to Rosu et al., issued Apr. 24, 2007 and U.S. Pat. No. 8,756,819 to Whited et al., issued Jun. 24, 2014, both of which are assigned to the assignee of the present invention. Both U.S. Pat. Nos. 7,207,114 and 8,756,819 are incorporated herein in their respective entireties by reference.

Blade Housing 600

Figure 18:
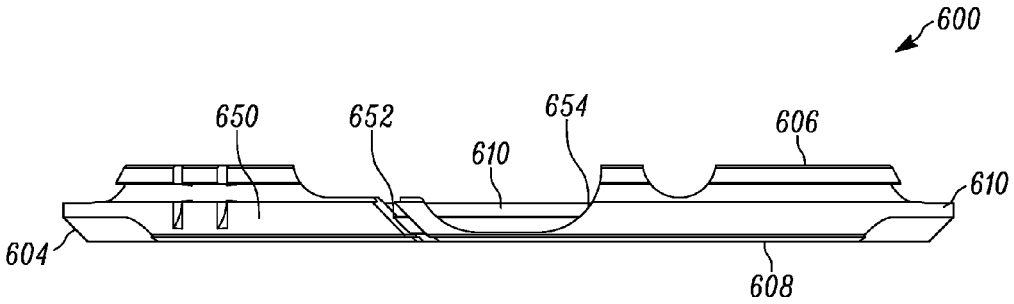
FIG. 18 is a schematic front elevation view of the blade housing of the head assembly of the power operated rotary knife of FIG. 1.
Figure 19:
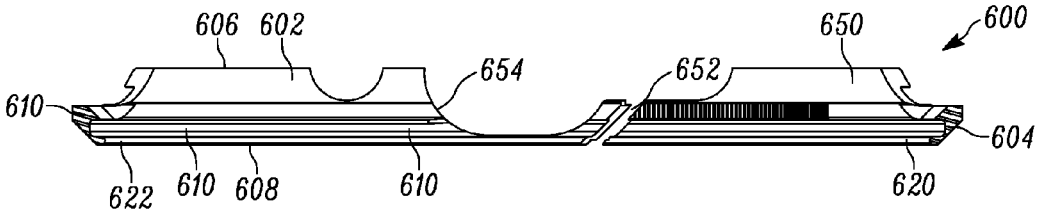
FIG. 19 is a schematic section view of the blade housing of the head assembly of the power operated rotary knife of FIG. 1.

The rotary knife blade 500 (FIGS. 10-13) is supported for rotation about a central axis of rotation R by the annular blade housing 600 (FIGS. 18-19). The blade housing includes a split, annularly curved blade support section 610 that surrounds and supports the rotary knife blade 500 about the entire 360 degree circumference of the blade 500 and a mounting section 650 extending axially from the blade support section 610 and provides a mounting structure for releasably mounting the blade 500 and blade housing 600 to the blade housing mounting region 324 of the frame body 310. The blade housing includes an inner wall 602 and an outer wall 604 and an upper end 606 and a lower end 608. Adjacent the lower end 608, the inner wall 602 defines a bearing surface 620, which in one exemplary embodiment is a radially inwardly protruding bearing bead 622, extending from an inner wall 602 of the blade housing 600. The blade housing bearing bead 622 extends into a generally V-shaped opening or bearing race 540 formed in and extending radially into an outer wall of the 514 of an annular body 510 of the rotary knife blade 500 to support the blade for rotation. The blade bearing race 540 comprises two axially spaced apart, generally frustoconical, bearing faces 542 which bear against the blade housing bead 622 to support the blade both axially and radially. The bearing support structure of the bearing bead 622 of the blade housing 600 and the bearing race 540 of the rotary knife blade 500 define the rotational plane RP of the rotary knife blade 500, which is substantially orthogonal to the blade central axis of rotation R.

The mounting section 650 of the blade housing 600 includes an angled split 652 and a pinion clearance region 654. The pinion clearance region 654 of the blade housing mounting section 650 provides for clearance for the gear head 406 of the pinion gear 404 of the drive mechanism drive train 402. The angled split 652 of the mounting section 650 is circumferentially offset from the pinion clearance region 654 and provides for expansion of the blade housing diameter for purposes of changing the rotary knife blade 500 when the blade has reached the end of its useful life. Specific details regarding an annular blade housing with an angle split and offset pinion clearance region are disclosed in U.S. Pat. No. 8,661,692 to Whited et al., issued Mar. 4, 2014. U.S. Pat. No. 8,661,692 is assigned to the assignee of the present invention and is incorporated herein in its entirety by reference.

Figure 9:
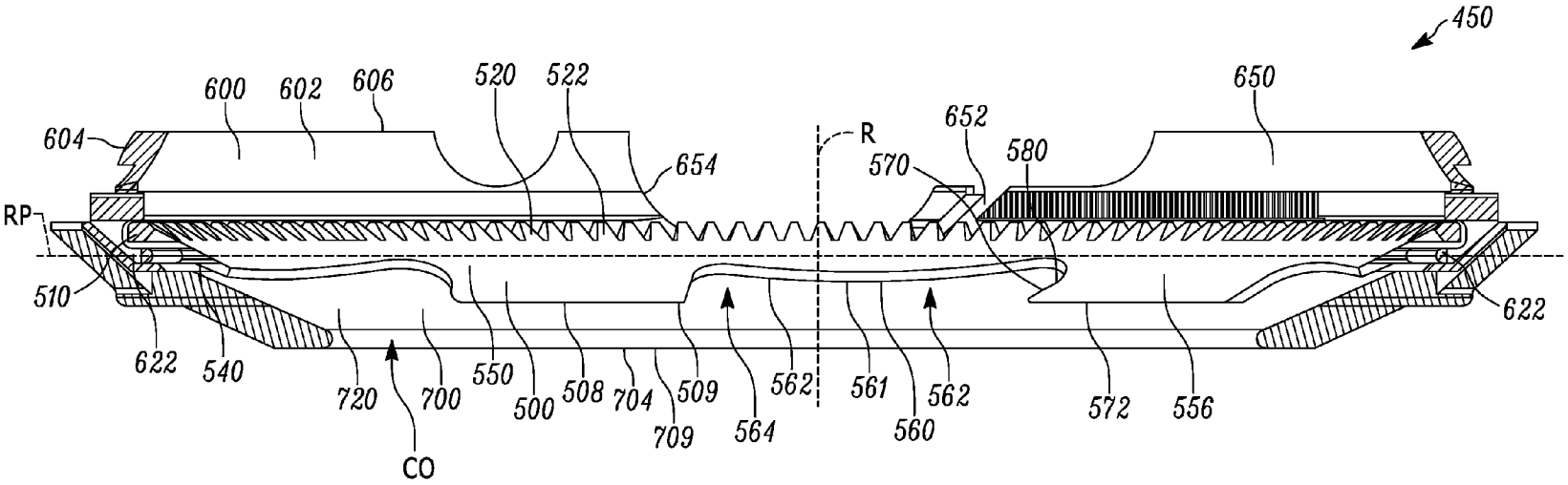
FIG. 9 is a schematic section view of the combination of the notched annular rotary knife blade, the blade housing, and the notched trim guide of the head assembly of the power operated rotary knife of FIG. 1, as seen from a plane indicated by the line 9-9 in FIG. 7.
Figure 10:
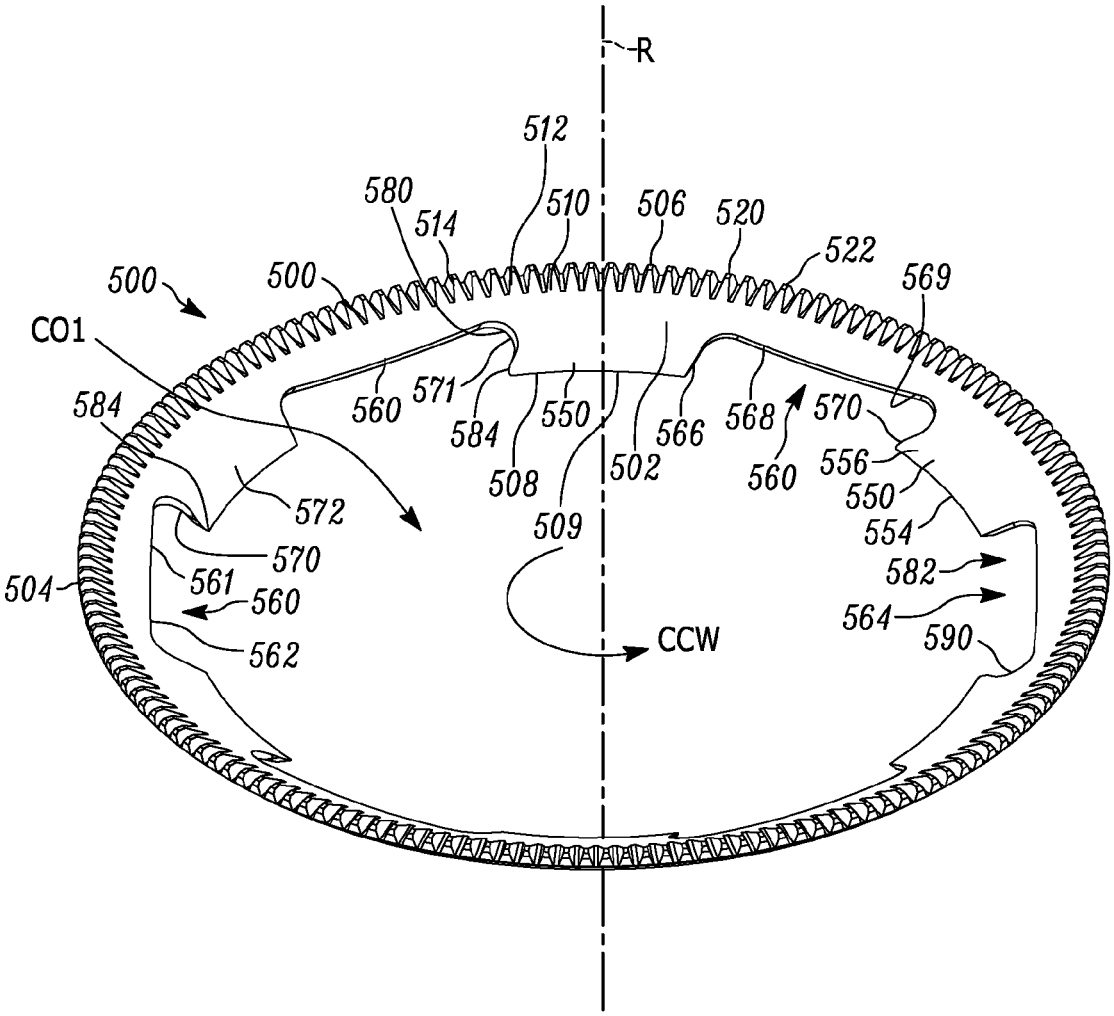
FIG. 10 is a schematic top, front perspective view of the notched annular rotary knife blade of the head assembly of the power operated rotary knife of FIG. 1.

The rotary knife blade 500, the blade housing 600, and the trim guide 700, are all annular and, when assembled, define an overlapping sandwiched combination 450, as shown in FIGS. 7-9, wherein the blade housing blade support section 610 is radially sandwiched between, on the radial inside, the annular body 510 of the rotary knife blade 500 and, on the radial outside, by the rib 751 of the guard section 750 of the trim guide 700.

Rotary Knife Blade 500

The rotary knife blade 500 of the power operated rotary knife 100 includes an inner wall 502 and a radially spaced apart outer wall 504 and an upper end 506 and an axially spaced apart lower or bottom end 508. The inner wall 502 defines a central opening of the blade 500. The blade 500 includes the annular body 510 which defines an inner wall 512 (defining part of the inner wall 502 of the blade 500), an outer wall 514 (defining part of the outer wall 504 of the blade 500), an upper end 516 (defining the upper end 506 of the blade 500) and a lower end 518. The rotary knife blade 500 further includes the blade section 550 extending axially downwardly and radially inwardly (toward the blade axis of rotation R) from the lower end 518 of the annular body 510. The blade section 550 includes upper end 552 adjacent the annular body lower end 518 and a lower end 554 (defining the lower end 508 of the blade 500) and a generally frustoconical wall 556 extending therebetween.

The upper end 516 of the annular body 510, as mentioned above, defines the driven gear 520 of the blade 500. The driven gear 520 comprises a set of gear teeth formed in a circumference adjacent the outer wall 514 of the annular body. Adjacent the lower end 518 of the annular body, the blade bearing race 540 defining frustoconical bearing surfaces 542 is formed in the outer wall 514 of the annular body, as described above.

The lower end 554 of the blade section 550 includes a plurality interrupted arc portions 572 that define a lower edge 509 of the blade 500. The interrupted arc portions 572 are centered about the blade central axis of rotation R and, if connected and continued, would form a circle defining an inner diameter of the blade 500 with a center on the axis of rotation R. Typically, the interrupted arc portions 572 would define a cutting edge of the blade, but, in the rotary knife 500 of the present disclosure, the cutting edge 590 of the blade are defined by the recessed, arcuate cutting portions 580 within the plurality of notches 560. Interrupting the are portions 572 are the plurality of notches 560 formed at the lower end 554 of the frustoconical wall 556 of the blade section 550 and extending into the frustoconical wall 556. As can best be seen in FIG. 11, each of the notches of the plurality of notches 560, when viewed in top plan view, defines a generally rectangular cavity 561 defined by a peripheral wall 562 surrounding a central open portion 564 and defining the cavity 561. The peripheral wall 562, when viewed with respect to the counterclockwise direction of rotation CCW (FIG. 7) of the rotary knife blade 500, includes an angled leading portion or end 566, a generally linear central portion 568, and a hook-shaped or U-shaped trailing portion or end 570.

The trailing end 570 of the peripheral wall 562 includes an arcuate sharpened region 571 extending approximately from a transition segment 569 of the peripheral wall 562 bridging the linear central portion 568 and the trailing end 570 to a termination point 584 of the trailing end 570 located at the bottom edge 509 of the blade 500, as defined by the start of the next interrupted arc portion 572. The arcuate sharpened regions 571 may extend to the bottom edge 509 of the blade 500 or be in close proximity to the bottom edge. Both are contemplated by the present disclosure. The arcuate sharpened regions 571 are concave (like the inside of a bowl) in that they are curving in or hollowed inwardly due to the hook-shape of the trailing end 570 of the peripheral wall 562. The arcuate sharpened regions 571 of the plurality of notches 560 define the respective recessed arcuate cutting regions or portions 580 of the blade 500. The arcuate cutting portions 580 are recessed in that at least a portion of the arcuate sharpened region 571 is within an interior region 582 (that is, the central open portion 564) defined by each of the plurality of notches 560. It should be appreciated of course that the arcuate cutting portions 580 (and the associated sharpened regions 571), instead of being arcuate (by virtue of the hook-shaped trailing end 570 of the peripheral wall 562), could be linear or convex and the present disclose contemplates such an alternate embodiment. In one exemplary embodiment of the rotary knife blade 500, an inner diameter of the blade 500, as defined by the interrupted arc portions 572 constituting the lower edge 509 of the blade 500, is approximately 4.0 in., while the outside diameter of the blade, defined by the radial outermost extent of the outer wall 514 of the annular body 510 of the blade is approximately 5.092 in. In one exemplary embodiment, a thickness of the interrupted arc portions 572 is approximately 0.038 in. Additionally, in one exemplary embodiment, the number notches in the plurality of notches 560 is six, each of which is spaced equidistantly about an inner perimeter or inner diameter of the blade 500, each of the notches subtending an angle $\alpha$ (depicted schematically in FIG. 11) with respect to the central axis of rotation R of approximately 35°.

Trim Guide 700

The trim guide 700, which is stationary with respect to the rotation of the blade 500, includes an upper end 702 and a lower end 704 and defines the planar base 710, the guide section 720 extending axially below and radially inwardly from the base 710, and the guard section 750, including the upwardly extending rib 751, the vertical extension 754 and the radially inwardly extending lip 770, as previously described. The base 710 includes an attachment tab 718 extending from a rearward portion 712 of the base 710. The tab 718 includes an aperture 719. The trim guide 700 is releasably affixed to a bottom surface 321 of the blade housing support region 320 of the frame body 310 by a threaded fastener 800 that extends through the tab aperture 719 and threads into a threaded opening 321*a* of the bottom surface 321 of the blade housing support region 320 of the frame body 310.

The guide section 720 of the trim guide 700 includes an upper end 722 and a lower end 724 and defines a guide section frustoconical wall 721. The frustoconical wall 721 extends along the frustoconical wall 556 of the blade section 550. As described above, the extending distal portion 725 of guide section 720 extends axially below and radially inwardly beyond the lower edge 509 of the rotary knife blade 500 and has two functions: 1) to direct a branch or branches into an interior region 745 defined by one of the plurality of notches 730 as the knife 100 is moved by the operator to cut or trim a branch or branches within the central cutting opening CO of the knife 100; and 2) to guard the blade 500 from inadvertent contact with the ground or plastic mats or sheets positioned on the ground between rows of plants.

In the forward portion 726 of the guide section 720 are the plurality of notches 730 formed the lower end 724 and extending into the frustoconical wall 721. The lower end 724 of the guide section 720 also includes interrupted arc portions 738 that define a lower edge 709 of the trim guide 700. The interrupted arc portions 738 are centered about the blade central axis of rotation R and, if connected and continued, would form a circle defining an inner diameter of the trim guide 700 with a center on the axis of rotation R. Interrupting the arc portions 738 in the forward portion 726 of the guide section 720 are the plurality of notches 730 formed at the lower end 724 of the frustoconical wall 721 of the guide section 720 and extending into the frustoconical wall 721. As can best be seen in FIG. 15, each of the notches of the plurality of notches 730, when viewed in top plan view, defines a generally slanted, concave U-shaped cavity 741 defined by a peripheral wall 742 surrounding a central open portion 743 (the interior region 745) and defining the cavity 741. The peripheral wall 742, when viewed with respect to the counterclockwise direction of rotation CCW of the rotary knife blade 500, includes an angled leading portion or end 732, a generally linear central portion 733, and an angled trailing portion or end 734.

For each of the plurality of notches 730, the leading end 734 of the peripheral wall 742 defines a shearing region or portion 740 extending approximately from a termination point 747 of the notch 730 at the lower end 724 of the guide section 720 where the next adjacent interrupted arc portion 738 commences and extending to a radially innermost point 746 (FIG. 16) of the peripheral wall 742. Or, stated another way, the shearing region or portion 740 extends from the termination point 747 of the notch 730 to a radially innermost point 749 (FIG. 16) of the notch 730, which corresponds to the radially innermost point 746 of the peripheral wall 742. When viewed in top plan view, the shearing portions 740 defined by the leading ends 734 of the respective plurality of notches 730 define a linear segment 740*a* (FIG. 15) over most of their extent moving radially inwardly from the lower end 724 of the guide section 720 and then transition into a shorter arcuate segment 740*b* as the innermost point 746 of the peripheral wall 742 is approached. The shearing portions 740 of the plurality of notches 730 of the trim guide 700 are recessed in that at least a portion of the shearing portion 740 is within an interior region 745 (that is, the central open portion 743) defined by each of the plurality of notches 730.

As explained above, the cutting action of the knife 100 occurs through the combination 480 of the rotating rotary knife blade 500 and the stationary trim guide 700. As the blade 500 rotates about its central axis of rotation R, the shearing portions 740 of the guide section notches 730 come into overlapping axial alignment with the arcuate cutting portions 580 of the blade section notches 560. Additionally, the central open portion 564 or interior region 582 of each of the plurality of notches 560 of the blade section 550 of the rotary knife blade 500 come into overlapping axial alignment with the central open portion 743 or interior region 745 of each of the plurality of notches 730 as the blade 500 rotates about the axis of rotation R. This transitory overlapping alignment of the central open portions 564, 743 or interior regions 582, 745 define transitory cutting pockets 799 (two of which can be seen in FIG. 7). The uncut branch or branches directed into a transitory pocket 799 by the guide section 720 of the trim guide 700, that is, guided into a trim guide notch 730, will be rapidly and efficiently cut by the shearing action of the rotating cutting portions 580 of the blade 500 passing over the stationary shearing portions 740 of the trim guide 700 as the rotary knife blade 500 continues its high speed rotation in the counterclockwise direction CCW. The cutting pockets 799 are transitory in that as the blade 500 continues to rotate about its axis of rotation R, the blade 500 rotates with respect to the stationary trim guide 700. Thus, as would be understood, new cutting pockets 799 are formed by overlapping interior regions 582, 745 and then disappear as cutting of the branch or branches with the cutting pockets 799 occurs by shearing action by virtue of the rotating cutting portions 580 of the blade 500 passing over the stationary shearing portions 740 of the trim guide 700. Thus, as the blade 500 rotates about the central axis of rotation R, new cutting pockets 799 are constantly formed and old cutting pockets 799 disappear as cutting occurs and branches in the cutting pockets are cut by shearing action.

In one exemplary embodiment of the trim guide 700, an inner diameter of the trim guide 700, as defined by the interrupted arc portions 738 constituting the lower edge 709 of the trim guide 700, is approximately 3.809 in., while a diameter defined by a radially innermost point of each of the plurality of notches 730 of the guide section 720 is approximately 4.631 in. Additionally, in one exemplary embodiment, the number notches in the plurality of notches 730 is six, each of the notches subtending an angle β (depicted schematically in FIG. 15) with respect to the central axis of rotation R of approximately 20°.

Annular, as used herein, means generally ring-like or generally ring-shaped in configuration and includes configuration wherein the ring include or does not include a split extending through a diameter of the ring or annulus. Axially above or axially spaced above, as used herein, means positioned above as viewed with respect to an axis, for example, the central axis of rotation R of the rotary knife blade 500, even if the two elements are not in axial alignment with respect to the axis. Similarly, the terms axially below or axially spaced below, as used herein, means positioned below as viewed with respect to an axis, for example, the central axis of rotation R of the rotary knife blade 500, even if the two elements are not in axial alignment with respect to the axis. Axially extending, as used here, means one element extends from and is positioned above or below a second element with respect to an axis, even if the two elements are not in axial alignment with respect to the axis. Similarly, the terms radially offset from, radially outward of, radially inward of, as used herein, means one element is positioned offset from a second element, as viewed along a radius line extending radially from an axis, for example, the central axis of rotation R of the rotary knife blade 500, even if the two elements are not in radial alignment along the radius line because one element is axially above or axially below the other element

Second Exemplary Embodiment—Power Operated Rotary Knife Assembly 1000

Figure 20:
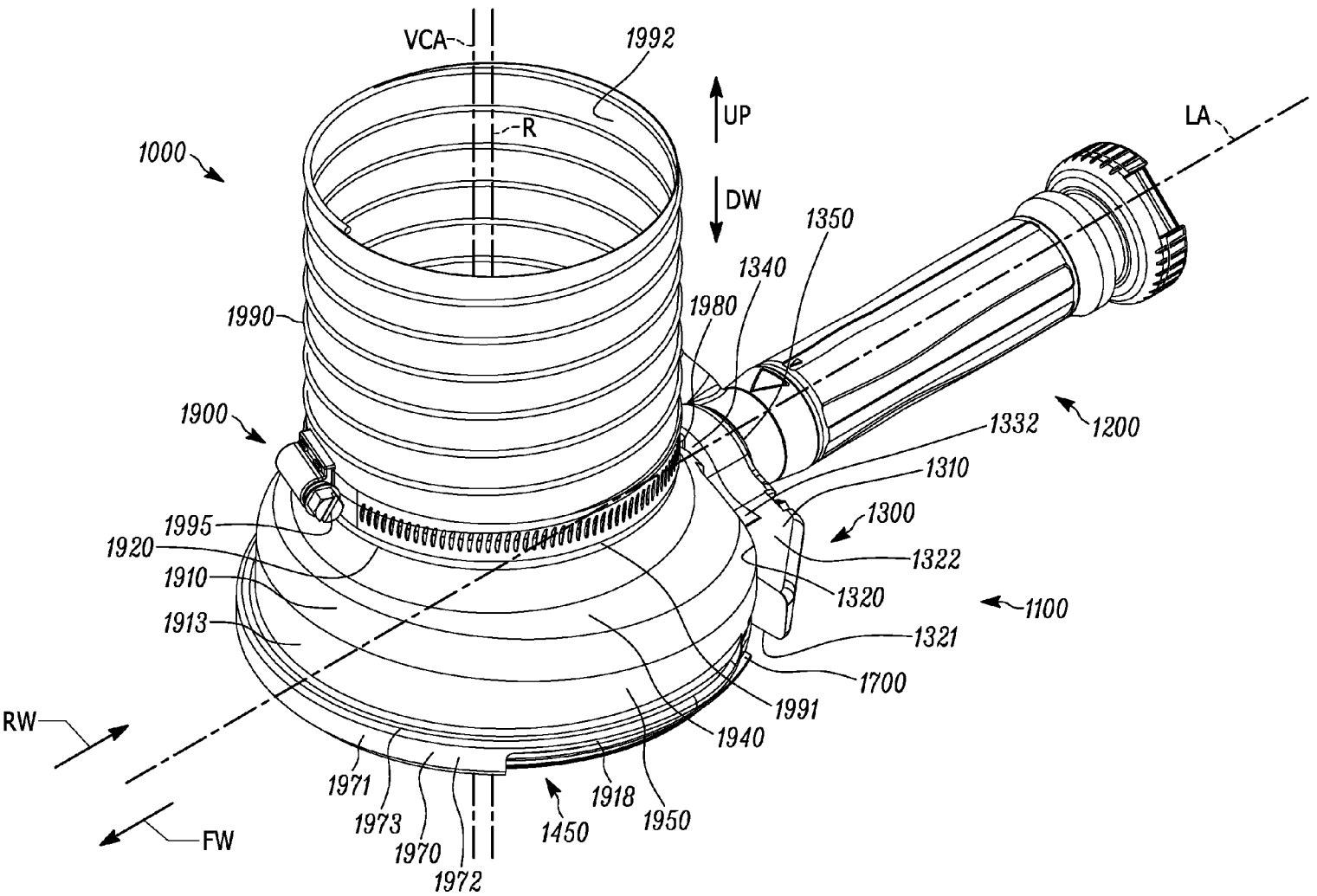
FIG. 20 is a schematic top front perspective view of a second exemplary embodiment of a power operated rotary knife assembly of the present disclosure including a power operated rotary knife and a vacuum assembly, the power operated rotary knife including a handle assembly, a head assembly, including a notched annular rotary knife blade, a blade housing, a notched trim guide, and a vacuum connector, the vacuum assembly including the vacuum connector and a vacuum hose coupled to the vacuum connector.
Figure 21:
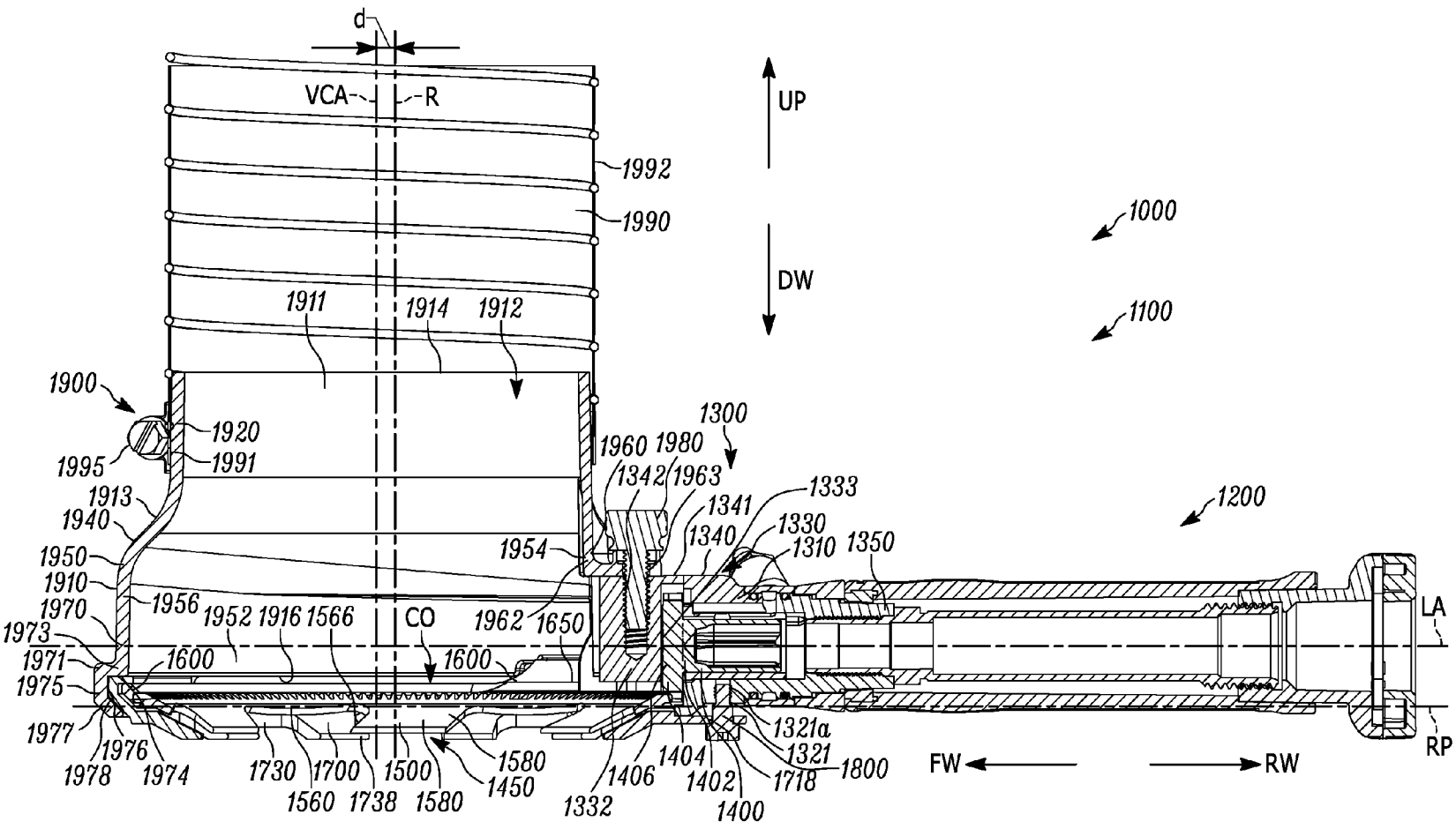
FIG. 21 is a schematic longitudinal section view of the power operated rotary knife assembly of FIG. 20.
Figure 22:
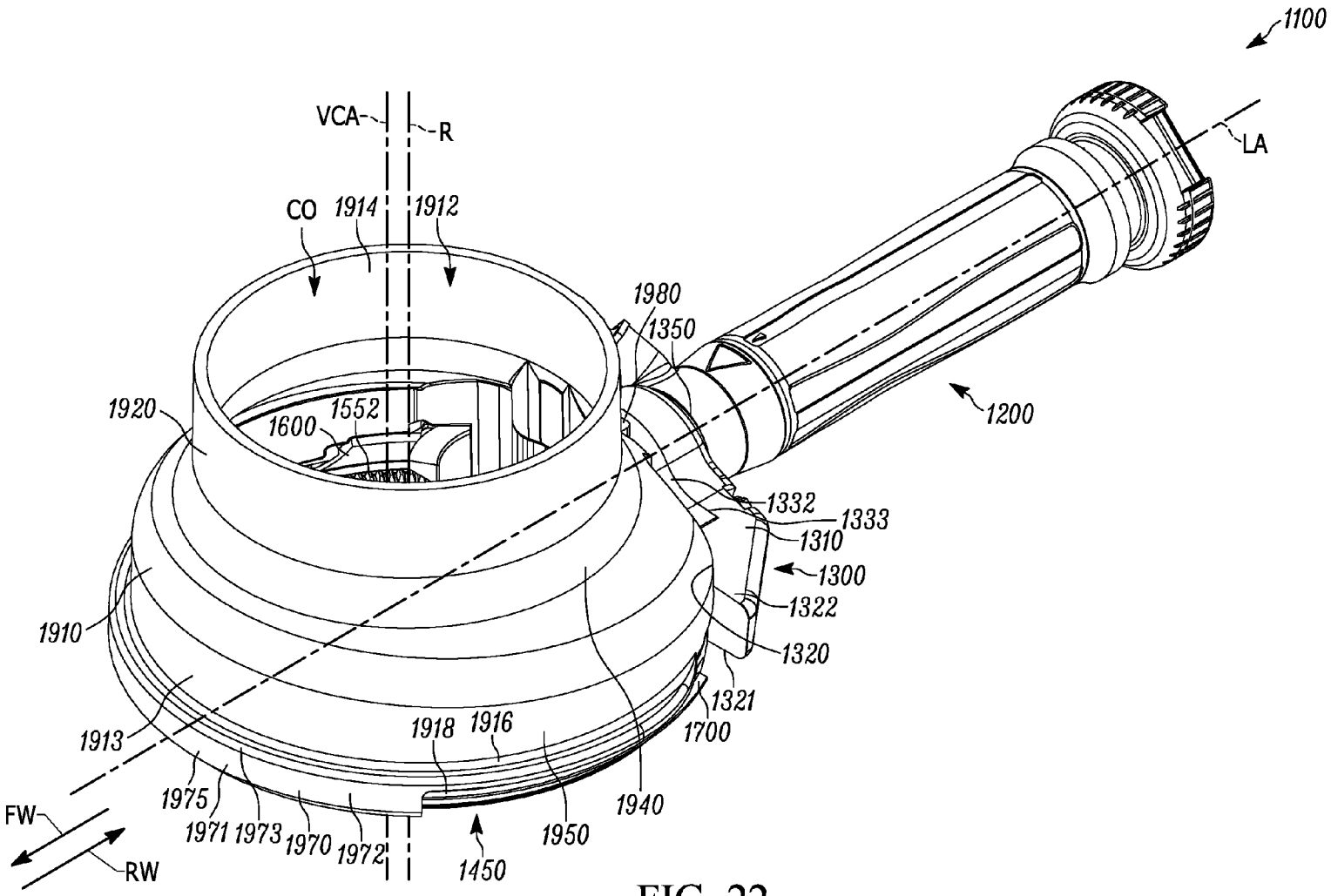
FIG. 22 is a schematic top front perspective view of the power operated rotary knife of FIG. 20, the vacuum hose of the vacuum assembly being removed for clarity purposes.
Figure 23:
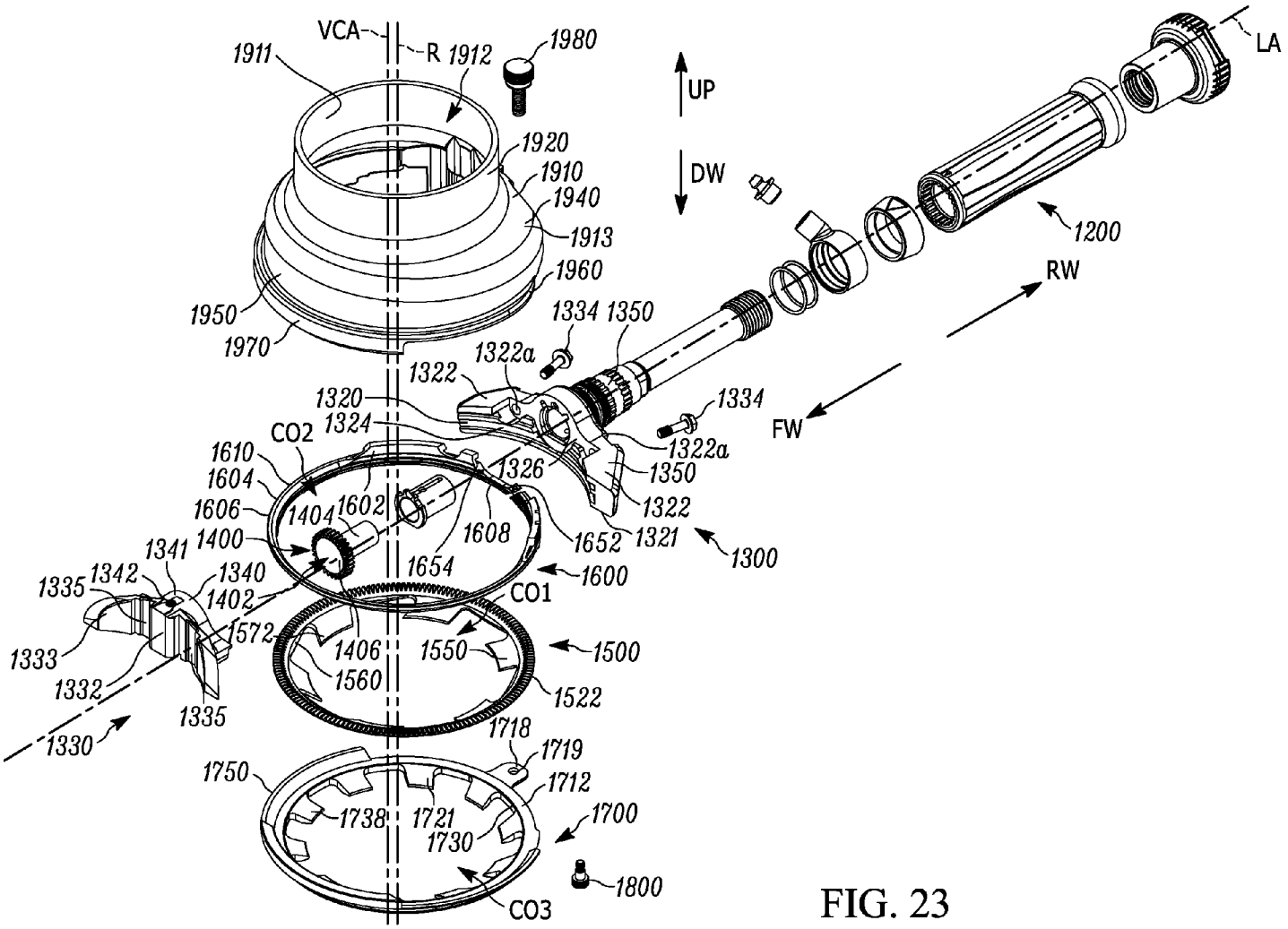
FIG. 23 is a schematic exploded perspective view of the power operated rotary knife of FIG. 22.
Figure 24:
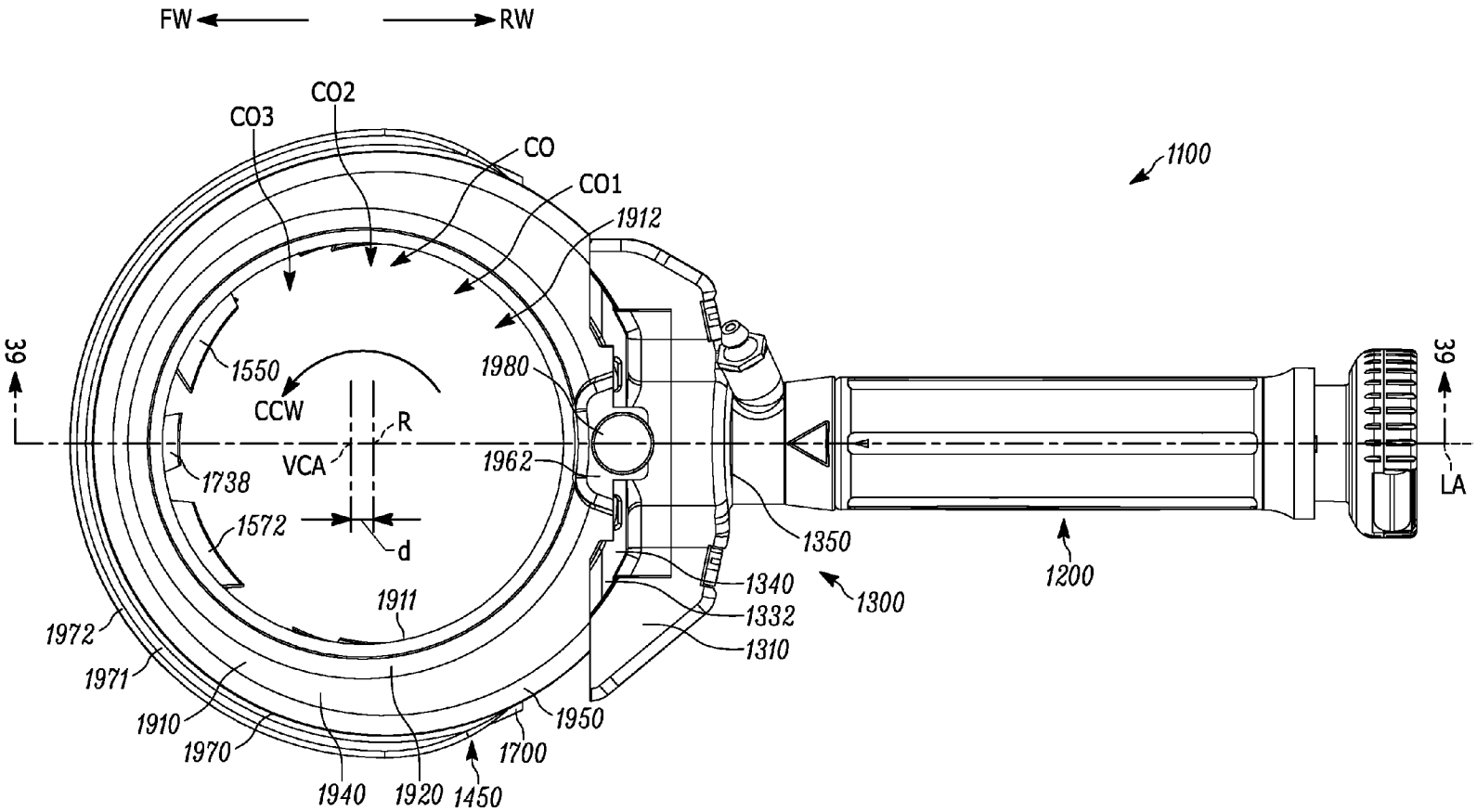
FIG. 24 is a schematic top plan view of the power operated rotary knife of FIG. 22.
Figure 25:
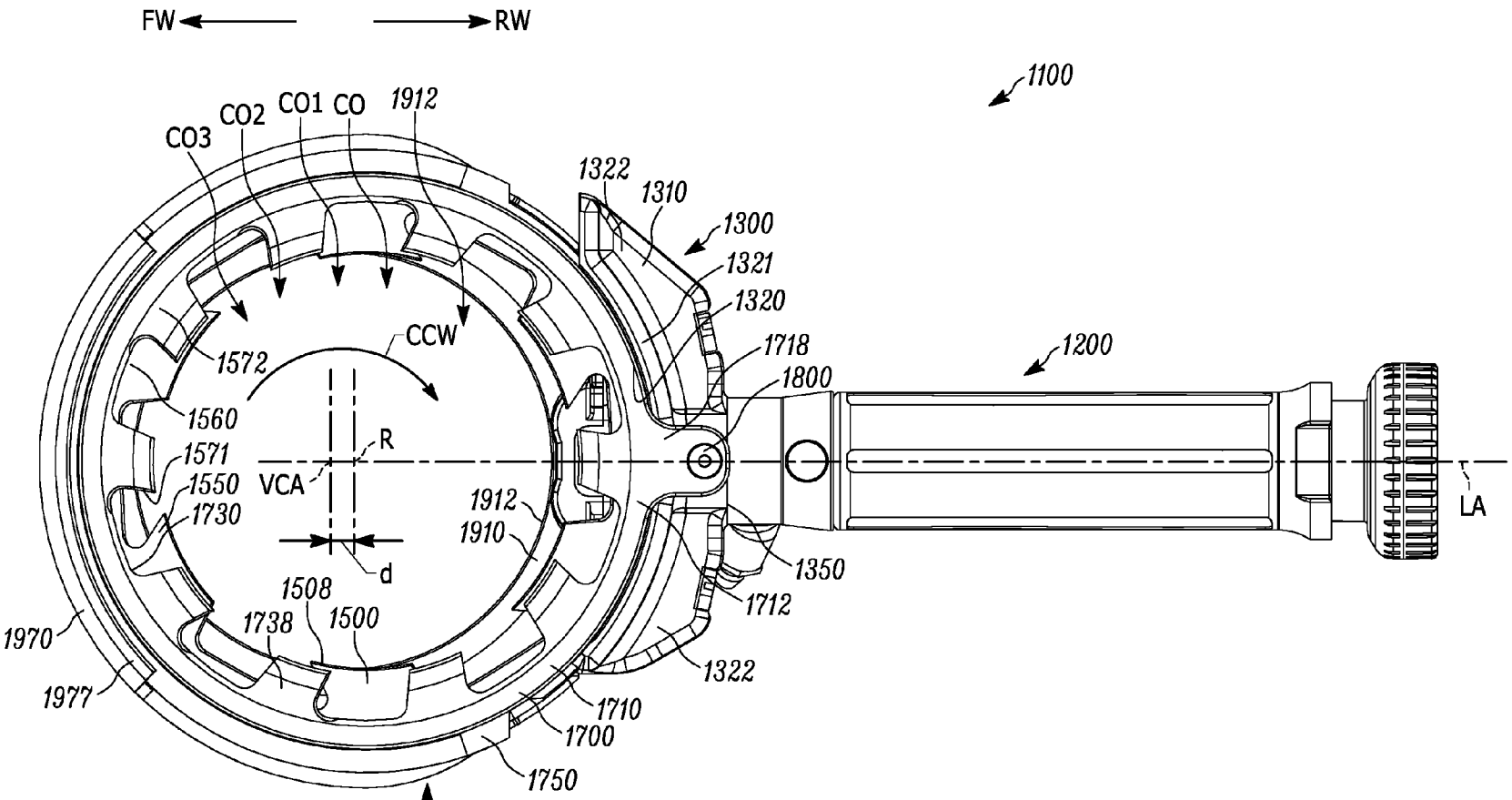
FIG. 25 is a schematic bottom plan view of the power operated rotary knife of FIG. 22.

A second exemplary embodiment of a power operated rotary knife assembly of the present disclosure is schematically shown, generally at 1000, in FIGS. 20-21. The power operated rotary knife assembly 1000 includes a power operated rotary knife 1100, generally similar in structure and function to the power operated rotary knife 100 of the first exemplary embodiment, and a vacuum assembly 1900. The power operated rotary knife 1100 is best seen in the schematic depictions of FIGS. 22-25, wherein a vacuum hose 1990 of the vacuum assembly 1900 has been removed for clarity. Advantageously, the vacuum assembly 1900 functions to remove, by vacuum suction, cut or trimmed materials (cut elements/branches) from the cutting opening CO of the power operated rotary knife 1100. The vacuum assembly 1900 (depicted schematically in FIGS. 20 and 21) expeditiously and efficiently removes trimmed branch materials from the cutting opening or cutting region CO (best seen in FIGS. 26 and 27) and, thus, away from the plant being trimmed, keeping the plant and the plant bed areas clean and free from trimmed branch materials is advantageous from a horticultural point of view. Leaving trimmed materials on the remaining branches of the plant or leaving trimmed materials to decay on the ground in the plant bed area is unsightly and potentially could lead to plant disease and/or insect infestation problems.

For brevity, the structural details/functions/advantages of those components and assemblies of the power operated rotary knife 1100 which are similar to the corresponding components and assemblies of the power operated rotary knife 100 will not be repeated in detail, all of the structural details/functions/advantages discussed above with respect to the power operated rotary knife 100 are hereby incorporated by reference with respect to the second exemplary embodiment. Explanations regarding the description of the power operated rotary knife 100, set forth above, are also hereby incorporated by reference with respect to the second exemplary embodiment. Common reference numbers and letters used in the two embodiments are assumed to represent similar concepts and/or structural details.

As best seen in FIGS. 22-25, the power operated rotary knife 1100 includes an elongated handle assembly 1200 extending and centered about a handle assembly longitudinal axis LA, similar to the handle assembly 200 of the power operated rotary knife 100 of the first exemplary embodiment, and a head assembly 1300, similar to the head assembly 300) of the power operated rotary knife 100. The head assembly 1300 includes a notched annular rotary knife blade 1500 supported for rotation about a central axis of rotation R by the split blade housing 1600, similar in operation and structure to the rotary knife blade 500 and blade housing 600 of the power operated rotary knife 100.

Additionally, as with rotary knife blade 500 and the trim guide 700 of the power operated rotary knife 100, cutting and trimming of branches for the power operated rotary knife 1100 is accomplished by the shearing action of the rotating rotary knife blade 1500 and a notched stationary trim guide 1700. The configuration of the rotary knife blade 1500 and the trim guide 1700 are generally the same as the counterpart rotary knife blade 500 and trim guide 700 of the power operated rotary knife 100. The structure differences of the rotary knife blade 1500 and the trim guide 1700 from their counterparts of the first exemplary embodiment are explained below.

The head assembly 1300 (FIG. 23) further includes a frame body 1310, similar to the frame body 310 of the power operated rotary knife 100, including a forward blade housing support region 1320 and a rearwardly extending annular boss 1350 and a clamping assembly 1330, similar to the clamping assembly 330 of the power operated rotary knife 100. As shown in FIGS. 20 and 21, the directions forward FW and rearward RW are generally along and with respect to the handle assembly longitudinal axis LA and the directions up UP and down DW are generally along and with respect to the rotary knife blade axis of rotation R. The clamping assembly 1230 includes an arcuate clamp 1332 secured to the frame body 1310 by a pair of threaded fasteners 1334 that extend through respective horizontally oriented openings 1322 of a pair of outwardly extending arcuate arms 1322 of the frame body 1310 and thread into respective threaded openings in a proximal wall 1333 of the clamp 1332. The clamping assembly 1330 functions to secure a split blade housing 1600 to the blade housing support region 1320, as described with respect to the head assembly 300 of the power operated rotary knife 100. The forward blade housing support region 1320 of the frame body 1310 includes the pair of outwardly extending arcuate arms 1322. The arcuate arms 1322 define a blade housing mounting region 1324 for receiving an arcuate mounting section 1650 of the blade housing 1600 and a clamping receiving region 1326 for receiving the proximal wall 1333 of the clamp 1332 of the clamping assembly 1330. The head assembly 1300 of the power operated rotary knife 100 also includes a drive mechanism 1400, similar to the drive mechanism 400 of the power operated rotary knife 100.

In addition to the foregoing, the head assembly 1300 of the power operated rotary knife 1100 further includes a vacuum connector 1910 (FIGS. 36-40), which is releasably affixed to the blade housing 1600. The vacuum connector 1910 is both a part or component of the head assembly 1300 of the power operated rotary knife 1100 and also is a part or component of the vacuum assembly of the power operated rotary knife assembly 1000. The vacuum assembly additionally includes a flexible vacuum hose 1990 and a vacuum clamp 1995 for affixing a proximal end portion 1991 of the vacuum hose 1990 to an upper or exit end 1914 of the vacuum connector 1910. The vacuum connector 1910 defines an inverted funnel-shaped interior region 1912 that provides a fluid communication path for the flow of trimmed foliage material from the cutting opening CO of the power operated rotary knife 1100 to an interior region 1992 of a vacuum hose 1990 to provide for efficient remove of trimmed materials by a vacuum drawn in the interior regions 1992, 1912 of the vacuum hose 1990 and the vacuum adapter 1910 from the cutting opening CO. That is, in the power operated rotary knife 100, after shearing, cut materials drop generally downwardly from the shearing region toward the ground by action of gravity. By contrast, with the power operated rotary knife assembly 1000, the vacuum assembly 1900 functions to apply a vacuum suction pressure in the region of the cutting opening CO to draw cut materials into an interior region 1912 defined by the inverted funnel-shaped vacuum connector 1910 and ultimately into the interior region 1992 of a vacuum hose 1990. Vacuum pressure drawn in the vacuum hose interior region 1992 is communicated through the interior region 1912 of the vacuum connector 1910 and into an interior region of the rotary knife blade 1500. The vacuum suction pressure is created by a suitable vacuum motor system (not shown) and the cut materials accumulate in a container (not shown) at a proximal end of the vacuum hose 1992.

As mentioned above, the head assembly 1300 includes the notched annular rotary knife blade 1500 (FIGS. 29-32), the coacting stationary, notched trim guide 1700 (FIGS. 32-35), the blade housing 1600 (FIGS. 23, 28 and 28A) and the vacuum connector 1910 (FIGS. 36-40). The rotary knife blade 1500 is supported by the stationary blade housing 1600 for rotation about a central axis of rotation R of the blade 1500. The blade housing 1600 is positioned between the rotary knife blade 1500 and the trim guide 1700. The trim guide 1700 is secured to the frame body 1310 by a threaded fastener 1800 which passes through an aperture 1719 in a attachment tab 1718 of the trim guide 1700 and threads into a threaded opening 1321*a* of a bottom surface 1321 of the blade housing support region 1320 of the frame body 1310 to secure the trim guide 1700 to the frame body 1310 (similar in structure and function to the fastener 800 and the attachment tab 718 of the trim guide 700 of the power operated rotary knife 100).

As can be seen in FIG. 21, the vacuum connector 1910 is secured to a clamp 1332 of the clamping assembly 1330 by a threaded fastener 1980 (FIG. 21) which extends through a vertically oriented opening 1963 defined in a radially extending boss 1962 of a clamp interface portion 1960 of a lower mounting section 1950 of the vacuum connector 1910. The threaded fastener 1980 threads into a threaded opening 1342 formed in an upper surface 1340 of the clamp member 1332 to secure the vacuum connector 1910 to the clamp member 1332 and thereby couple the vacuum connector 1910 to the frame body 1310. In one exemplary embodiment, the threaded connector 1980 is a thumbscrew to advantageously allow for easy removal of the vacuum connector 1910 from the remainder of the head assembly 1300, specifically the clamp member 1332 and the blade housing 1600 for servicing of the vacuum connector 1910. The vacuum connector 1910 is also secured to the trim guide 1700 by a C-shaped latch 1972 (best seen in FIGS. 39 and 40) extending from an arcuate rim portion 1971 of a trim guide interface portion 1970 of the lower mounting section 1950 of the vacuum connector 1910. The C-shaped latch 1972 of the trim guide interface portion 1970 latches or hooks on to an axially and radially extending rib 1951, a vertical extension 1754 and a radially inwardly extending lip 1770 of a guard section 1750 (best seen in FIGS. 32 and 35) of the trim guide 1700. The C-shaped latch 1972 to the trim guide 1700 is circumferentially opposite of the connection of the thumbscrew 1980 of the vacuum connector boss 1962 to the clamp member upper surface 1340. The combined coupling of the C-shaped latch 1972 and the thumbscrew 1980 releasably secure the vacuum connector 1910 to remainder of the head assembly 1300.

Figure 26:
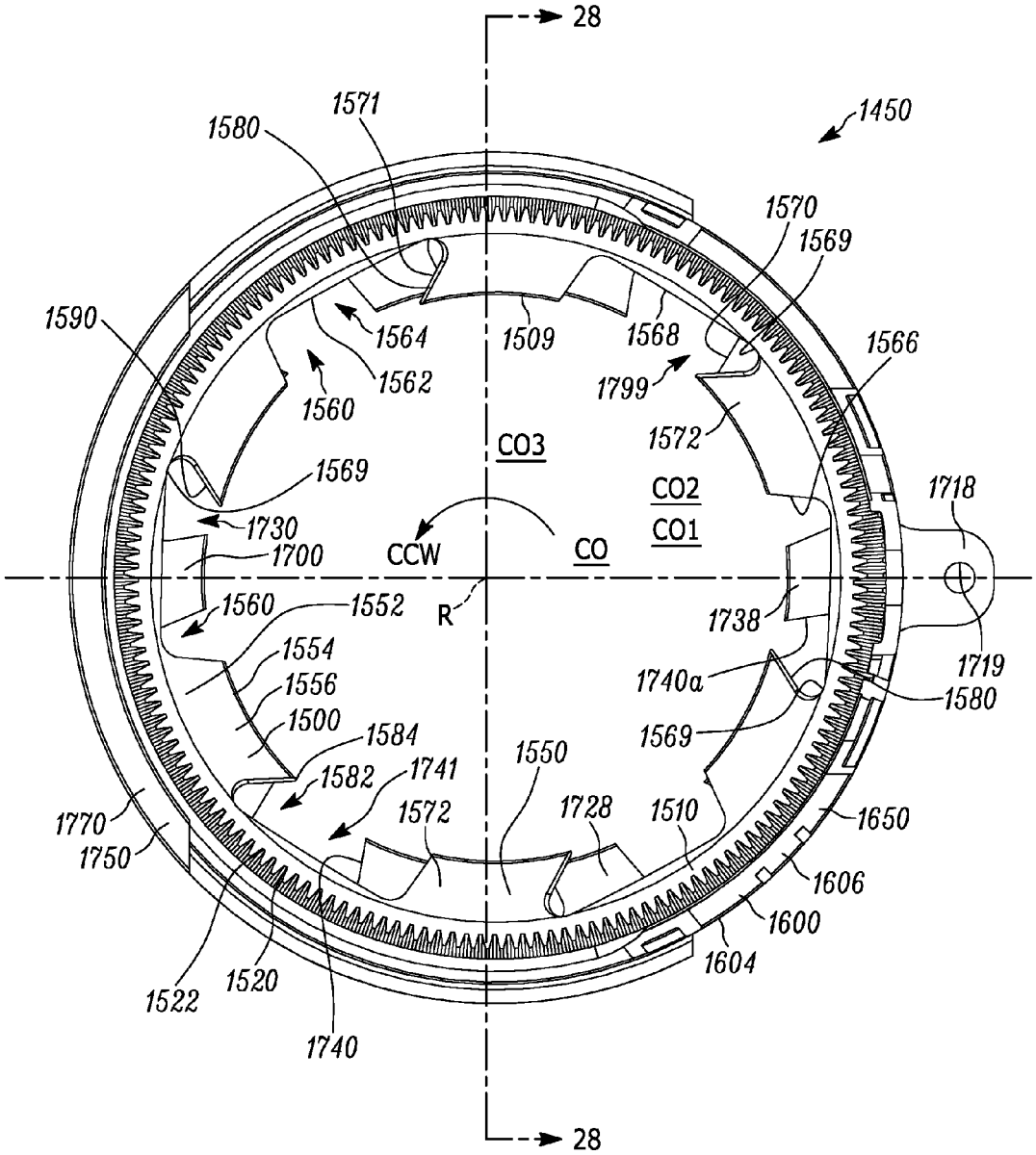
FIG. 26 is a schematic top plan view of a combination of the notched annular rotary knife blade, the blade housing, and the notched trim guide of the head assembly of the power operated rotary knife assembly of FIG. 20.
Figure 27:
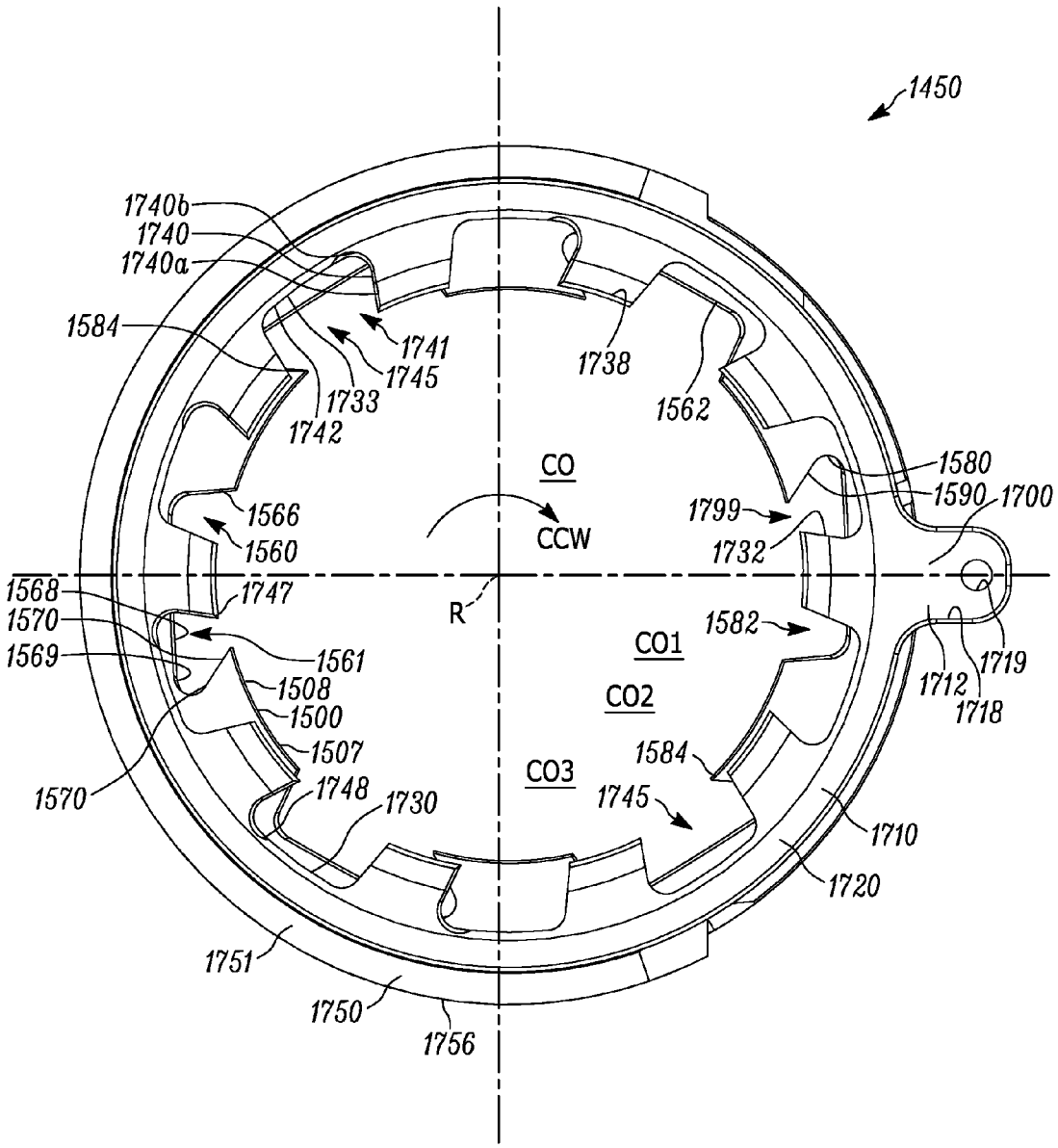
FIG. 27 is a schematic bottom plan view of the combination of the notched annular rotary knife blade, the blade housing, and the notched trim guide of the head assembly of the power operated rotary knife assembly of FIG. 20.

As schematically depicted in FIGS. 26 and 27, each of the rotary knife blade 1500, the blade housing 1600 and the trim guide 1700 are annular, defining central open regions CO1, CO2, CO3, respectively. When the rotary knife blade 1500, the blade housing 1600 and the trim guide 1700 are assembled and attached to the frame body 1310 of the head assembly 1300, the central open regions of a combination 1450 of the blade 1500, the blade housing 1600 and trim guide 1700 define the central cutting opening CO of the power operated rotary knife 1100. Cutting and trimming take place along a periphery of the central cutting opening CO. The central cutting opening CO is actually defined by a combination 1480 of the blade 1500, and the trim guide 1700. As can be seen in FIGS. 21 and 26-28A, no portion of the blade housing 1600 extends radially inwardly far enough to define any portion of the central cutting opening CO of the power operated rotary knife 1100. Thus, the central cutting opening CO is defined by intersecting central open regions CO1, CO3 of the assembled combination 1480 of the rotary knife blade 1500 and trim guide 1700.

Blade Housing 1600

As best seen in FIGS. 21, 23, 28 and 28A, the rotary knife blade 1500 of the power operated rotary knife 1100 is supported for rotation about the central axis of rotation R by the annular blade housing 1600. The blade housing includes a split, annularly curved blade support section 1610 that surrounds and supports the rotary knife blade 1500 about the entire 360 degree circumference of the blade 1500 and a mounting section 1650 extending axially from the blade support section 1610 and provides a mounting structure for releasably mounting the blade 1500 and blade housing 1600 to the blade housing mounting region 1324 of the forward blade housing support region 1320 of the frame body 1310. The blade housing 1600 includes an inner wall 1602 and an outer wall 1604 and an upper end 1606 and a lower end 1608. Adjacent the lower end 1608, the inner wall 1602 defines a bearing surface 1620, which in one exemplary embodiment is a radially inwardly protruding bearing bead 1622, extending from an inner wall 1602 of the blade housing 1600. The blade housing bearing bead 1622 extends into a generally V-shaped opening or bearing race 1540 formed in and extending radially into an outer wall of the 1514 of an annular body 1510 of the rotary knife blade 1500 to support the blade 1500 for rotation about the axis of rotation R. The blade bearing race 1540 comprises two axially spaced apart, generally frustoconical, bearing faces 1542 which bear against the blade housing bead 1622 to support the blade both axially and radially. The bearing support structure of the bearing bead 1622 of the blade housing 1600 and the bearing race 1540 of the rotary knife blade 1500 define a cutting plane RP of the rotary knife blade 1500, which is substantially orthogonal to the blade central axis of rotation R.

The mounting section 1650 of the blade housing 1600 includes an angled split 1652 and a pinion clearance region 1654. The pinion clearance region 1654 of the blade housing mounting section 1650 provides for clearance for a gear head 1406 of a pinion gear 1404 of a drive train 1402 of the drive mechanism 1400. The angled split 1652 of the mounting section 1650 is circumferentially offset from the pinion clearance region 1654 and provides for expansion of the blade housing diameter for purposes of changing the rotary knife blade 1500 when the blade has reached the end of its useful life. Specific details regarding an annular blade housing with an angle split and offset pinion clearance region are disclosed in U.S. Pat. No. 8,661,692 to Whited et al., issued Mar. 4, 2014. U.S. Pat. No. 8,661,692 is assigned to the assignee of the present invention and is incorporated herein in its entirety by reference.

The rotary knife blade 1500, the blade housing 1600, and the trim guide 1700, are all annular and, when assembled, define an overlapping sandwiched combination 1450 wherein the blade housing blade support section 1610 is radially sandwiched between, on the radial inside, the annular body 1510 of the rotary knife blade 1500 and, on the radial outside, by a radially outwardly and axially upwardly extending rib 1751 of the guard section 1750 of the trim guide 1700. The rib 1751 includes a frustoconical section 1752. A vertical extension 1754 of the guard section 1750 extends from an upper end 1751*a* of the rib 1751 and is disposed axially above the rib 1751. A radially inwardly extending lip 1770 of the guide section 1570 extends from an upper end 1754*a* of the vertical extension 1754 in a radially inward direction. An angle subtended by the rib frustoconical section 1752 is greater than 180°, while an angle subtended by the upper vertical extension 1754 and the lip 1770 are significantly less than 180°.

Rotary Knife Blade 1500

Figure 29:
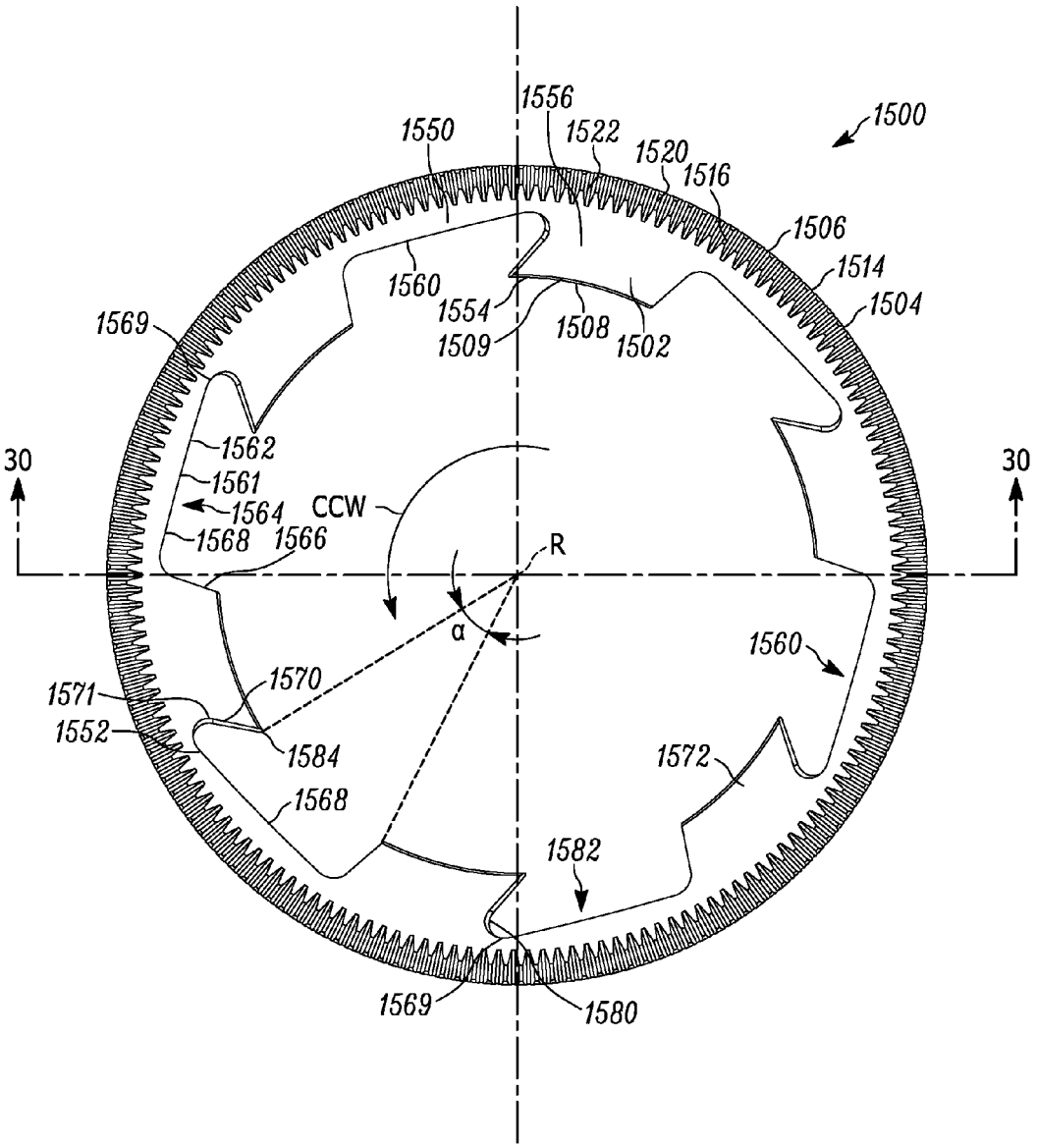
FIG. 29 is a schematic top plan view of the notched annular rotary knife blade of the head assembly of the power operated rotary knife assembly of FIG. 20.
Figure 30:
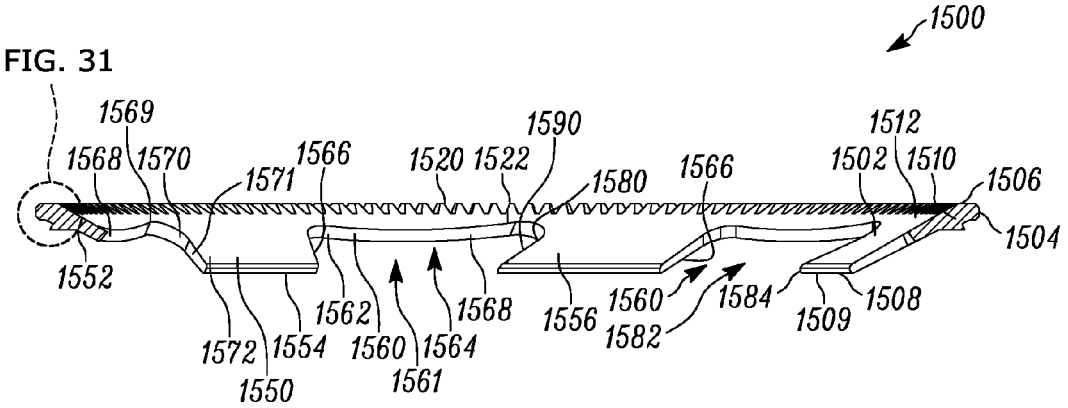
FIG. 30 is a schematic longitudinal section view of the notched annular rotary knife blade of FIG. 29, as seen from a plane indicated by the line 30-30 in FIG. 29.
Figure 31:
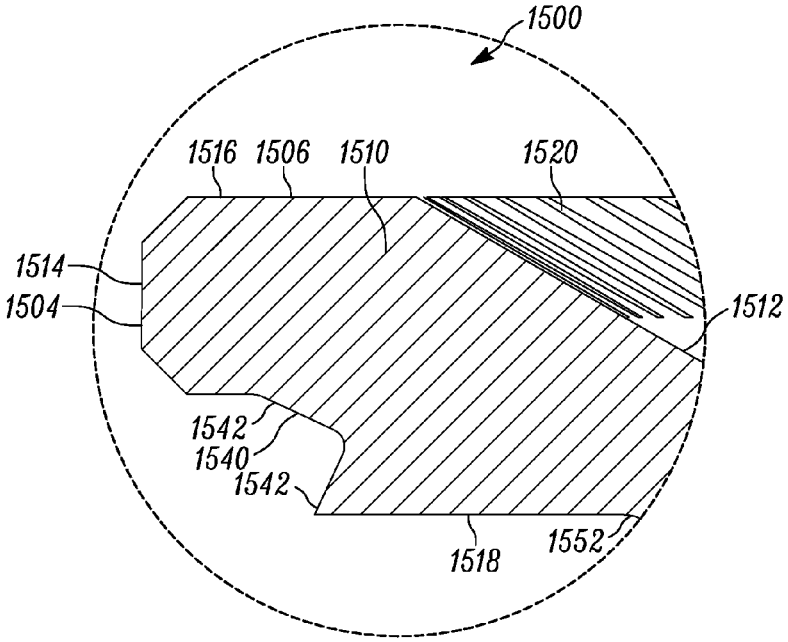
FIG. 31 is a schematic enlarged section view of an end portion of the notched annular rotary knife blade of FIG. 29 that is within a dashed circle labeled FIG. 31 in FIG. 30.
Figure 32:
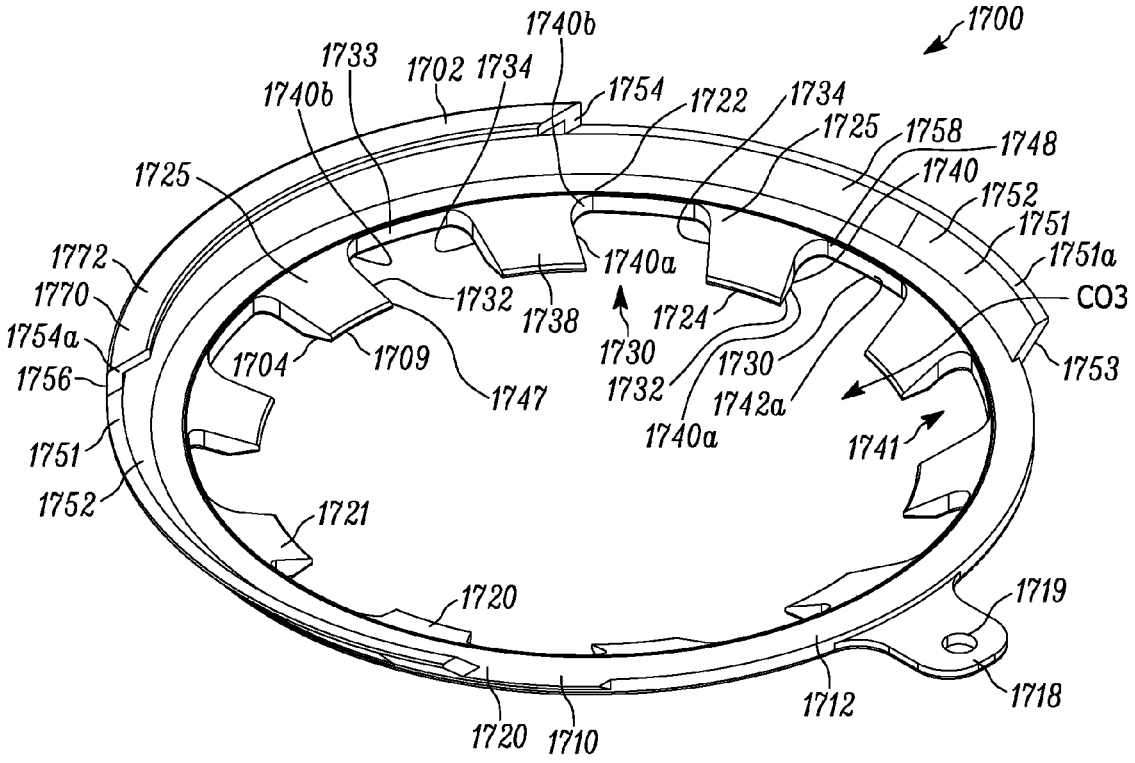
FIG. 32 is a schematic top perspective view of the notched trim guide of the head assembly of the power operated rotary knife assembly of FIG. 20.

As best seen in FIGS. 29-31, the rotary knife blade 1500 of the power operated rotary knife 100 of the second exemplary embodiment includes an inner wall 1502 and a radially spaced apart outer wall 1504 and an upper end 1506 and an axially spaced apart lower or bottom end 1508. The inner wall 1502 defines a central opening of the blade 1500. The blade 1500 includes the annular body 1510 which defines an inner wall 1512 (defining part of the inner wall 1502 of the blade 1500), an outer wall 1514 (defining part of the outer wall 1504 of the blade 1500), an upper end 1516 (defining the upper end 1506 of the blade 1500) and a lower end 1518. The rotary knife blade 1500 further includes the blade section 1550 extending axially downwardly and radially inwardly (toward the blade axis of rotation R) from the lower end 1518 of the annular body 1510. The blade section 1550 includes upper end 1552 adjacent the annular body lower end 1518 and a lower end 1554 (defining the lower end 1508 of the blade 1500) and a generally frustoconical wall 1556 extending therebetween.

The upper end 1516 of the annular body 1510, as mentioned above, defines the driven gear 1520 of the blade 1500. The driven gear 1520 comprises a set of gear teeth formed in a circumference adjacent the outer wall 1514 of the annular body. Adjacent the lower end 1518 of the annular body, the blade bearing race 540 defining frustoconical bearing surfaces 542 is formed in the outer wall 1514 of the annular body, as described above.

The lower end 1554 of the blade section 1550 includes interrupted arc portions 1572 that define a lower edge 1509 of the blade 1500. The interrupted are portions 1572 are centered about the blade central axis of rotation R and, if connected and continued, would form a circle defining an inner diameter of the blade 1500 with a center on the axis of rotation R. Typically, the interrupted arc portions 1572 would define a cutting edge of the blade, but, in the rotary knife 1500, the cutting edge 1590 of the blade is defined by a plurality of recessed, arcuate cutting portions 1580 within the plurality of notches 1560. Interrupting the arc portions 1572 are the plurality of notches 1560 formed at the lower end 1554 of the frustoconical wall 1556 of the blade section 1550 and extending into the frustoconical wall 1556. As can best be seen in FIGS. 29 and 30, each of the notches of the plurality of notches 1560, when viewed in top plan view, defines a generally rectangular cavity 1561 defined by a peripheral wall 1562 surrounding a central open portion 1564 and defining the cavity 1561. The peripheral wall 1562 of each notch of the plurality of notches 1560, when viewed with respect to the counterclockwise direction of rotation CCW of the rotary knife blade 1500, includes an angled leading portion or end 1566, a generally linear central portion 1568, and a hook-shaped or U-shaped trailing portion or end 1570.

As best seen in FIGS. 29 and 30, the trailing end 1570 of the peripheral wall 1562 includes an arcuate sharpened region 1571 extending approximately from a transition segment 1569 of the peripheral wall 1562 bridging the linear central portion 1568 and the trailing end 1570 to a termination point 1584 of the trailing end 1570 located at the bottom edge 1509 of the blade 1500, as defined by the start of the next interrupted arc portion 1572. The arcuate sharpened regions 1571 may extend to the bottom edge 1509 of the blade 1500 or be in close proximity to the bottom edge 1509. Both are contemplated by the present disclosure. The arcuate sharpened regions or cutting portions 1571 are concave (like the inside of a bowl) in that they are curving in or hollowed inwardly due to the hook-shape of the trailing end 1570 of the peripheral wall 1562. The arcuate sharpened regions 1571 of the plurality of notches 1560 define the respective recessed arcuate cutting regions or portions 1580 of the blade 1500. The arcuate cutting portions 1580 are recessed in that at least a portion of the arcuate sharpened region 1561 is within an interior region 1582 (that is, the central open portion 1564) defined by each of the plurality of notches 1560.

It should be appreciated of course that the arcuate cutting portions 1580 (and the associated sharpened regions 1571), instead of being arcuate (by virtue of the hook-shaped trailing end 1570 of the peripheral wall 1562), could be linear or convex and the present disclose contemplates such an alternate embodiment. In one exemplary embodiment of the rotary knife blade 1500, an inner diameter of the blade 1500, as defined by the interrupted are portions 1572 constituting the lower edge 1509 of the blade 1500, is approximately 3.704 in., while the outside diameter of the blade, defined by the radial outermost extent of the outer wall 1514 of the annular body 1510 of the blade is approximately 5.092 in. The inner diameter of the blade 1500 is approximately twice the radius RAD, schematically depicted in FIG. 11. In one exemplary embodiment, a thickness of the interrupted arc portions 1572 is approximately 0.063 in. Additionally, in one exemplary embodiment, the number notches in the plurality of notches 1560 is six, each of which is spaced equidistantly about an inner perimeter or inner diameter of the blade 1500, each of the notches subtending an angle $\alpha$ (depicted schematically in FIG. 29) with respect to the central axis of rotation R of approximately 32°.

Trim Guide 1700

As can best be seen in FIGS. 32-35, the trim guide 1700 of the power operated rotary knife 1100, which is stationary with respect to the rotation of the blade 1500, includes an upper end 1702 and a lower end 1704 and defines the planar base 1710, the guide section 1720 extending axially below and radially inwardly from the base 1710, and the guard section 1750, including the radially outwardly and upwardly extending rib 1751, the vertical extension 1754 and the radially inwardly extending lip 1770. As can best be seen in FIG. 35, the guard section 1750 of the trim guide 1700 extends axially upwardly and radially outwardly from the base 1710. The rib 1751 of the guard section 1750 includes the frustoconical section 1752. The vertical extension 1754 extends axially upwardly from the upper end 1751*a* of the rib 1751. The lip 1770 extends radially inwardly from the upper end 1754*a* of the vertical extension 1752. The lip 1770 subtends an angle substantially equal to the angle subtended by the vertical extension 1752. The base 1710 includes the attachment tab 1718 extending from a rearward portion 1712 of the base 1710. The tab 1718 includes the aperture 1719. The trim guide 1700 is releasably affixed to the bottom surface 1321 of the blade housing support region 1320 of the frame body 1310 by the threaded fastener 1800 that extends through the tab aperture 1719 and threads into the threaded opening 1321*a* of the bottom surface 1321 of the blade housing support region 1320 of the frame body 1310.

Figure 35:
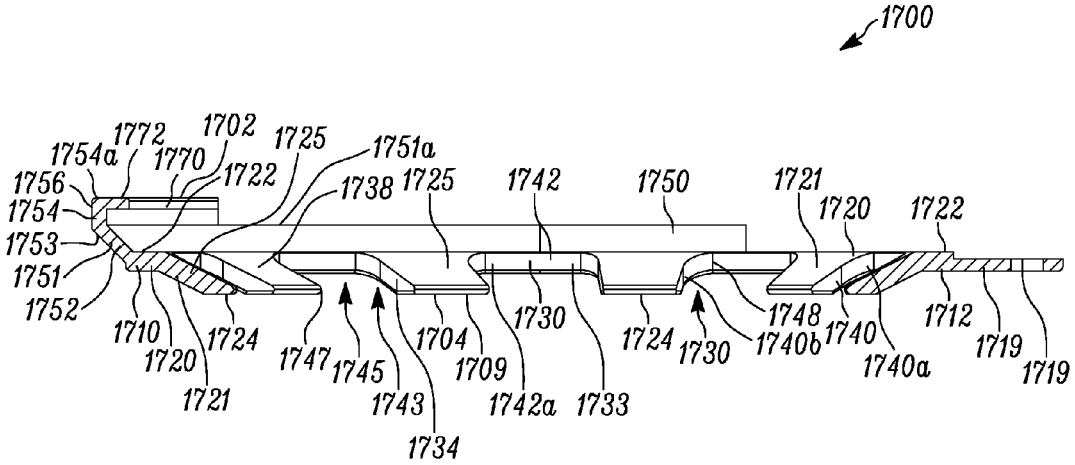
FIG. 35 is a schematic longitudinal section view of the notched trim guide of FIG. 32, as seen from a plane indicated by the line 35-35 in FIG. 33.
Figure 36:
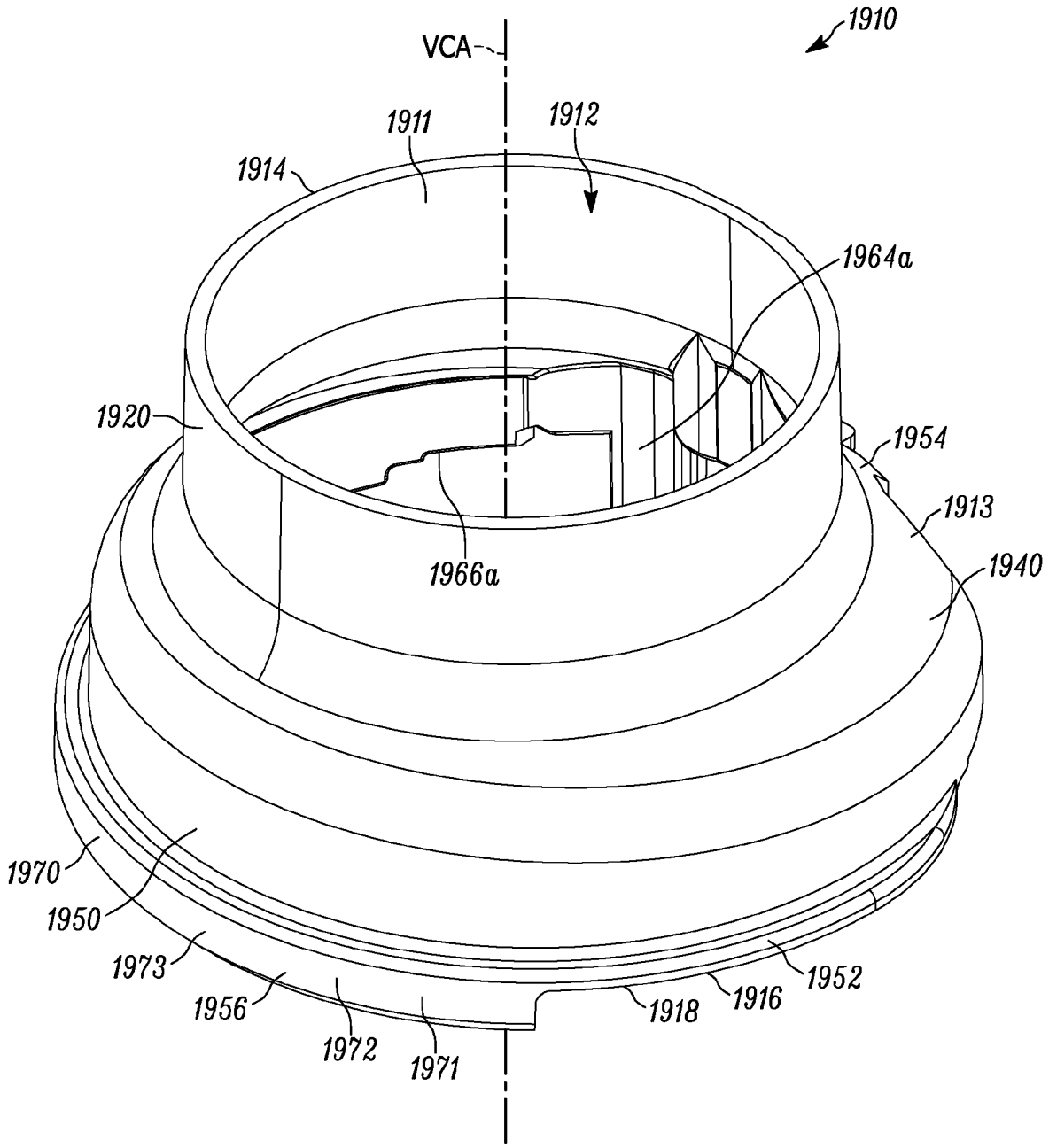
FIG. 36 is a schematic top perspective view of the vacuum connector of the head assembly of the power operated rotary knife assembly of FIG. 20.
Figure 37:
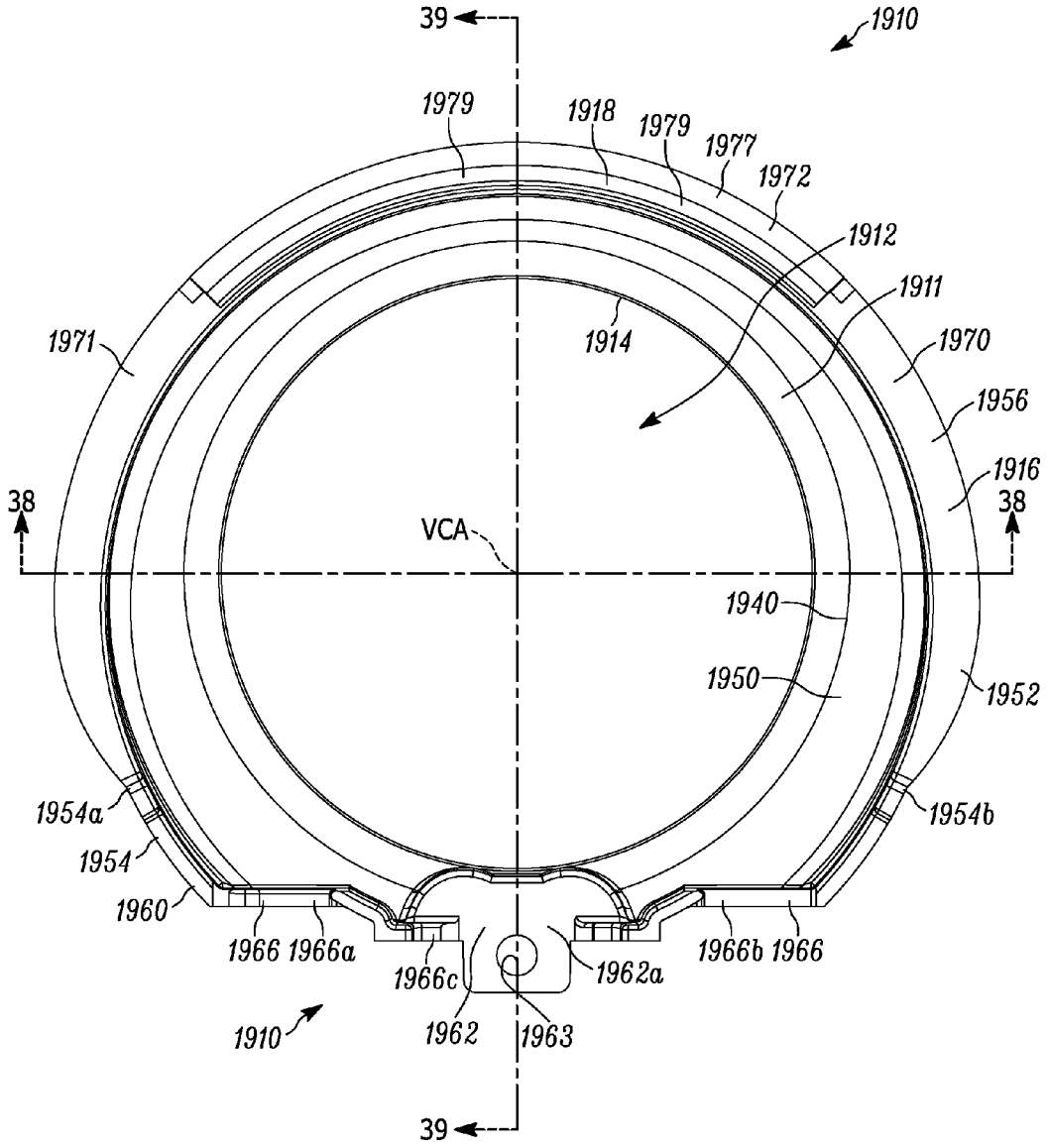
FIG. 37 is a schematic bottom plan view of the vacuum connector of FIG. 36.
Figure 38:
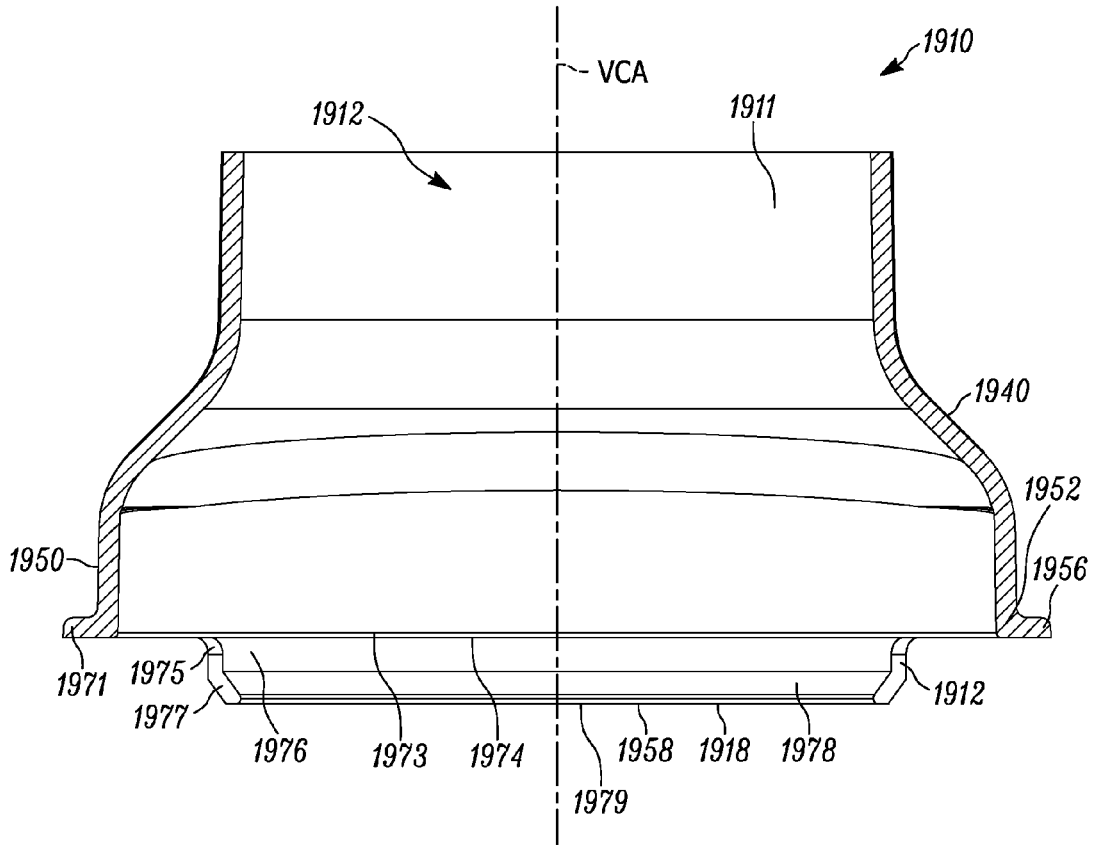
FIG. 38 is a schematic longitudinal section view of the vacuum connector of FIG. 16, as seen from a plane indicated by the line 38-38 in FIG. 37.
Figure 39:
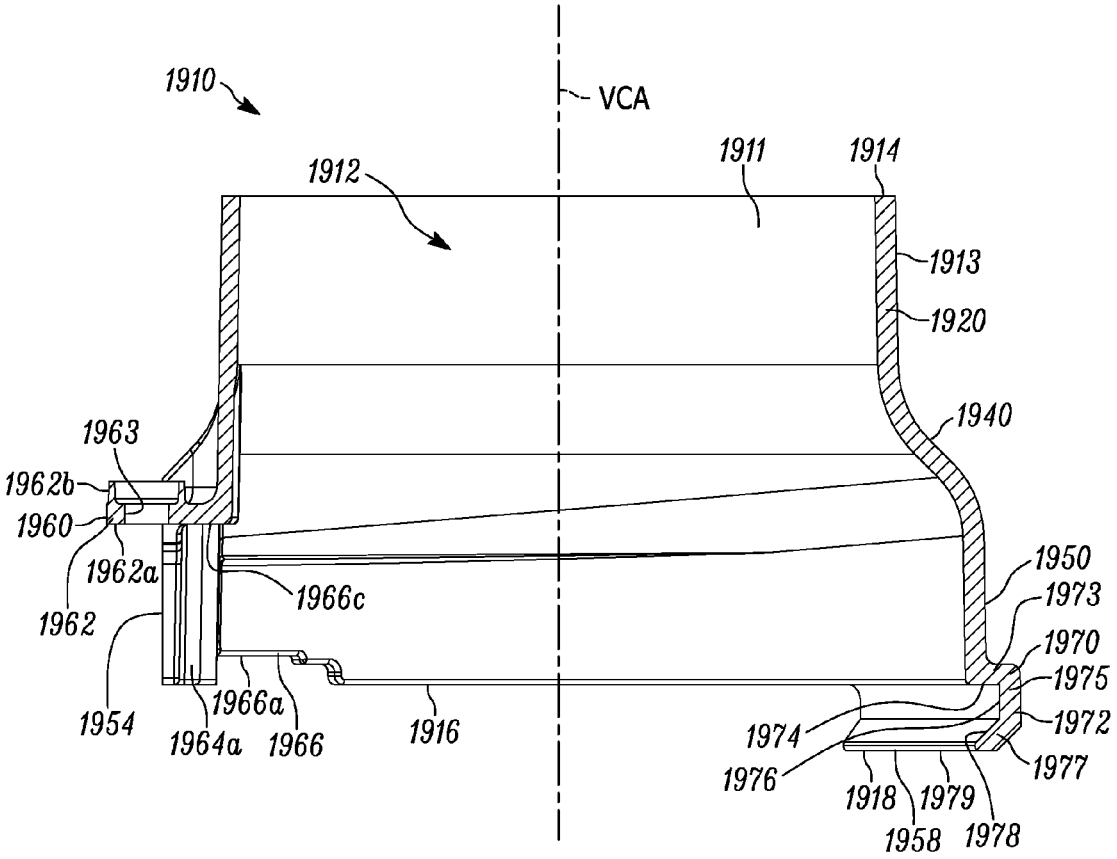
FIG. 39 is a schematic longitudinal section view of the vacuum connector of FIG. 36, as seen from a plane indicated by the line 39-39 in FIG. 37.

As can best be seen in FIG. 35, the guide section 1720 of the trim guide 1700 includes an upper end 1722 and a lower end 1724 and defines a guide section frustoconical wall 1721. The frustoconical wall 1721 extends along the frustoconical wall 1556 of the blade section 1550. The guide section 1720 of the trim guide 1700 includes interrupted arc portion 1738 circumferentially spaced apart by a plurality of notches 1730. In one exemplary embodiment, the notches of the plurality of notches 1730 are spaced equidistant about the lower end 1724 of the guide section 1720 and the number of notches 1730 is ten. The openings or cavities defined by each of the notches of the plurality of notches 1730 are generally a concave, slanted or skewed U-shape.

Unlike the trim guide 700 of the power operated rotary knife 100 of the first embodiment, the plurality of notches 1730 are disposed circumferentially in spaced-apart relationship about an entirety (that is around the entire 360° circumference) of the lower end 1724 of the guide section 1720. That is, in the trim guide 700, the guide section 720 included the forward portion 725, subtending just over 180 degrees of the total annulus defined by the trim guide 700. As shearing action for trimming of branches occurred in a region of the plurality of notches 730 of the guide section 720, for trimming branches, in the power operated rotary knife 100 of the first embodiment, the operator needed to pull the power operated rotary knife 100 in a rearward or proximal direction RW along the handle assembly longitudinal axis LA toward himself or herself since the plurality of notches 730 were positioned in a forward portion 726 of the guide section 720.

Advantageously, with the trim guide 1700 and the vacuum assembly 1900 of the power operated rotary knife 1100, the operator may move the power operated rotary knife 100 in any direction, i.e., toward the operator along the longitudinal axis LA of the handle assembly 1200 in the rearward or proximal direction RW, away from operator along the longitudinal axis LA of the handle assembly 1200 in the forward or distal direction FW, or anywhere therebetween, as plurality of notches 730 are spaced about the entire 360° of the guide section 1720 and shearing action is therefore not limited to a forward portion of the guide section but may take place at any circumferential position where a notch 1730 is disposed and shearing action occurs, as explained. Additionally and advantageously, the vacuum assembly 1900 functions to expeditiously and efficiently remove trimmed branch materials from the cutting opening CO region and away from the plant, keeping the plant and the plant bed areas clean and free from trimmed branch materials and possible diseases and other problems associated with leaving trimmed materials on the remaining branches of the plant or left to compost on the plant bed area.

The notches 1730 of the trim guide 1700 function to direct the plant branches to be cut into recessed shearing portions 1740 defined by each of the plurality of notches 1730 of the trim guide 1700 wherein the recessed arcuate cutting portions 1580 of the plurality of notches 1560 of the rotary knife blade 1500 cut the branches by shearing action as the blade 1500 rotates with respect to the stationary trim guide 1700. To cut or trim a branch and then evacuate the cut or severed portions of the branch, the power operated rotary knife 1100 is positioned with respect to a plant branch to be cut or trimmed such that the branch extends through the cutting opening CO defined by the power operated rotary knife 1100, the operator then moves the knife 1100 in a direction such that the branch is moved within the cutting opening CO and urged against the guide section 1720 of the trim guide 1700. Depending on the position of the branch within the cutting opening CO, the movement of the rotary knife 1100 by the operator will move the branch into one of the plurality of notches 1730 of the trim guide section 1720. A cutting portion 1580 of the rotary knife blade 1500 will impact the branch within the interior region 1745 of the notch 1720, cutting the branch by a shearing action between the shearing portion 1740 of the trim guide notch 1720 at the leading end 1732 of the notch 1720 and the cutting portion 1580 of the blade section notch 1560 at the trailing end 1570 of the notch 1560.

Figure 28:
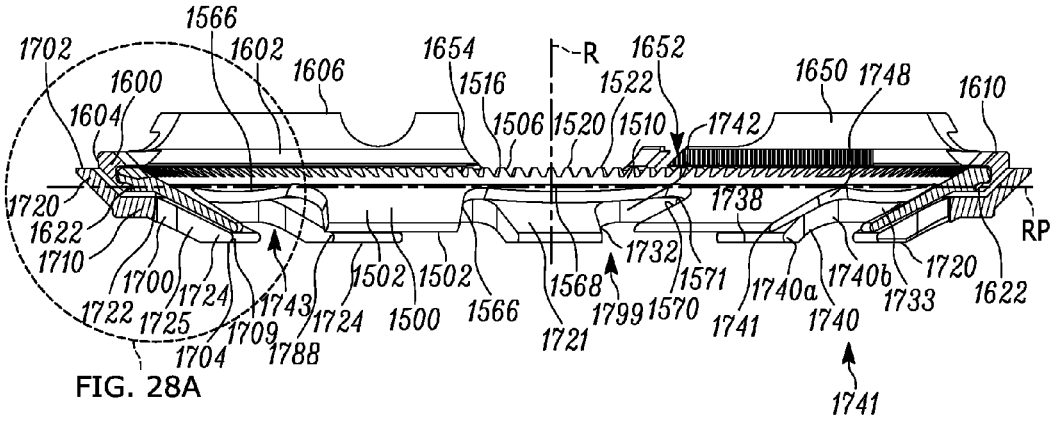
FIG. 28 is a schematic section view of the combination of the notched annular rotary knife blade, the blade housing, and the notched trim guide of the head assembly of the power operated rotary knife assembly of FIG. 20, as seen from a plane indicated by the line 28-28 in FIG. 26.
Figure 28A:
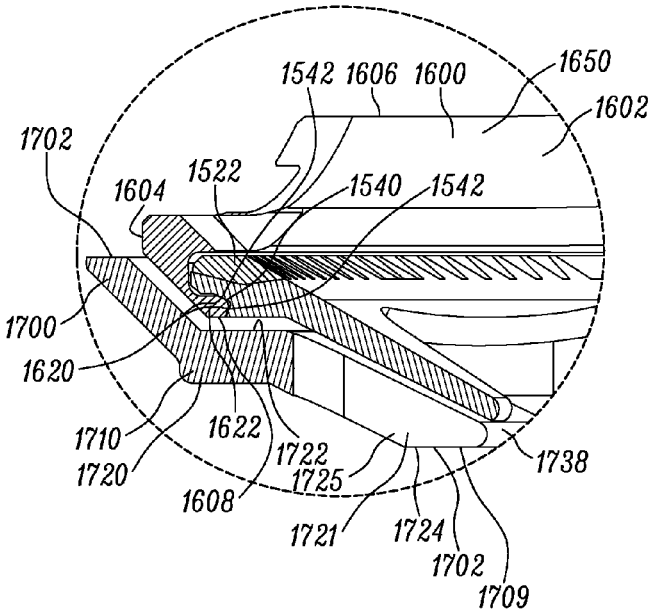
FIG. 28A is a schematic enlarged section view of the combination of the notched annular rotary knife blade, the blade housing, and the notched trim guide of FIG. 28 that is within a dashed circle labeled FIG. 28A in FIG. 28.

As best seen in FIG. 28, an extending distal portion 1725 of guide section 1720 extends axially below and radially inwardly beyond the lower edge 1509 of the rotary knife blade 1500 and has two functions: 1) to direct a branch or branches into an interior region 1745 defined by one of the plurality of notches 1730 as the power operated rotary knife 1100 is moved or manipulated by the operator to cut or trim a branch or branches within the central cutting opening CO of the knife 1100; and 2) to guard the rotary knife blade 1500 from inadvertent contact with the ground or plastic mats or sheets positioned on the ground between rows of plants. The trim guide 1700 also includes the guard section 1750 including the peripheral rib 1751 which extends axially above and radially outwardly from the base 1710. The rib 1751 extends around most, but not all of the total annulus defined by the trim guide 1700. Additionally, the vertical extension 1754 and the lip 1770 extend axially upwardly and radially inwardly from the upper end 1751*a* of the rib 1751. The vertical extension 1754 and the lip 1770 subtend an angle less than an angle subtended by the rib 1751. Both the rib 1751, the vertical extension 1754 and the lip 1770 of the guard section 1750 function as guards to protect the blade 1500 from inadvertent contact with plastic mats, portions of plants that are not to be trimmed or cut, and the like.

Figure 33:
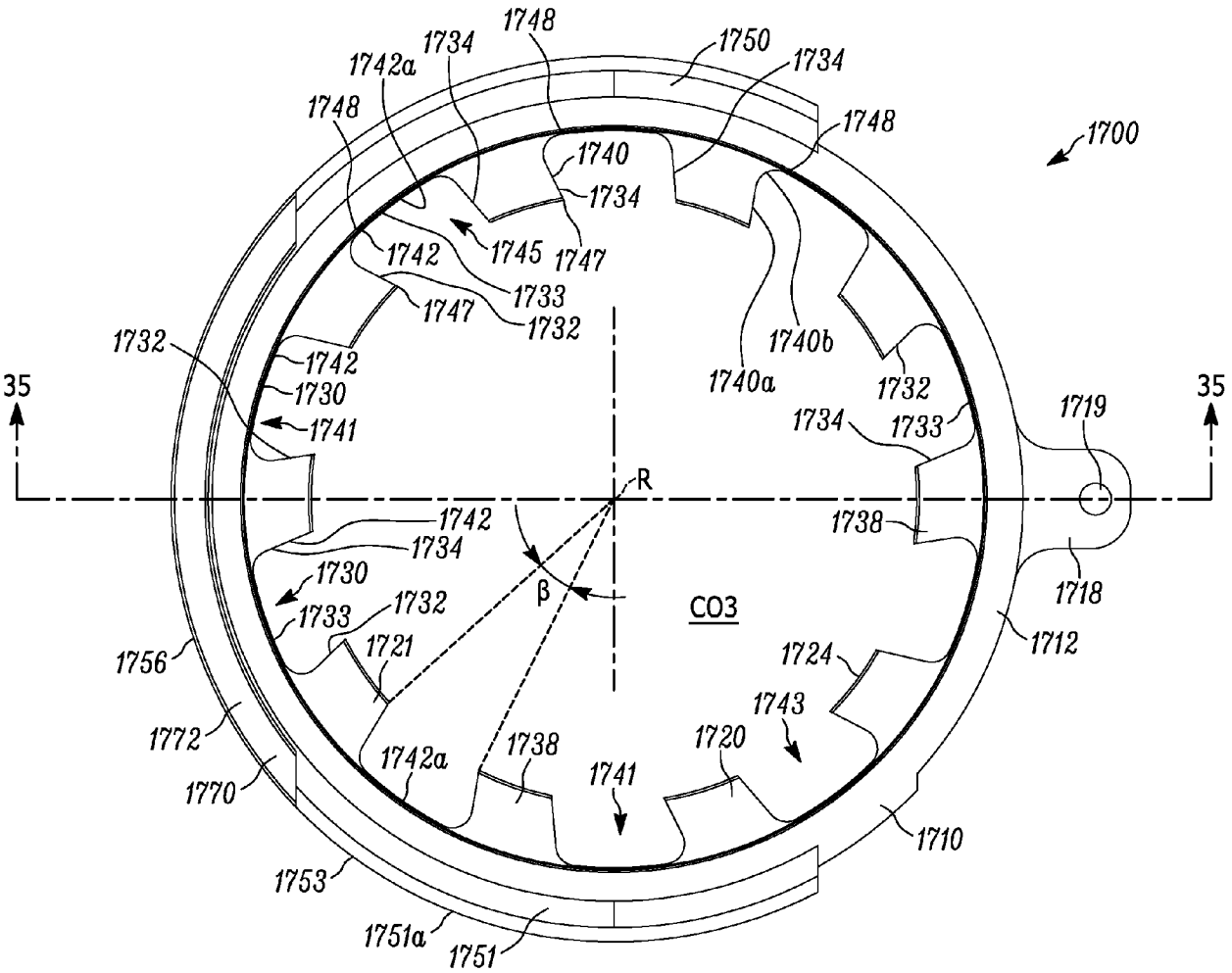
FIG. 33 is a schematic top plan view of the notched trim guide of FIG. 32.
Figure 34:
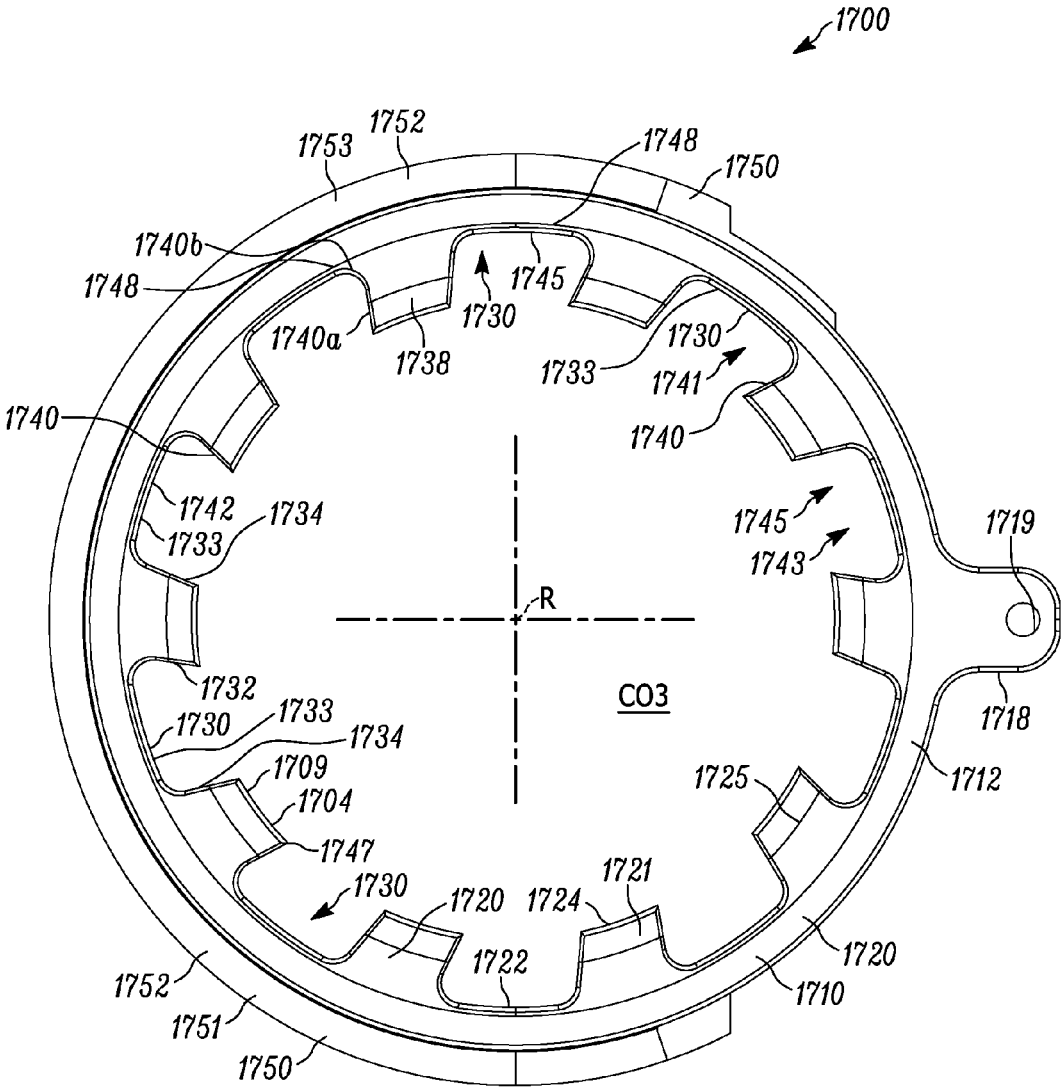
FIG. 34 is a schematic bottom plan view of the notched trim guide of FIG. 32.

As best seen in FIGS. 33-35, the guide section 1720 includes the plurality of notches 1730 formed the lower end 1724 and extending into the frustoconical wall 1721. The lower end 1724 of the guide section 1720 also includes interrupted arc portions 1738 that define a lower edge 1709 of the trim guide 1700. The interrupted are portions 1738 are centered about the blade central axis of rotation R and, if connected and continued, would form a circle defining an inner diameter of the trim guide 1700 with a center on the axis of rotation R. Interrupting the are portions 1738 of the guide section 1720 are the plurality of notches 1730 formed at the lower end 1724 of the frustoconical wall 1721 of the guide section 1720 and extending into the frustoconical wall 1721. As can best be seen in FIG. 33, each of the notches of the plurality of notches 1730, when viewed in top plan view, defines a slightly slanted, concave U-shaped cavity 1741 defined by a peripheral wall 1742 surrounding a central open portion 1743 and defining the cavity 1741. The central open portion 1743 corresponds to the interior region 1745 of the notch 1730. The peripheral wall 1742, when viewed with respect to the counterclockwise direction of rotation CCW (FIG. 26) of the rotary knife blade 1500, includes an angled leading portion or end 1732 (FIG. 33), a central portion 1733, and an angled trailing portion or end 1734. The central portion 1733, which is generally arcuate, defines a radially innermost section or region 1742*a* of the peripheral wall 1742.

The angled leading end 1734 of the peripheral wall 1742 defines a shearing region or portion 1740 extending approximately from a termination point 1747 at the lower end 1724 of the guide section 1720 where the next adjacent interrupted are portion 1738 commences and extending to a transition point 1748 along the central portion 1733 of the peripheral wall 1742 where the angled leading end 1732 terminates. The transition point 1748 being along the central portion 1733 is one of the radially innermost points of the peripheral wall 1742. When viewed in top plan view, the shearing portions 1740 defined by the leading ends 1734 of the respective plurality of notches 1730 define a linear segment 1740*a* over most of their extent moving radially inwardly from the lower end 1724 of the guide section 1720 and then transition into a shorter arcuate segment 1740*b* as the transition point 1748 of the peripheral wall 1742 is approached. The shearing portions 1740 of the plurality of notches 1730 of the trim guide 700 are recessed in that at least a portion of the shearing portion 1740 is within an interior region 1745 (that is, the central open portion 1743) defined by each of the plurality of notches 1730.

As explained above, the cutting action of the power operated rotary knife 1100 occurs through the combination 1480 of the rotating rotary knife blade 1500 and the stationary trim guide 1700. As the blade 1500 rotates about its central axis of rotation R, the shearing portions 1740 of the guide section notches 1730 come into overlapping axial alignment with the arcuate cutting portions 1580 of the blade section notches 1560. Additionally, the central open portion 1564 or interior region 1582 of each of the plurality of notches 1560 of the blade section 1550 of the rotary knife blade 1500 come into overlapping axial alignment with the central open portion 1743 or interior region 1745 of each of the plurality of notches 1730 as the blade 1500 rotates about the axis of rotation R. This transitory overlapping alignment of the central open portions 1564, 1743 or interior regions 1582, 1745 define transitory cutting pockets 1799. (Such transitory cutting pockets 1799 are depicted schematically, for example, in FIGS. 26 and 27. The uncut branch or branches directed into a transitory pocket 1799 by the guide section 1720 of the trim guide 1700, that is, guided into a trim guide notch 1730, will be rapidly and efficiently cut by the shearing action of the rotating cutting portions 1580 of the blade 1500 passing over the stationary shearing portions 1740 of the trim guide 1700 as the rotary knife blade 1500 continues its high speed rotation in the counterclockwise direction CCW. The cutting pockets 1799 are transitory in that as the blade 1500 continues to rotate about its axis of rotation R, the blade 1500 rotates with respect to the stationary trim guide 1700. Thus, as would be understood, new cutting pockets 1799 are formed by overlapping interior regions 1582, 1745 and then disappear as cutting of the branch or branches with the cutting pockets 1799 occurs by shearing action by virtue of the rotating cutting portions 1580 of the blade 1500 passing over the stationary shearing portions 1740 of the trim guide 1700. Thus, as the blade 1500 rotates about the central axis of rotation R, new cutting pockets 1799 are constantly formed and old cutting pockets 1799 disappear as cutting occurs and branches in the cutting pockets are cut by shearing action.

In one exemplary embodiment of the trim guide 1700 of the power operated rotary knife 1100, an inner diameter of the trim guide 1700, as defined by the interrupted arc portions 1738 constituting the lower edge 1709 of the trim guide 1700, is approximately 3.808 in., while a diameter defined by a radially innermost point of each of the plurality of notches 1730 of the guide section 1720 is approximately 4.631 in. Additionally, in one exemplary embodiment, the number notches in the plurality of notches 1730 is ten, spaced about the entirety of the 360° of the central opening CO3 of the trim guide 1700 and circumferentially spaced apart by ten interrupted are portions 1738 wherein each of the notches of the plurality of notches 1730 subtends an angle β (depicted schematically in FIG. 33) with respect to the central axis of rotation R of approximately 21°.

Advantageously, with the trim guide 1700 and the vacuum assembly 1900 of the power operated rotary knife 1100, the operator may move the power operated rotary knife 100 in any direction, i.e., a rearward or proximal direction RW toward the operator along the longitudinal axis LA of the handle assembly 1200, a forward or distal direction FW away from operator, or any direction therebetween, as plurality of notches 1730 are spaced about the entire 360° of the guide section 1720 and shearing action is therefore not limited to a forward portion of the guide section but may take place at any circumferential position where a notch 1730 is disposed and shearing action occurs, as explained. Additionally and advantageously, the vacuum assembly 1900 functions to expeditiously and efficiently remove trimmed branch materials from the cutting opening CO region and away from the plant, keeping the plant and the plant bed areas clean and free from trimmed branch materials and possible issues associated with leaving trimmed materials on the remaining branches of the plant or dropping to the ground and decaying on the ground in the plant bed area.

Vacuum Assembly 1900

As best seen in FIGS. 20-23 and 36-40, the vacuum assembly includes the vacuum connector 1910, which, as described above is also part of the head assembly 1300 of the power operated rotary knife 1100, a flexible vacuum hose 1990, which is coupled to an upper or exit end 1925 of the vacuum connector 1910 by a clamp 1995. In one exemplary embodiment, the vacuum hose is a 4 in. diameter flexible hose or duct which defines the interior region 1992 of the vacuum hose 1990.

The vacuum connector 1910 has a generally inverted funnel shape and includes the lower, larger diameter lower mounting section 1950 and an upper, reduced diameter cylindrical section 1920, bridged by a tapered middle section 1940 that necks down the diameter between the mounting section 1950 and the cylindrical section 1920. An inner wall or inner surface 1911 of the vacuum connector 1910 defines the inverted funnel-shaped interior region 1912 that is in fluid communication with the interior region 1992 of the vacuum hose 1990. An outer wall or outer surface 1913 is radially spaced from the inner wall 1911 and generally conforms to the shaped of the inner wall 1911. Advantageously, the necked down configuration of the vacuum connector 1910 provides for the funnel shape of the interior region 1912 that proceeds from a larger diameter at a generally cylindrical entry end 1916 of the vacuum connector 1910, where trimmed branches/foliage material enter the interior region 1912 of the vacuum connector 1910 from the cutting opening CO of the power operated rotary knife 1100 defined by the assembled combination 1450 of the blade 1500, blade housing 1600 and trim guide 1700, to a cylindrical exit or upper end 1914 of the vacuum connector 1910, where trimmed branches and foliage material exit the interior region 1912 of the vacuum connector 1910. Additionally, the inner surface 1911 of the vacuum connector 1910 is smooth, with minimal discontinuities, to facilitate flow of trimmed foliage materials from the entry end 1916 to the exit end 1914 of the vacuum connector 1910. The vacuum connector 1910 is centered about a central axis VCA extending though the interior region 1912 of the vacuum connector 1910. When the vacuum connector 1910 is coupled to the head assembly 1300 of the power operated rotary knife 1100, the central axis VCA of the vacuum connector 1910 is substantially parallel to but slightly offset by a radial distance schematically shown as distance d in FIG. 21, from the central axis of rotation R of the rotary knife blade 1500. In one exemplary embodiment, an offset distance d between the rotary knife blade axis of rotation R and the vacuum connector central axis VAC is 0.200 in.

The lower mounting section 1950 of the vacuum connector 1910 includes a lower end 1952. The lower end 1952 of the mounting section 1950 includes a lower edge 1958. The lower end 1952 of the mounting section 1950 corresponds to a lower end 1916 of the vacuum connector 1910. The lower edge 1958 of the lower end 1952 of the mounting section 1950, which corresponds to a lower edge 1918 of the lower end 1916 of the vacuum connector 1910, is defined by an axially lowest peripheral edge 1979 of a C-shaped latch 1972 of the a trim guide interface portion 1970. A generally proximal portion 1954 of the lower end 1952 includes a clamp interface portion 1960, while a generally distal portion 1959 of the lower end 1952 includes the trim guide interface portion 1970. The clamp interface portion 1960 extends peripherally between approximate endpoints 1954*a*, 1954*b* of the proximal portion 1954, while the trim guide interface portion 1960 includes the remainder of the lower end 1952. The arcuate trim guide interface portion 1970 and the clamp interface portion 1960, advantageously function in co-acting relationship to releasably secure the vacuum connector 1910 to the head assembly 1300 of the power operated rotary knife 1100.

The arcuate trim guide interface portion 1970 of the lower mounting section 1950 of the vacuum connector 1910 includes the radially extending arcuate rim portion 1971 that seats on the rib 1751, the vertical extension 1754 and the lip 1770 of the guard section 1750 of the trim guide 1700. As can be seen in FIG. 21, more specifically, extending from the annular rim 1953 of the trim guide interface portion 1970 of the vacuum connector 1910 is the C-shaped latch 1972 that hooks over and thereby attaches the vacuum connector 1910 to the guard section 1750 of the trim guide 1700, acting in cooperation with the clamp interface portion 1960. The arcuate trim guide interface portion 1970 extends radially outwardly from and axially below the entry opening 1914 of the vacuum connector 1910 and subtends an angle of approximately 270° with respect to the central axis VCA of the vacuum connector 1910. That is, the trim guide interface portion 1970 (approximately 270°) and the clamp interface portion 1960 (approximately 90°) circumscribe the entirety of the circular lower peripheral surface of the vacuum connector 1910 with respect to the vacuum connector central axis VCA.

The C-shaped latch 1972 of the trim guide interface portion 1970 is located at and extends from a lower end 1956 of the distal portion 1952 of the lower mounting section 1950 of the vacuum connector 1910. The C-shaped latch 1972 includes an upper horizontal section 1973, a vertical section 1975, and a lower frustoconical section 1977. When the trim guide interface portion 1960 is latched to the trim guide 1700, a horizontal wall 1974 of the upper horizontal section 1973 bears against an upper surface 1772 of the radially inwardly extending lip 1770 of the guard section 1750 in the trim guide 1700, a vertical wall 1976 of the middle vertical section 1975 bears against an outer surface 1753 of the vertical extension 1754 of the guard section 1750 of the trim guide 1700, and an angled wall 1978 bears against the outer surface 1753 of the frustoconical section 1752 of the rib 1751 of the guard section 1750 of the trim guide 1700. The axially lowest peripheral edge 1979 of the C-shaped latch 1972 defines the lower edge 1918 of the lower end 1916 of the vacuum connector 1910 and the lower edge 1958 of the lower end 1952 of mounting section 1950.

Figure 40:
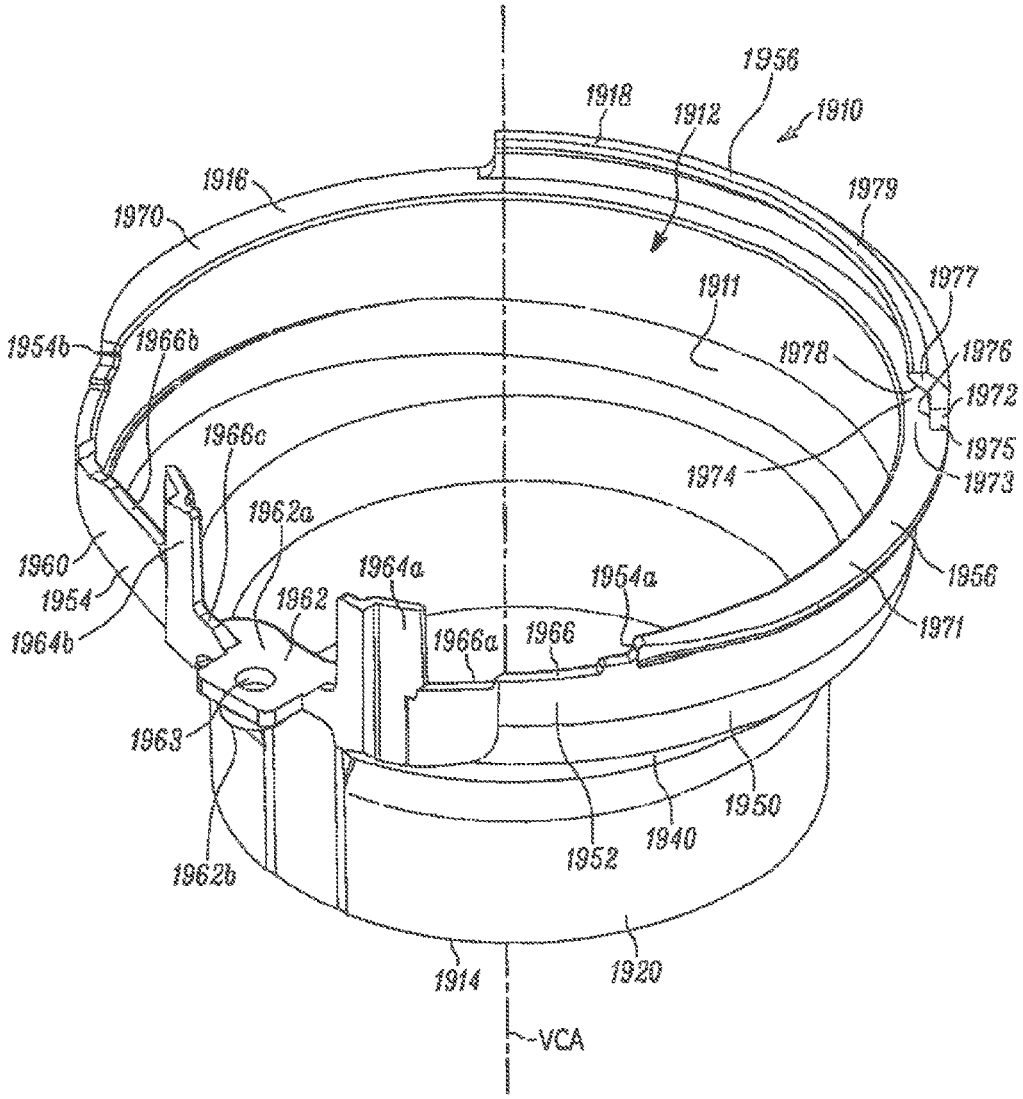
FIG. 40 is a schematic bottom perspective view of the vacuum connector of FIG. 36.

Additionally, as best seen in FIG. 40, the clamp interface portion 1960 of the proximal portion 1954 of the lower mounting section 1950 includes a radially protruding boss 1962 having a planar lower surface 1962*a* and a cylindrical projection 1962*b* extending axially upwardly. The boss 1962 defines a vertical opening 1963. A threaded connector 1980, preferably a thumb screw, extends through the boss vertical opening 1963 and threads into a threaded vertically extending opening 1342 in an upper surface 1340 of the clamp 1332 of the clamping assembly 1330 to secure the vacuum connector 1910 to the clamp 1332 of the clamp assembly 1330. Stated another way, the threaded fastener/thumb screw 1980 extends through the vertically oriented opening 1963 of the radially extending boss 1962 of the clamp interface portion 1960 of the mounting section 1950 and threads into the threaded opening 1342 formed in the upper surface 1340 of the clamp member 1332 to secure the vacuum connector 1910 to the clamp member 1332 and thereby couple the vacuum connector 1910 to the frame body 1310.

The clamp interface portion 1960 further includes a pair of axially extending pedestals 1964*a*, 1964*b* circumferentially flanking the boss 1962. The pair of pedestals 1964*a*, 1964*b* fit into and engage respective ones of a pair of axially extending slots 1335 formed in the proximal wall 1333 of the clamp 1332. The clamp interface portion 1960 further includes a contoured opening 1966 sized and shaped to engage the upper surface 1340 of the clamp 1332. The contoured opening 1966 is defined by the lower edge 1958 of the lower end 1952 of the vacuum connector 1910 in the region of the clamp interface portion 1960. The contoured opening 1966 of the clamp interface portion 1960 comprises a pair of lateral contoured openings 1966*a*, 1966*b* and a central contoured opening 1966*c*. The contoured opening 1966*a* is adjacent the pedestal 1964*a*, while the contoured opening 1962*b* is adjacent the pedestal 1964*b*. The central contoured opening 1966*c*, which includes the generally planar lower surface 1962*a* of the boss 1962, engages a central portion 1341 of the upper surface 1340 of the clamp 1332. The contoured opening 1962 is defined by a lower peripheral edge 1964 of the lower mounting section 1950 in the region of the clamp 1332. The peripheral edge 1964 bears against the upper surface 1340 of the clamp 1332 along a region of contact corresponding to the clamp interface portion 1960, that is, the portion 1954 of the lower end 1952 of the mounting section 1950 of the vacuum connector 1910 corresponding to the clamp interface portion 1960 to provide a seal between the vacuum connector 1910 and the clamp upper surface 1340 to mitigate loss of vacuum pressure which would otherwise occur if there was a gap or space between the vacuum connector 1910 and the upper surface of the clamp 1332.

As used herein, terms of orientation and/or direction such as front, rear, forward, rearward, distal, proximal, distally, proximally, upper, lower, inward, outward, inwardly, outwardly, upwardly, downwardly, horizontal, horizontally, vertical, vertically, axial, radial, longitudinal, axially, radially, longitudinally, etc., are provided for convenience purposes and relate generally to the orientation shown in the Figures and/or discussed in the Detailed Description. Such orientation/direction terms are not intended to limit the scope of the present disclosure, this application, and/or the invention or inventions described therein, and/or any of the claims appended hereto. Further, as used herein, the terms comprise, comprises, and comprising are taken to specify the presence of stated features, elements, integers, steps or components, but do not preclude the presence or addition of one or more other features, elements, integers, steps or components.

What have been described above are examples of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A power operated rotary knife comprising:

an annular rotary knife blade supported for rotation about a central axis of rotation in a direction of rotation and rotating with respect to a trim guide, the knife blade including an annular body including an inner wall and an outer wall and an upper end and a lower end, the annular body of the rotary knife blade including a bearing surface for rotational support of the rotary knife blade and a driven gear for rotationally driving the rotary knife blade, the rotary knife blade further including a blade section extending from the lower end of the annular body, the blade section including a blade frustoconical wall extending between an upper end of the blade section and a lower end of the blade section, the lower end of the blade section spaced radially inwardly from and axially below the upper end of the blade section, a plurality of circumferentially spaced apart notches extending from the lower end of the blade section into the blade frustoconical wall, each of the plurality of notches including a peripheral wall surrounding a central open portion, the peripheral wall including a cutting portion, the cutting portion of each of the plurality of circumferentially spaced apart notches defining a cutting edge of the rotary knife blade; and the trim guide including a base and a guide section extending radially inwardly and axially downwardly from the base, the guide section extending axially below and being adjacent to the blade section of the rotary knife blade and including a guide frustoconical wall extending between an upper end of the guide section and a lower end of the guide section, the lower end of the guide section spaced radially inwardly from the upper end, a plurality of circumferentially spaced apart notches extending from the lower end of the guide section into the guide frustoconical wall, each of the plurality of notches including a peripheral wall surrounding a central open portion, the peripheral wall including a shearing portion, the shearing portion in overlapping axial alignment with the cutting portions of the plurality of notches of the blade section of the rotary knife blade as the rotary blade rotates about the central axis of rotation.

2. The power operated rotary knife of claim 1 wherein the cutting portion of each of the plurality of notches of the blade section of the rotary knife blade are arcuate.

3. The power operated rotary knife of claim 1 wherein the cutting portion of each of the plurality of notches of the blade section of the rotary knife blade define a trailing end of the notch with respect to the direction of rotation of the blade.

4. The power operated rotary knife of claim 1 wherein the lower end of the guide section of the trim guide extends radially inwardly of the lower end of the blade section of the rotary knife blade.

5. The power operated rotary knife of claim 1 wherein the lower end of the guide section of the trim guide extends axially below the lower end the blade section of the rotary knife blade.

6. The power operated rotary knife of claim 1 wherein the trim guide includes a circumferential rib that extends from the base of the trim guide, the circumferential rib extending axially above and radially outwardly of the blade section of the rotary knife blade.

7. The power operated rotary knife of claim 1 wherein the cutting portion of each of the plurality of notches of the blade section defining the cutting edge of the rotary knife blade is adjacent the lower end of the blade section.

8. The power operated rotary knife of claim 1 wherein the shearing portion of each of the plurality of notches of the guide section of the trim guide is adjacent the lower end of the guide section.

9. The power operated rotary knife of claim 1 further including a vacuum connector coupled to the blade housing, the vacuum connector releasably coupled to the trim guide and including an inner surface defining a funnel-shaped interior region, the vacuum connector including an upper cylindrical section, a tapered middle section and a lower mounting section, the lower mounting section including a trim guide interface portion including an arcuate rim portion and a latch extending from the arcuate rim portion, the trim guide further including a guard section extending axially upwardly from the base and having a radially inwardly extending lip, the latch of the trim guide interface portion of the vacuum connector releasably secured to the radially inwardly extending lip of the guard section of the trim guide to releasably couple the vacuum connector to the trim guide.

10. A combination of an annular rotary knife blade and a trim guide for a power operated rotary knife, the combination comprising:

the annular rotary knife blade supported for rotation about a central axis of rotation in a direction of rotation and rotating with respect to the trim guide, the knife blade including an annular body including an inner wall and an outer wall and an upper end and a lower end, the annular body of the rotary knife blade including a bearing surface for rotational support of the rotary knife blade and a driven gear for rotationally driving the rotary knife blade, the rotary knife blade further including a blade section extending from the lower end of the annular body, the blade section including a blade frustoconical wall extending between an upper end of the blade section and a lower end of the blade section, the lower end of the blade section spaced radially inwardly from and axially below the upper end, a plurality of circumferentially spaced apart notches extending from the lower end of the blade section into the blade frustoconical wall, each of the plurality of notches including a peripheral wall surrounding a central open portion, the peripheral wall including a cutting portion, the cutting portion of each of the plurality of circumferentially spaced apart notches defining a cutting edge of the rotary knife blade;

the trim guide including a base and a guide section extending radially inwardly and axially downwardly from the base, the guide section extending axially below and being adjacent to the blade section of the rotary knife blade and including a guide frustoconical wall extending between an upper end of the guide section and a lower end of the guide section, the lower end of the guide section spaced radially inwardly from the upper end of the guide section, a plurality of circumferentially spaced apart notches extending from the lower end of the guide section into the guide frustoconical wall, each of the plurality of notches including and a peripheral wall surrounding a central open portion, the peripheral wall including a shearing portion, the shearing portion in overlapping axial alignment with the cutting portions of the plurality of notches of the blade section of the rotary knife blade as the rotary blade rotates about the central axis of rotation in the direction of rotation.

11. The combination of claim 10 wherein the cutting portion of each of the plurality of notches of the blade section of the rotary knife blade are arcuate.

12. The combination of claim 10 wherein the arcuate portion of each of the plurality of notches of the blade section of defining the cutting edge of the blade rotary blade define a trailing end of the notch with respect to the direction of rotation of the blade.

13. The combination of claim 10 wherein the lower end of the guide section of the trim guide extends radially inwardly of the lower end of the blade section of the rotary knife blade.

14. The combination of claim 10 wherein the lower end of the guide section of the trim guide extends axially below the lower end the blade section of the rotary knife blade.

15. The combination of claim 10 wherein the trim guide includes a circumferential rib that extends from the base of the trim guide, the circumferential rib extending axially above and radially outwardly of the blade section of the rotary knife blade.

16. The combination of claim 10 wherein the cutting portion of each of the plurality of notches of the blade section defining the cutting edge of the rotary knife blade is adjacent the lower end of the blade section.

17. The combination of claim 10 wherein the shearing portion of each of the plurality of notches of the guide section of the trim guide is adjacent the lower end of the guide section.

18. An annular rotary knife blade for a power operated rotary knife, the annular rotary knife blade supported for rotation about a central axis of rotation by an annular blade housing of the power operated rotary knife, the annular rotary knife blade comprising:

an annular body including an inner wall and an outer wall and an upper end and a lower end, the annular body of the rotary knife blade including a bearing surface for rotational support of the rotary knife blade and a driven gear for rotationally driving the rotary knife blade, the rotary knife blade further including a blade section extending from the lower end of the annular body, the blade section including a blade frustoconical wall extending between an upper end of the blade section and a lower end of the blade section, the lower end of the blade section spaced radially inwardly from and axially below the upper end, a plurality of circumferentially spaced apart notches extending from the lower end of the blade section into the blade frustoconical wall, each of the plurality of notches including a peripheral wall surrounding a central open portion, the peripheral wall including a leading portion, a central portion and a U-shaped trailing portion, the leading portion and the U-shaped trailing portion being circumferentially spaced apart by the central portion, the U-shaped trailing portion including a cutting portion, the cutting portion of each of the plurality of circumferentially spaced apart notches defining a cutting edge of the rotary knife blade.

19. A trim guide for a power operated rotary knife having an annular rotary knife blade supported for rotation by an annular blade housing about a central axis of rotation, the annular rotary knife blade rotating with respect to the trim guide, the trim guide comprising:

a base and a guide section extending radially inwardly and axially downwardly from the base, the guide section including a guide frustoconical wall extending between an upper end of the guide section and a lower end of the guide section, the lower end of the guide section spaced radially inwardly from the upper end of the guide section, the guide section including a plurality of circumferentially spaced apart notches extending from the lower end of the guide section into the guide frustoconical wall, each of the plurality of notches including a peripheral wall surrounding a central open portion, the peripheral wall defining a slanted, U-shaped cavity in plan view, the peripheral wall including a shearing portion.

20. The trim guide of claim 19 further including a guard section extending axially upwardly from the base and having a radially inwardly extending lip.

21. The annular rotary knife blade of claim 18 wherein, for each of the plurality of circumferentially spaced apart notches, the central open portion of the peripheral wall is generally rectangular shaped in plan view.

22. The annular rotary knife blade of claim 18 wherein, for each of the plurality of circumferentially spaced apart notches, the central portion of the peripheral wall is generally linear.

23. The annular rotary knife blade of claim 18 wherein, for each of the plurality of circumferentially spaced apart notches, the leading portion of the peripheral wall is angled.

24. An annular rotary knife blade for a power operated rotary knife, the annular rotary knife blade supported for rotation about a central axis of rotation by an annular blade housing of the power operated rotary knife, the annular rotary knife blade comprising:

an annular body including an inner wall and an outer wall and an upper end and a lower end, the annular body of the rotary knife blade including a bearing surface for rotational support of the rotary knife blade and a driven gear for rotationally driving the rotary knife blade, the rotary knife blade further including a blade section extending from the lower end of the annular body, the blade section including a blade frustoconical wall extending between an upper end of the blade section and a lower end of the blade section, the lower end of the blade section spaced radially inwardly from and axially below the upper end, a plurality of circumferentially spaced apart notches extending from the lower end of the blade section into the blade frustoconical wall, each of the plurality of notches including a peripheral wall surrounding a central open portion being generally rectangular shaped in plan view, the peripheral wall including a cutting portion, the cutting portion of each of the plurality of circumferentially spaced apart notches defining a cutting edge of the rotary knife blade.

25. The annular rotary knife blade of claim 24 wherein, for each of the plurality of circumferentially spaced apart notches, the peripheral wall includes a leading portion, a central portion and a U-shaped trailing portion, the leading portion and the U-shaped trailing portion being radially spaced apart by the central portion, the U-shaped trailing portion including the cutting portion.

26. An annular rotary knife blade for a power operated rotary knife, the annular rotary knife blade supported for rotation about a central axis of rotation by an annular blade housing of the power operated rotary knife, the annular rotary knife blade comprising:

an annular body including an inner wall and an outer wall and an upper end and a lower end, the annular body of the rotary knife blade including a bearing surface for rotational support of the rotary knife blade and a driven gear for rotationally driving the rotary knife blade, the rotary knife blade further including a blade section extending from the lower end of the annular body, the blade section including a blade frustoconical wall extending between an upper end of the blade section and a lower end of the blade section, the lower end of the blade section spaced radially inwardly from and axially below the upper end, a plurality of circumferentially spaced apart notches extending from the lower end of the blade section into the blade frustoconical wall, each of the plurality of notches including a peripheral wall surrounding a central open portion, the peripheral wall including a leading portion, a central portion and a hook-shaped trailing portion, the leading portion and the hook-shaped trailing portion being radially spaced apart by the central portion, the hook-shaped trailing portion including a cutting portion, the cutting portion of each of the plurality of circumferentially spaced apart notches defining a cutting edge of the rotary knife blade.

27. The annular rotary knife blade of claim 26 wherein, for each of the plurality of circumferentially spaced apart notches, the central open portion of the peripheral wall is generally rectangular shaped in plan view.

28. The annular rotary knife blade of claim 26 wherein, for each of the plurality of circumferentially spaced apart notches, the central portion of the peripheral wall is generally linear.

29. The annular rotary knife blade of claim 26 wherein, for each of the plurality of circumferentially spaced apart notches, the leading portion of the peripheral wall is angled.

30. The trim guide of claim 19 wherein the peripheral wall includes an angled leading portion and an angled trailing portion circumferentially spaced by a central portion, the angled leading portion including the cutting portion.

* * * * *